US008328335B2

(12) United States Patent
Xie et al.

(10) Patent No.: US 8,328,335 B2
(45) Date of Patent: Dec. 11, 2012

(54) LIQUID DISPENSER INCLUDING SLOPED OUTLET OPENING WALL

(75) Inventors: Yonglin Xie, Pittsford, NY (US); Joseph Jech, Jr., Webster, NY (US); Carolyn R. Ellinger, Rochester, NY (US); Maria J. Lehmann, Spencerport, NY (US); Ali G. Lopez, Pittsford, NY (US); Qing Yang, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 114 days.

(21) Appl. No.: 12/911,758

(22) Filed: Oct. 26, 2010

(65) Prior Publication Data

US 2012/0098892 A1 Apr. 26, 2012

(51) Int. Cl.
*B41J 2/04* (2006.01)

(52) U.S. Cl. ..... 347/54; 347/20; 347/65

(58) Field of Classification Search ..... 347/20, 347/44, 47, 56, 61–65, 67, 73, 82, 84–85, 347/89

See application file for complete search history.

(56) References Cited

U.S. PATENT DOCUMENTS

| | | | | |
|---|---|---|---|---|
| 4,345,259 | A | 8/1982 | Reitberger | |
| 4,435,719 | A | 3/1984 | Snaper | |
| 5,097,275 | A * | 3/1992 | Takita | 347/56 |
| 5,156,306 | A | 10/1992 | Perera | |
| 7,364,268 | B2 * | 4/2008 | Hart et al. | 347/47 |
| 2007/0188564 | A1 | 8/2007 | Harvey et al. | |
| 2007/0291082 | A1 | 12/2007 | Baumer et al. | |
| 2009/0135223 | A1 | 5/2009 | Xie et al. | |
| 2009/0195612 | A1 | 8/2009 | Xie et al. | |
| 2010/0053270 | A1 | 3/2010 | Xu et al. | |

FOREIGN PATENT DOCUMENTS

| | | |
|---|---|---|
| EP | 0 436 509 | 7/1991 |
| WO | WO 95/10415 | 4/1995 |

* cited by examiner

*Primary Examiner* — Juanita D Jackson
(74) *Attorney, Agent, or Firm* — William R. Zimmerli

(57) ABSTRACT

A liquid dispenser is provided that includes a liquid supply channel, a liquid dispensing channel, and a liquid return channel. The liquid dispensing channel includes a wall. The wall includes a surface. A portion of the wall defines an outlet opening that includes a downstream edge relative to a direction of liquid flow through the liquid dispensing channel. The downstream edge is sloped relative to the surface of the wall of the liquid dispensing channel. A liquid is provided that flows from the liquid supply channel through the liquid dispensing channel to the liquid return channel. A liquid drop is caused to be ejected from the outlet opening of the liquid dispensing channel by selectively actuating a diverter member to divert a portion of the flowing liquid through the outlet opening of the liquid dispensing channel.

17 Claims, 37 Drawing Sheets

LIQUID DISPENSER INCLUDING SLOPED OUTLET OPENING WALL

CROSS REFERENCE TO RELATED APPLICATIONS

Reference is made to commonly-assigned, U.S. patent application Ser. No. 12/911,756, entitled "LIQUID DISPENSER INCLUDING SLOPED OUTLET OPENING WALL", filed concurrently herewith.

FIELD OF THE INVENTION

This invention relates generally to the field of fluid dispensers and, in particular, to flow through liquid drop dispensers that eject on demand a quantity of liquid from a continuous flow of liquid.

BACKGROUND OF THE INVENTION

Traditionally, inkjet printing is accomplished by one of two technologies referred to as "drop-on-demand" and "continuous" inkjet printing. In both, liquid, such as ink, is fed through channels formed in a print head. Each channel includes a nozzle from which droplets are selectively extruded and deposited upon a recording surface.

Drop-on-demand printing only provides drops (often referred to a "print drops") for impact upon a print media. Selective activation of an actuator causes the formation and ejection of a drop that strikes the print media. The formation of printed images is achieved by controlling the individual formation of drops. Typically, one of two types of actuators is used in drop-on-demand printing—heat actuators and piezoelectric actuators. With heat actuators, a heater, placed at a convenient location adjacent to the nozzle, heats the ink. This causes a quantity of ink to phase change into a gaseous steam bubble that raises the internal ink pressure sufficiently for an ink droplet to be expelled. With piezoelectric actuators, an electric field is applied to a piezoelectric material possessing properties causing a wall of a liquid chamber adjacent to a nozzle to be displaced, thereby producing a pumping action that causes an ink droplet to be expelled.

Continuous inkjet printing uses a pressurized liquid source that produces a stream of drops some of which are selected to contact a print media (often referred to as "print drops") while other are selected to be collected and either recycled or discarded (often referred to as "non-print drops"). For example, when no print is desired, the drops are deflected into a capturing mechanism (commonly referred to as a catcher, interceptor, or gutter) and either recycled or discarded. When printing is desired, the drops are not deflected and allowed to strike a print media. Alternatively, deflected drops can be allowed to strike the print media, while non-deflected drops are collected in the capturing mechanism.

Printing systems that combine aspects of drop-on-demand printing and continuous printing are also known. These systems, often referred to as flow through liquid drop dispensers, provide increased drop ejection frequency when compared to drop-on-demand printing systems without the complexity of continuous printing systems. As such, there is an ongoing need and effort to increase the reliability and performance of flow through liquid drop dispensers.

SUMMARY OF THE INVENTION

According to one aspect of the invention, a liquid dispenser is provided that includes a liquid supply channel, a liquid dispensing channel, and a liquid return channel. The liquid dispensing channel includes a wall. The wall includes a surface. A portion of the wall defines an outlet opening that includes a downstream edge relative to a direction of liquid flow through the liquid dispensing channel. The downstream edge is sloped relative to the surface of the wall of the liquid dispensing channel. A liquid is provided that flows from the liquid supply channel through the liquid dispensing channel to the liquid return channel. A liquid drop is caused to be ejected from the outlet opening of the liquid dispensing channel by selectively actuating a diverter member to divert a portion of the flowing liquid through the outlet opening of the liquid dispensing channel.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1A:
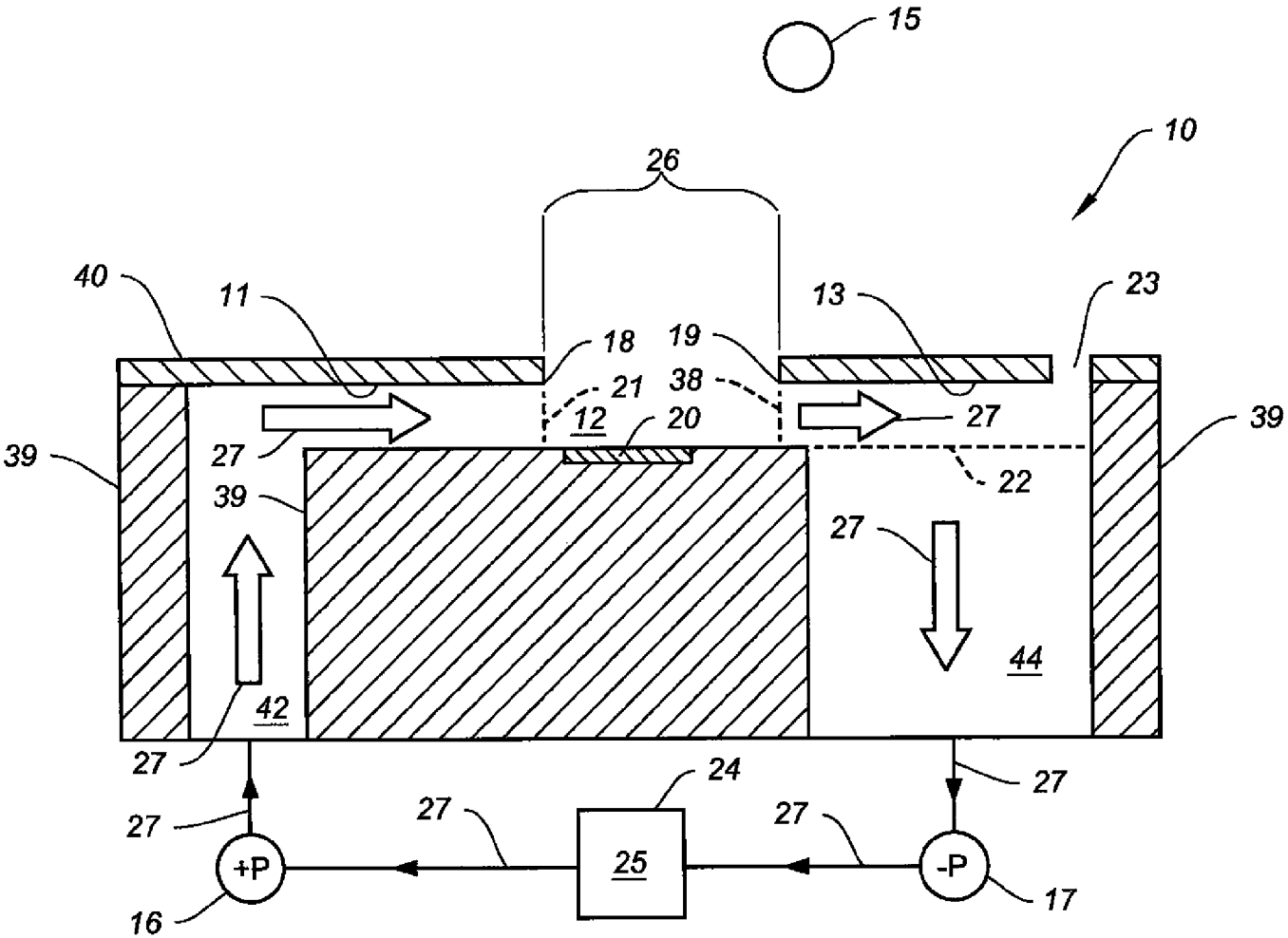
FIGS. 1A and 1B are schematic cross sectional views of example embodiments of a liquid dispenser made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a liquid dispenser, often referred to as a printhead, that is particularly useful in digitally controlled inkjet printing devices in which drops of ink are ejected from a printhead toward a print medium. However, many other applications are emerging which use liquid dispensers, similar to inkjet printheads, to emit liquids, other than inks, that need to be finely metered and deposited with high spatial precision. As such, as described herein, the terms "liquid" and "ink" are used interchangeably and refer to any material, not just inkjet inks, that can be ejected by the example embodiments of the liquid dispenser described below.

Figure 1B:
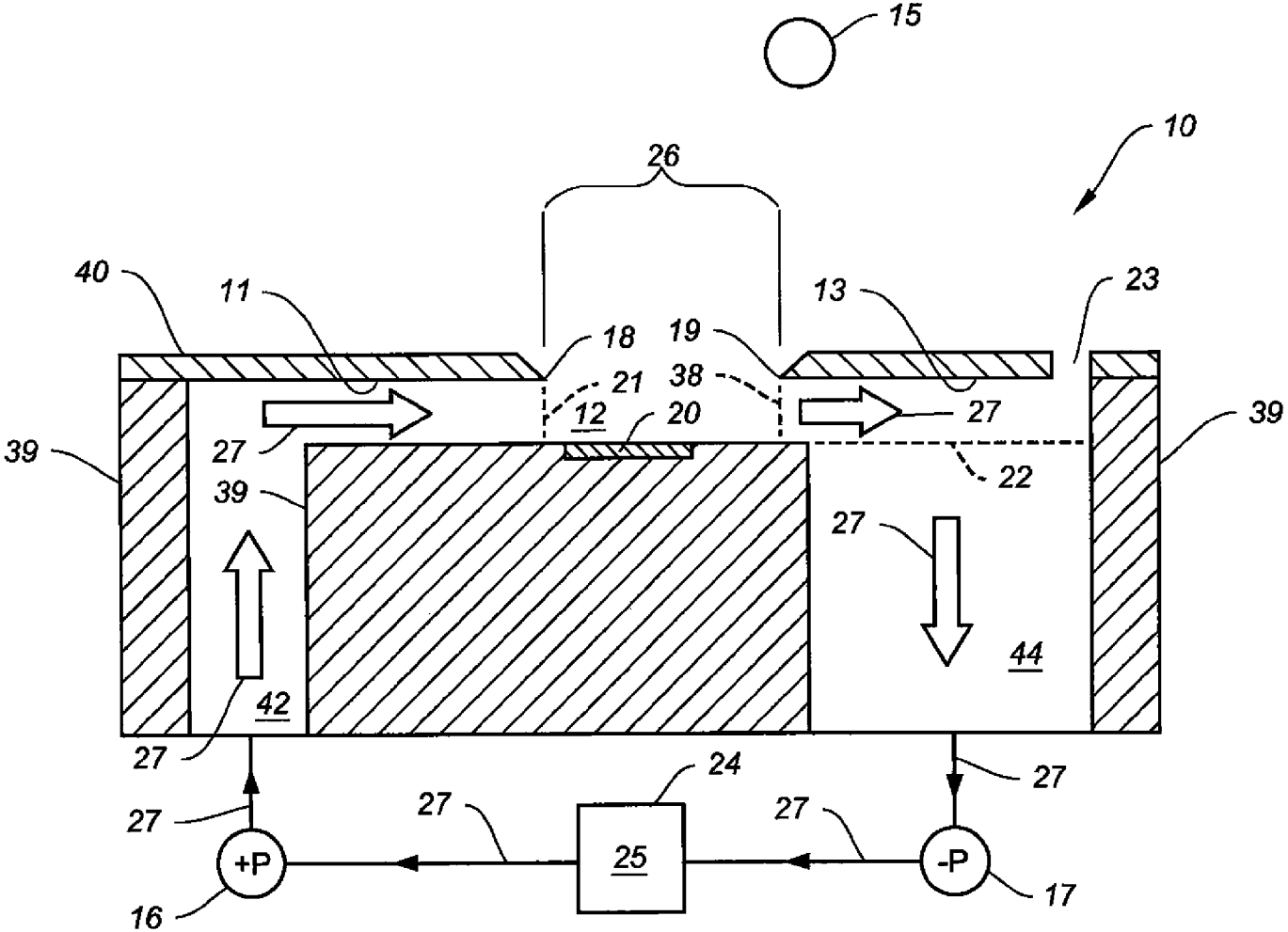

Referring to FIGS. 1A and 1B, example embodiments of a liquid dispenser 10 made in accordance with the present invention are shown. Liquid dispenser 10 includes a liquid supply channel 11 that is in fluid communication with a liquid return channel 13 through a liquid dispensing channel 12.

Liquid dispensing channel 12 includes a diverter member 20. Liquid supply channel 11 includes an exit 21 while liquid return channel 13 includes an entrance 38.

Liquid dispensing channel 12 includes an outlet opening 26, defined by an upstream edge 18 and a downstream edge 19, that opens directly to atmosphere. Outlet opening 26 is different when compared to conventional nozzles because the area of the outlet opening 26 does not determine the size of the ejected drops. Instead, the actuation of diverter member 20 determines the size (volume) of the ejected drop 15. Typically, the size of drops created is proportional to the amount of liquid displaced by the actuation of diverter member 20. The upstream edge 18 of outlet opening 26 also at least partially defines the exit 21 of liquid supply channel 11 while the downstream edge 19 of outlet opening 26 also at least partially defines entrance 38 of liquid return channel 13

Liquid ejected by liquid dispenser 10 of the present invention does not need to travel through a conventional nozzle which typically has a smaller area which helps to reduce the likelihood of the outlet opening 26 becoming contaminated or clogged by particle contaminants. Using a larger outlet opening 26 (as compared to a conventional nozzle) also reduces latency problems at least partially caused by evaporation in the nozzle during periods when drops are not being ejected. The larger outlet opening 26 also reduces the likelihood of satellite drop formation during drop ejection because drops are produced with shorter tail lengths.

Diverter member 20, associated with liquid dispensing channel 12, for example, positioned on or in substrate 39, is selectively actuatable to divert a portion of liquid 25 toward and through outlet opening 26 of liquid dispensing channel 12 in order to form and eject a drop 15. Diverter member 20 can include a heater or can incorporate using heat in its actuation. As shown in FIGS. 1A and 1B, diverter member 20 includes a heater that vaporizes a portion of the liquid flowing through liquid dispensing channel 12 so that another portion of the liquid is diverted toward outlet opening 26. This type of heater is commonly referred to as a "bubble jet" heater. Alternatively, diverter member 20 can include a heater, for example, a bi-layer or tri-layer thermal micro-actuator, that is selectively movable into and out of liquid dispensing channel 12 during actuation to divert a portion of the liquid flowing through liquid dispensing channel 12 toward outlet opening 26. These types of actuators are known and have been described in at least one or more of the following commonly assigned US Patents: U.S. Pat. No. 6,464,341 B1; U.S. Pat. No. 6,588,884 B1; U.S. Pat. No. 6,598,960 B1; U.S. Pat. No. 6,721,020 B1; U.S. Pat. No. 6,817,702 B2; U.S. Pat. No. 7,073,890 B2; U.S. Pat. No. 6,869,169 B2; and U.S. Pat. No. 7,188,931 B2.

As shown in FIGS. 1A and 1B, liquid supply channel 11, liquid dispensing channel 12, and liquid return channel 13 are partially defined by portions of substrate 39. These portions of substrate 39 can also be referred to as a wall or walls of one or more of liquid supply channel 11, liquid dispensing channel 12, and liquid return channel 13. A wall 40 defines outlet opening 26 and also partially defines liquid supply channel 11, liquid dispensing channel 12, and liquid return channel 13. Portions of substrate 39 also define a liquid supply passage 42 and a liquid return passage 44. Again, these portions of substrate 39 can be referred to as a wall or walls of liquid supply passage 42 and liquid return passage 44. As shown in FIGS. 1A and 1B, liquid supply passage 42 and liquid return passage 44 are perpendicular to liquid supply channel 11, liquid dispensing channel 12, and liquid return channel 13.

A liquid supply 24 is connected in fluid communication to liquid dispenser 10. Liquid supply 24 provides liquid 25 to liquid dispenser 10. During operation, liquid 25, pressurized by a regulated pressure supply source 16, for example, a pump, flows (represented by arrows 27) from liquid supply 24 through liquid supply passage 42, through liquid supply channel 11, through liquid dispensing channel 12, through liquid return channel 13, through liquid return passage 44, and back to liquid supply 24 in a continuous manner. When a drop 15 of liquid 25 is desired, diverter member 20 is actuated causing a portion of the liquid 25 in liquid dispensing channel 12 to be ejected toward and through outlet opening 26. Typically, regulated pressure supply source 16 is positioned in fluid communication between liquid supply 24 and liquid supply channel 11 and provides a positive pressure that is above atmospheric pressure.

Optionally, a regulated vacuum supply source 17, for example, a pump, can be included in the liquid delivery system of liquid dispenser 10 in order to better control liquid flow through liquid dispenser 10. Typically, regulated vacuum supply source 17 is positioned in fluid communication between liquid return channel 13 and liquid supply 24 and provides a vacuum (negative) pressure that is below atmospheric pressure.

Liquid return channel 13 or liquid return passage 44 can optionally include a porous member 22, for example, a filter, which in addition to providing particulate filtering of the liquid flowing through liquid dispenser 10 helps to accommodate liquid flow and pressure changes in liquid return channel 13 associated with actuation of diverter member 20 and a portion of liquid 25 being deflected toward and through outlet opening 26. This reduces the likelihood of liquid spilling over outlet opening 26 of liquid dispensing channel 12 during actuation of diverter member 20. The likelihood of air being drawn into liquid return passage 44 is also reduced when porous member 22 is included in liquid dispenser 10.

Porous member 22 is typically integrally formed in liquid return channel 13 during the manufacturing process that is used to fabricate liquid dispenser 10. Alternatively, porous member 22 can be made from a metal or polymeric material and inserted into liquid return channel 13 or affixed to one or more of the walls that define liquid return channel 13. As shown in FIGS. 1A and 1B, porous member 22 is positioned in liquid return channel 13 in the area where liquid return channel 13 and liquid return passage 44 intersect. As such, it can be stated that either liquid return passage 44 includes porous member 22 or that liquid return channel 13 includes porous member 22. Alternatively, porous member 22 can be positioned in liquid return passage 44 downstream from its location as shown in FIGS. 1A and 1B.

Regardless of whether porous member 22 in integrally formed or fabricated separately, the pores of porous member 22 can have a substantially uniform pore size. Alternatively, the pore size of the pores of porous member 22 can include a gradient so as to be able to more efficiently accommodate liquid flow through the liquid dispenser 10 (for example, larger pore sizes (alternatively, smaller pore sizes) on an upstream portion of the porous member 22 that decrease (alternatively, increase) in size at a downstream portion of porous member 22 when viewed in a direction of liquid travel). The specific configuration of the pores of porous member 22 typically depends on the specific application contemplated. Example embodiments of this aspect of the present invention are discussed in more detail below.

Typically, the location of porous member 22 varies depending on the specific application contemplated. As shown in FIGS. 1A and 1B, porous member 22 is positioned in liquid return channel 13 parallel to the flow direction 27 of liquid 25 in liquid dispensing channel 12 such that the center axis of the openings (pores) of porous member 22 are substantially perpendicular to the liquid flow 27 in the liquid dispensing channel. Porous member 22 is positioned in liquid return channel 13 at a location that is spaced apart from outlet opening 26 of liquid dispensing channel 12. Porous member 22 is also positioned in liquid return channel 13 at a location that is adjacent to the downstream edge 19 of outlet opening 26 of liquid dispensing channel 12. As described above, the likelihood of air being drawn into liquid return passage 44 is reduced because the difference between atmospheric pressure and the negative pressure provided by the regulated vacuum supply source 17, described above, is less than the meniscus pressure of porous member 22. Additionally, liquid return channel 13 includes a vent 23 that opens liquid return channel 13 to atmosphere. Vent 23 helps to accommodate liquid flow and pressure changes in liquid return channel 13 associated with actuation of diverter member 20 and a portion of liquid 25 being deflected toward and through outlet opening 26. This reduces the likelihood of liquid spilling over outlet opening 26 of liquid dispensing channel 12 during actuation of diverter member 20. In the event that liquid does spill over outlet opening 26, vent 23 also acts as a drain that provides a path back to liquid return channel 13 for any overflowing liquid. As such, the terms "vent" and "drain" are used interchangeably herein.

Liquid dispenser 10 is typically formed from a semiconductor material (for example, silicon) using known semiconductor fabrication techniques (for example, CMOS circuit fabrication techniques, micro-electro mechanical structure (MEMS) fabrication techniques, or combination of both). Alternatively, liquid dispenser 10 can be formed from any materials using any fabrication techniques known in the art.

The liquid dispensers of the present invention, like conventional drop-on-demand printheads, only create drops when desired, eliminating the need for a gutter and the need for a drop deflection mechanism which directs some of the created drops to the gutter while directing other drops to a print receiving media. The liquid dispensers of the present invention use a liquid supply that supplies liquid, for example, ink under pressure to the printhead. The supplied ink pressure serves as the primary motive force for the ejected drops, so that most of the drop momentum is provided by the ink supply rather than by a drop ejection actuator at the nozzle.

Figure 2A:
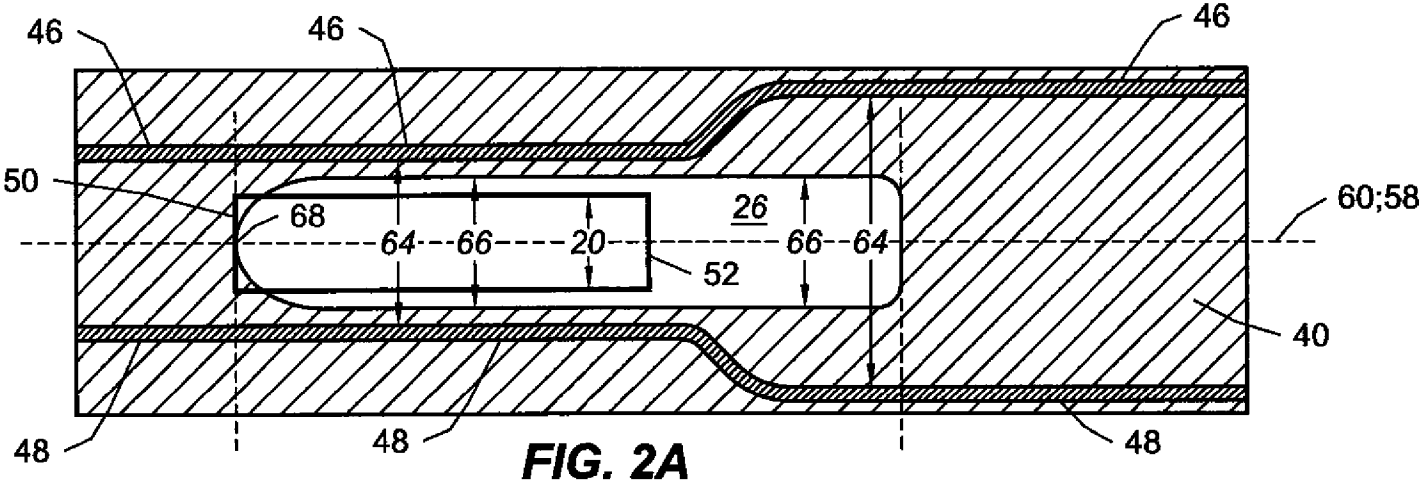
FIGS. 2A and 2B are a schematic plan view and a schematic cross sectional view, respectively, of another example embodiment of a liquid dispenser made in accordance with the present invention.
Figure 2B:
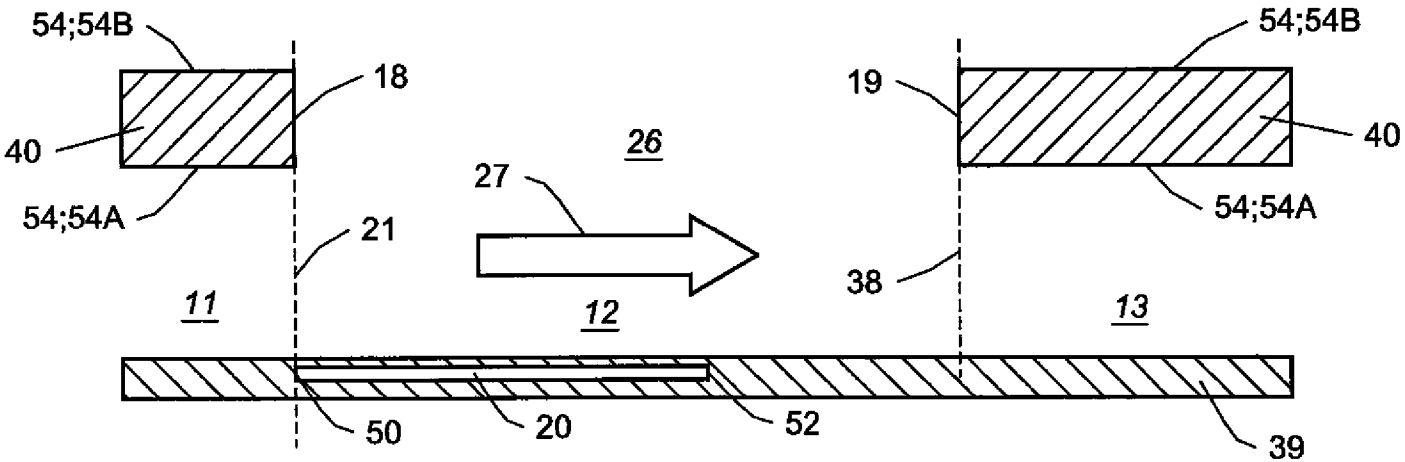
Figure 2C:
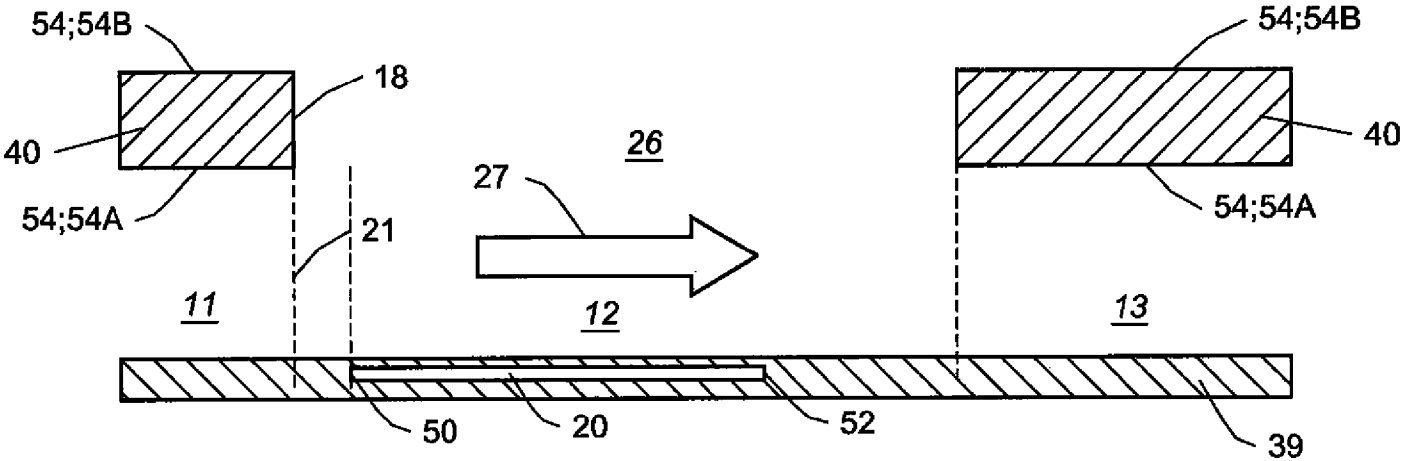
FIGS. 2C and 2D are schematic cross sectional views of the liquid dispenser shown in FIG. 2A showing additional example embodiments of a liquid dispenser made in accordance with the present invention.
Figure 2D:
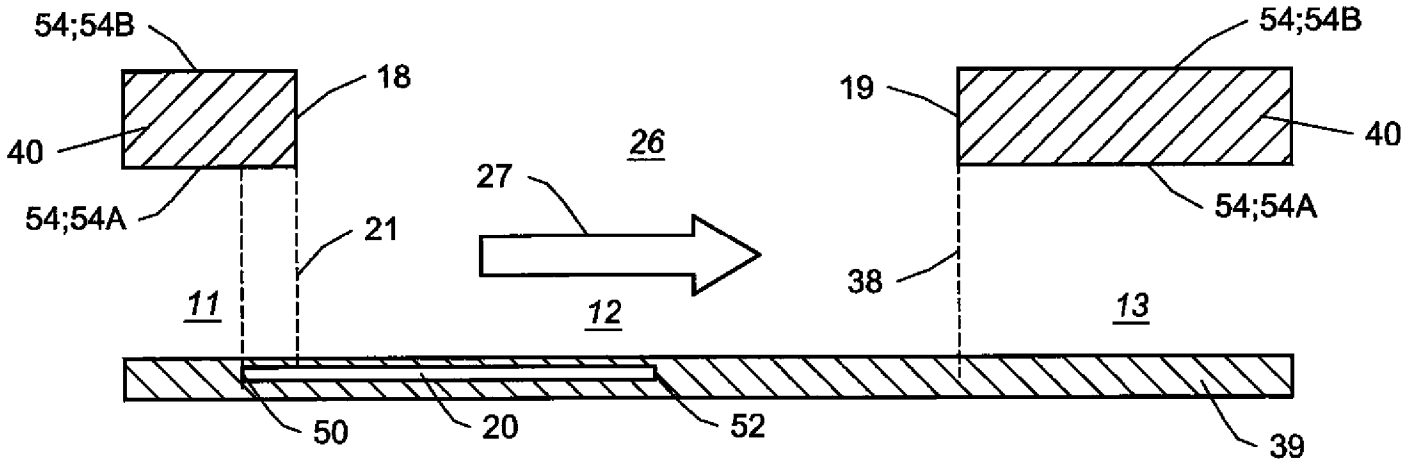

Referring to FIGS. 2A-2D and back to FIGS. 1A and 1B, additional example embodiments of liquid dispenser 10 are shown. In FIG. 2A, a plan view of liquid dispenser 10, wall 46 and wall 48 define a width, as viewed perpendicular to the direction of liquid flow 27 (shown in FIG. 2B), of liquid dispensing channel 12 and a width, as viewed perpendicular to the direction of liquid flow 27 (shown in FIG. 2B), of liquid supply channel 11 and liquid return channel 13. Additionally, a length, as viewed along the direction of liquid flow 27 (shown in FIG. 2B), and a width, as viewed perpendicular to the direction of liquid flow 27 (shown in FIG. 2B), of outlet opening 26 relative to the length and width of liquid dispensing channel 12 are also shown in FIG. 2A. In FIGS. 2B-2D, the location of diverter member 20 relative to the exit 21 of liquid supply channel 11 and the upstream edge 18 of outlet opening 26 is shown. In FIG. 2B, an upstream edge 50 of diverter member 20 is located at the exit 21 of liquid supply channel 11 and the upstream edge 18 of outlet opening 26. A downstream edge 52 of diverter member 20 is located upstream from the downstream edge 19 of outlet opening 26 and the entrance 38 of liquid return channel 13. In FIG. 2C, an upstream edge 50 of diverter member 20 is located in liquid dispensing channel 12 downstream from the exit 21 of liquid supply channel 11 and the upstream edge 18 of outlet opening 26. The downstream edge 52 of diverter member 20 is located upstream from the downstream edge 19 of outlet opening 26 and the entrance 38 of liquid return channel 13. In FIG. 2D, upstream edge 50 of diverter member is located in liquid supply channel 11, upstream from the exit 21 of liquid supply channel 11 and the upstream edge 18 of outlet opening 26. The downstream edge 52 of diverter member 20 is located upstream from the downstream edge 19 of outlet opening 26 and the entrance 38 of liquid return channel 13. Depending on the application contemplated, the relative location of diverter member 20 to exit 21 and entrance 38 can be used to control or adjust characteristics (for example, the angle of trajectory, volume, or velocity) of ejected drops 15.

Referring to FIGS. 3A-7B, and back to FIGS. 1A and 2A-2D, additional example embodiments of liquid dispenser 10 are shown. As shown in FIGS. 2B-2D, 3B, 4B, 5B, 6B, and 7B, wall 40, that defines outlet opening 26, includes a surface 54. Surface 54 can be either interior surface 54A or exterior surface 54B. The downstream edge 19, as viewed in the direction of liquid flow 27 through liquid dispensing channel 12, of outlet opening 26 is perpendicular relative to the surface 54 of wall 40 of liquid dispensing channel 12.

Figure 3A:
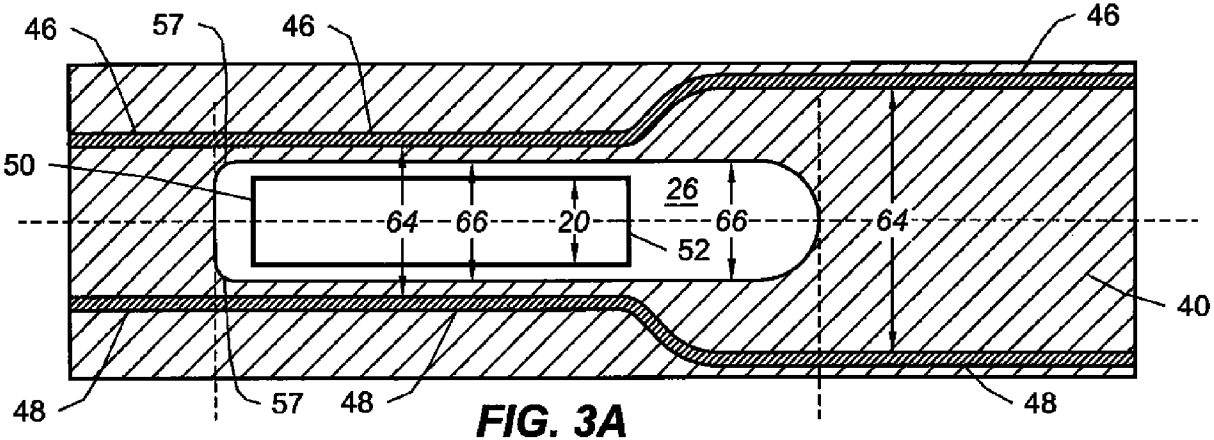
FIGS. 3A and 3B are a schematic plan view and a schematic cross sectional view, respectively, of another example embodiment of a liquid dispenser made in accordance with the present invention.
Figure 3B:
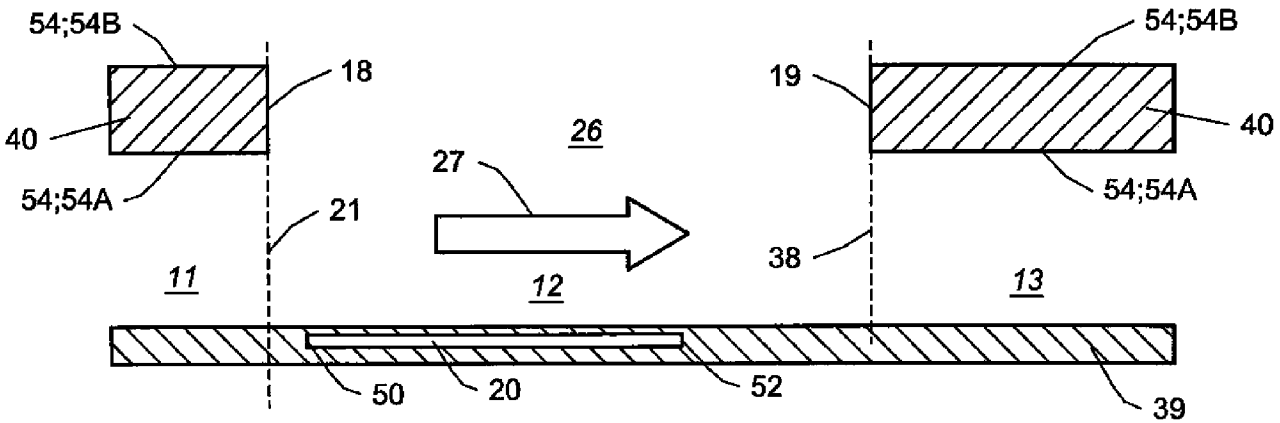
Figure 5A:
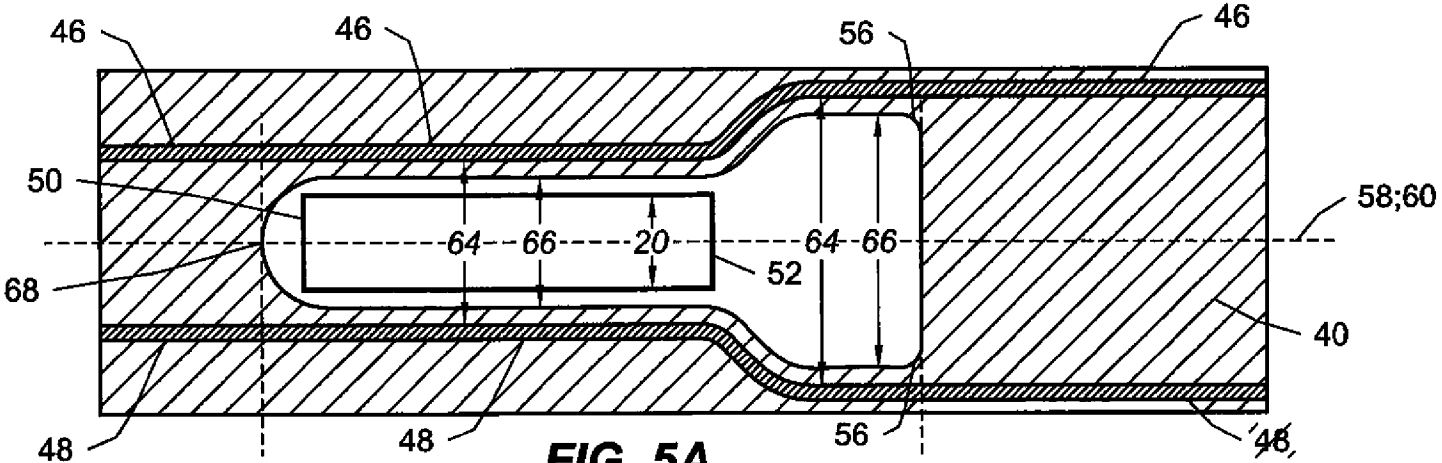
FIGS. 5A and 5B are a schematic plan view and a schematic cross sectional view, respectively, of another example embodiment of a liquid dispenser made in accordance with the present invention.
Figure 5B:
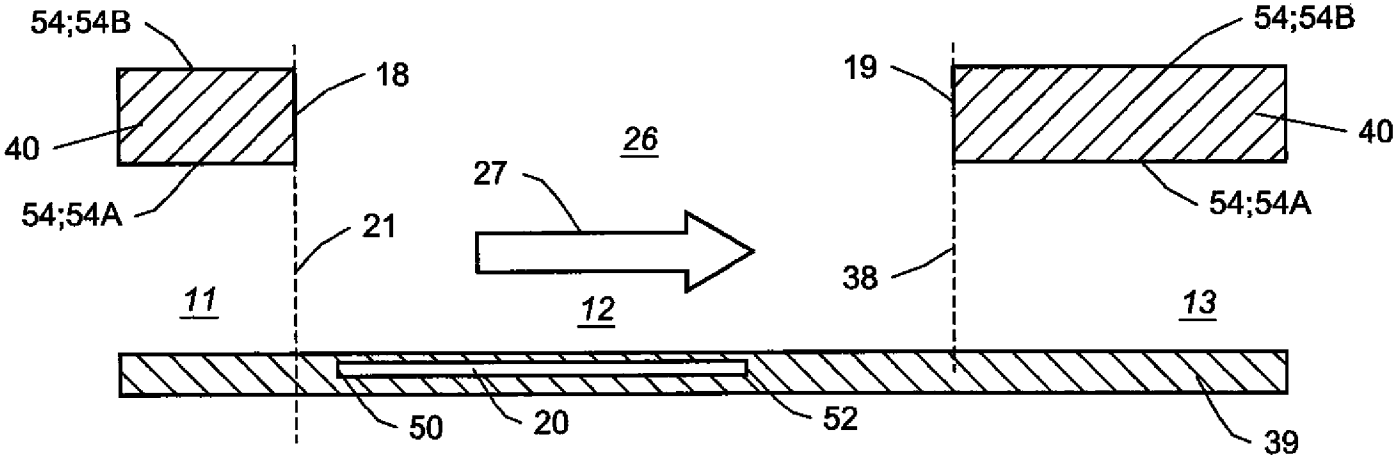
Figure 6A:
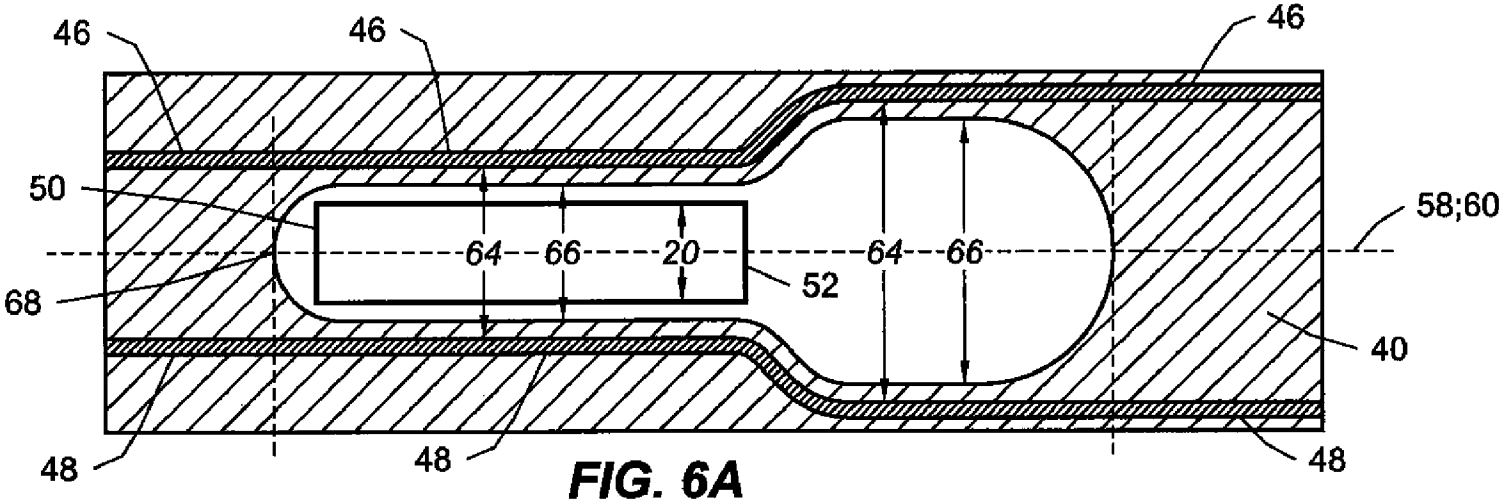
FIGS. 6A and 6B are a schematic plan view and a schematic cross sectional view, respectively, of another example embodiment of a liquid dispenser made in accordance with the present invention.
Figure 6B:
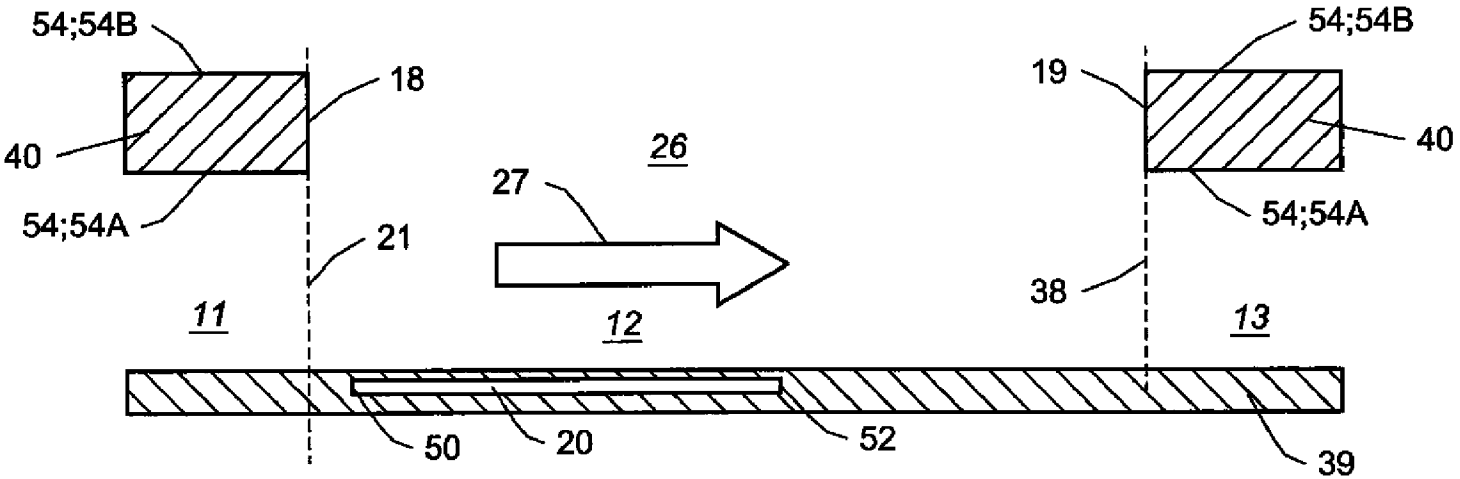

Downstream edge 19 of outlet opening 26 can include other features. For example, as shown in FIGS. 2A and 5A, the central portion of the downstream edge 19 of outlet opening 26 is straight when viewed from a direction perpendicular to surface 54 of wall 40. When central portion of the downstream edge 19 is straight, the corners 56 of downstream edge 19 can be rounded to provide mechanical stability and reduce stress induced cracks in wall 40. It is believed, however, that it is more preferable to configure the downstream edge 19 of outlet opening 26 to include a radius of curvature when viewed from a direction perpendicular to the surface 54 of wall 40 as shown in FIGS. 3A and 6A in order to improve the drop ejection performance of liquid dispenser 10. The radius of curvature can be different at different locations along the arc of the curve. In this sense, the radius of curvature can include a plurality of radii of curvature.

Outlet opening 26 includes a centerline 58 along the direction of the liquid flow 27 through liquid dispensing channel 12 as viewed from a direction perpendicular to surface 54 of wall 40 of liquid dispensing channel 12.

Liquid dispensing channel 12 includes a centerline 60 along the direction of the liquid flow 27 through liquid dispensing channel 12 as viewed from a direction perpendicular to surface 54 of wall 40 of liquid dispensing channel 12. In some example embodiments of the present invention, liquid dispensing channel 12 and outlet opening 26 share this centerline 58, 60.

Figure 4A:
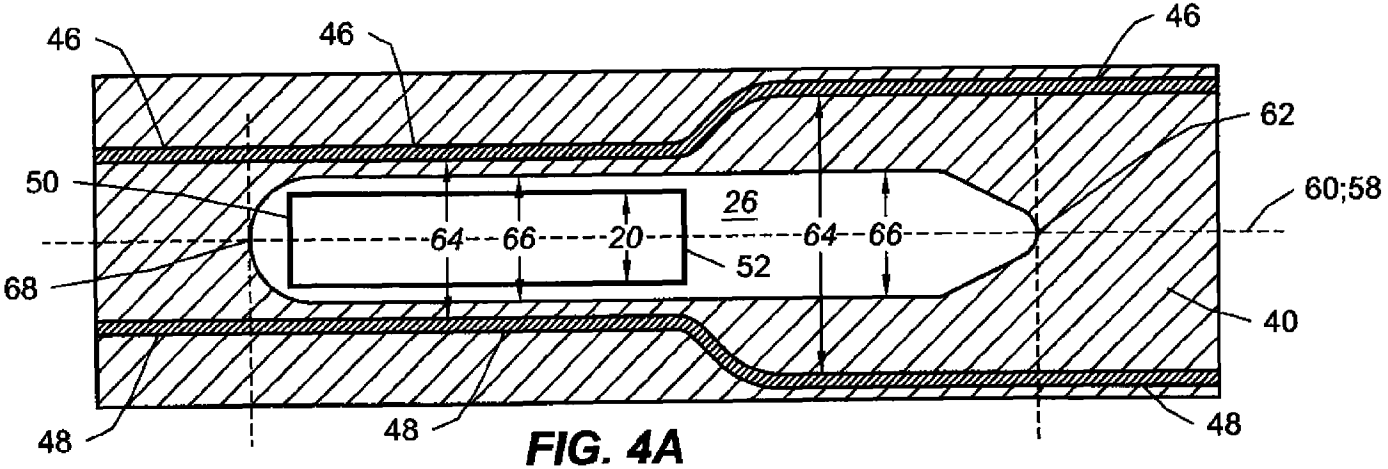
FIGS. 4A and 4B are a schematic plan view and a schematic cross sectional view, respectively, of another example embodiment of a liquid dispenser made in accordance with the present invention.
Figure 4B:
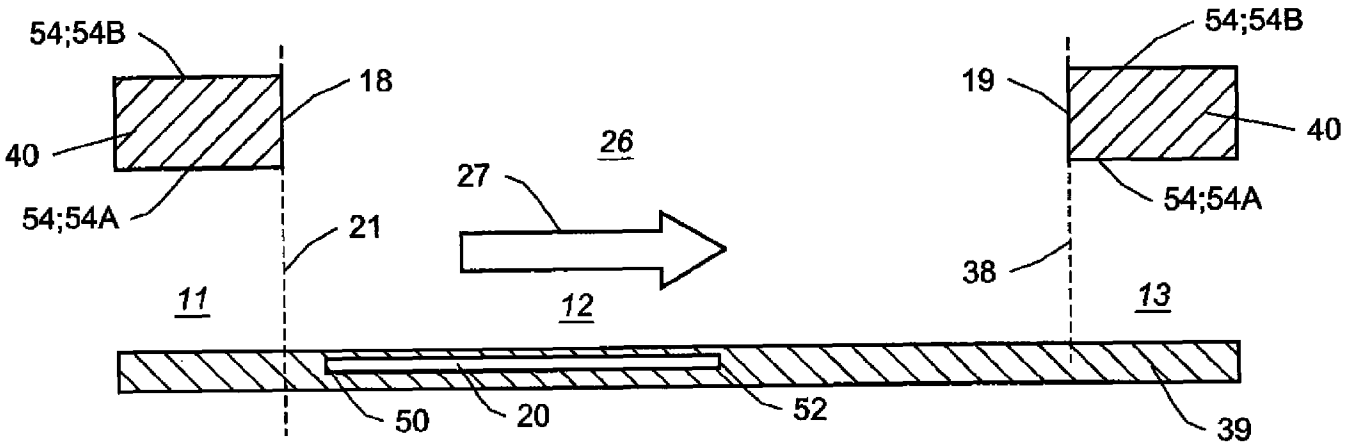
Figure 7A:
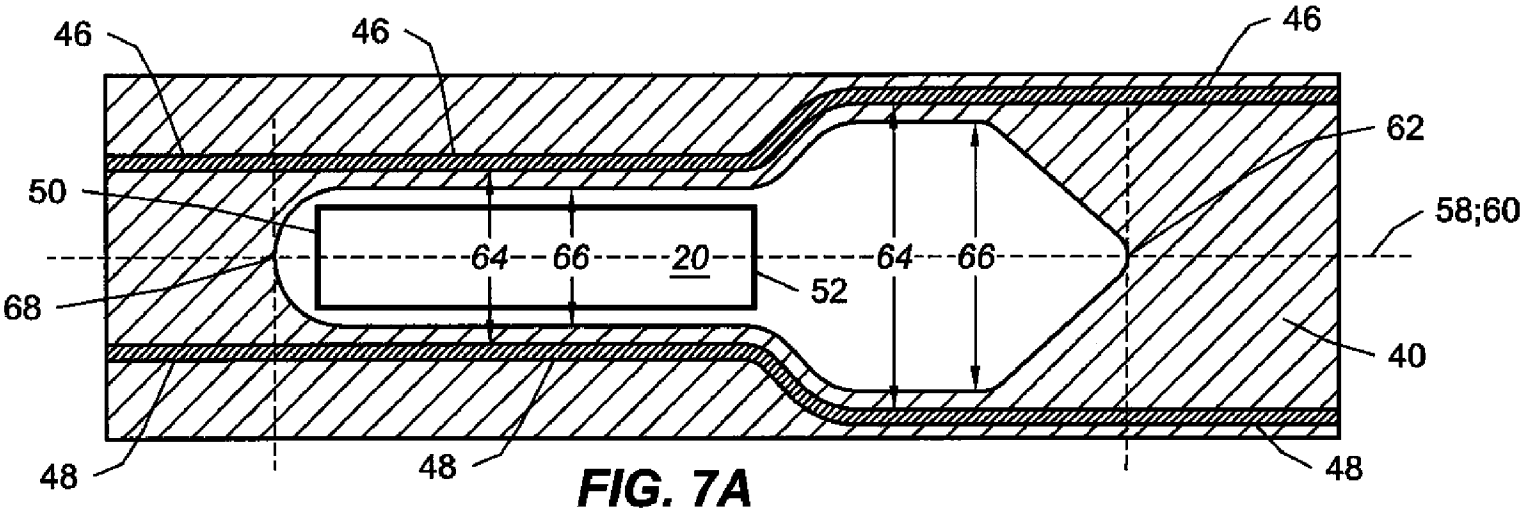
FIGS. 7A and 7B are a schematic plan view and a schematic cross sectional view, respectively, of another example embodiment of a liquid dispenser made in accordance with the present invention.
Figure 7B:
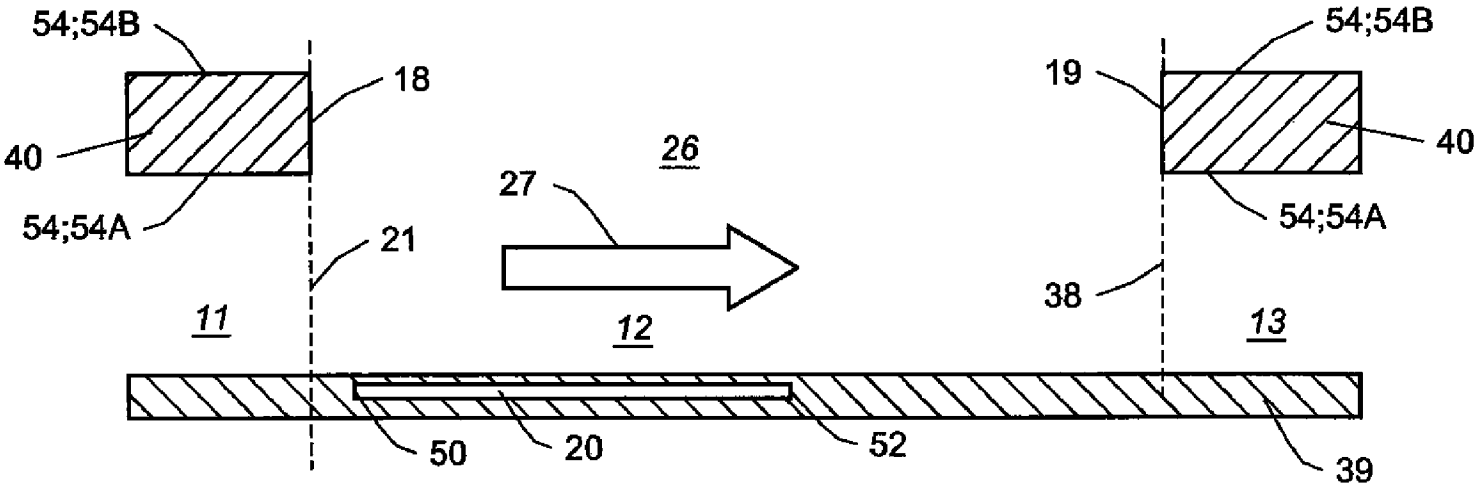

It is believed that it is still more preferable to configure the downstream edge 19 of the outlet opening 26 such that it tapers towards the centerline 58 of the outlet opening 26, as shown in FIGS. 4A and 7A, in order to improve the drop ejection performance of liquid dispenser 10. The apex 62 of the taper can include a radius of curvature when viewed from a direction perpendicular to the surface 54 of wall 40 to provide mechanical stability and reduce stress induced cracks in wall 40.

In some example embodiments, the overall shape of the outlet opening 26 is symmetric relative to the centerline 58 of the outlet opening 26. In other example embodiments, the overall shape of the liquid dispensing channel 12 is symmetric relative to the centerline 60 of the liquid dispensing channel 12. It is believed, however, that optimal drop ejection performance can be achieved when the overall shape of the liquid dispensing channel 12 and the overall shape of the outlet opening 26 are symmetric relative to a shared centerline 58, 60.

Liquid dispensing channel 12 includes a width 64 that is perpendicular to the direction of liquid flow 27 through liquid dispensing channel 12. Outlet opening 26 also includes a width 66 that is perpendicular to the direction of liquid flow 27 through liquid dispensing channel 12. The width 66 of the outlet opening 26 is less than the width 64 of the liquid dispensing channel 12.

In the example embodiments of the present invention described herein, the width 64 of the liquid dispensing channel 12 is greater at a location that is downstream relative to diverter member 20. Additionally, liquid return channel 13 is wider than the width of liquid dispensing channel 12 at the upstream edge 18 of the liquid dispensing channel 12. Liquid return channel 13 is also wider than the width of liquid supply channel 11 at its exit 21. This feature helps to control the meniscus height of the liquid in outlet opening 26 so as to reduce or even prevent liquid spills.

The width 66 of outlet opening 26 can vary, however. For example, in the example embodiments shown in FIGS. 2A, 3A, and 4A, the width 66 of outlet opening 26 remains constant along the length of the outlet opening 26 until the downstream edge 19 of the outlet opening is encountered. In the example embodiments shown in FIGS. 5A, 6A, and 7A, the width 66 of outlet opening 26 is greater at a location that is downstream relative to diverter member 20 and upstream relative to the downstream edge 19 of the outlet opening when compared to the width 66 of outlet opening 26 at a location in the vicinity of diverter member 20. It is believed that this configuration helps achieve optimal drop ejection performance.

Although the location of diverter member 20 can vary, as described above with reference to FIGS. 2A-2D, in some example embodiments of the present invention, diverter member 20 can be positioned spaced apart from downstream edge 19 of outlet opening 26 by a distance that is between a range of greater than or equal to 0.5× of the width 64 of liquid dispensing channel 12 and less than or equal to 2.5× of the width 64 of liquid dispensing channel 12 as viewed from a direction perpendicular to surface 54 of wall 40 of the liquid dispensing channel 12. Again, it is believed that this diverter member 20 location helps achieve optimal drop ejection performance.

Referring back to FIGS. 1A, 2A-2D, and 3A-7B, a method of ejecting liquid from a liquid dispenser will be described. A liquid dispenser is provided that includes a liquid supply channel, a liquid dispensing channel, and a liquid return channel. The liquid dispensing channel includes a wall. The wall includes a surface. A portion of the wall defines an outlet opening that includes a downstream edge relative to a direction of liquid flow through the liquid dispensing channel. The downstream edge is perpendicular to the surface of the wall of the liquid dispensing channel. A liquid is provided that flows from the liquid supply channel through the liquid dispensing channel to the liquid return channel. A liquid drop is caused to be ejected from the outlet opening of the liquid dispensing channel by selectively actuating a diverter member to divert a portion of the flowing liquid through the outlet opening of the liquid dispensing channel.

Selectively actuating the diverter member to divert a portion of the flowing liquid through the outlet opening of the liquid dispensing channel can include applying heat to a portion of the liquid flowing through the liquid dispensing channel. Providing the liquid that flows from the liquid supply channel through the liquid dispensing channel to the liquid return channel can include providing the liquid under pressure sufficient to cause the liquid to flow from the liquid supply channel through the liquid dispensing channel to the liquid return channel in a continuous manner. Additionally, providing the liquid dispenser can include providing a liquid dispenser that includes any of the example embodiments described above either alone or in combination with each other.

Figure 8A:
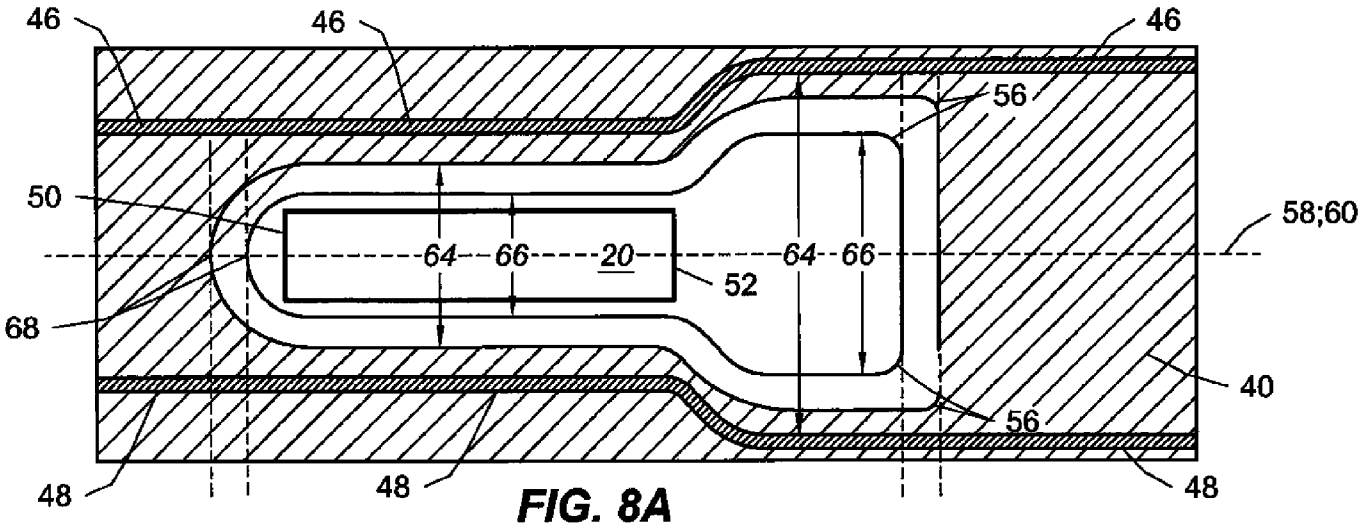
FIGS. 8A and 8B are a schematic plan view and a schematic cross sectional view, respectively, of another example embodiment of a liquid dispenser made in accordance with the present invention.
Figure 8B:
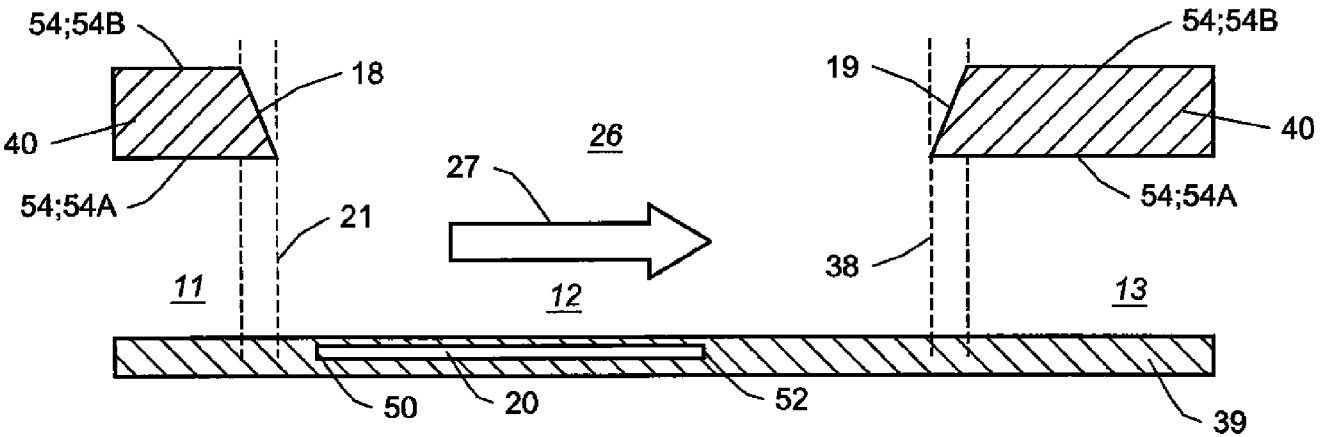
Figure 9A:
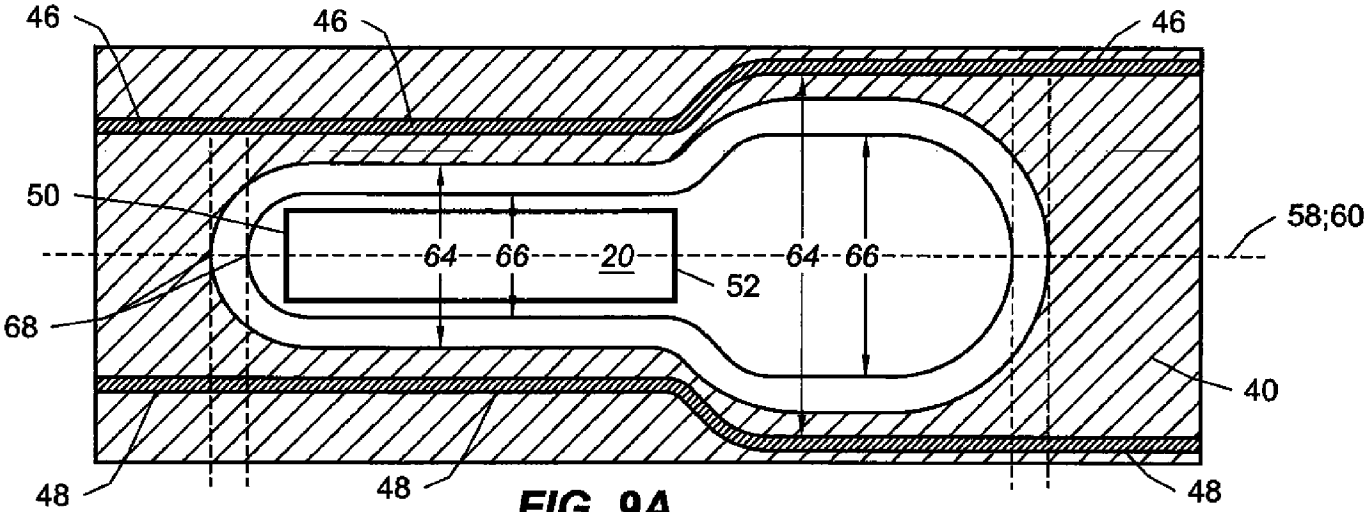
FIGS. 9A and 9B are a schematic plan view and a schematic cross sectional view, respectively, of another example embodiment of a liquid dispenser made in accordance with the present invention.
Figure 9B:
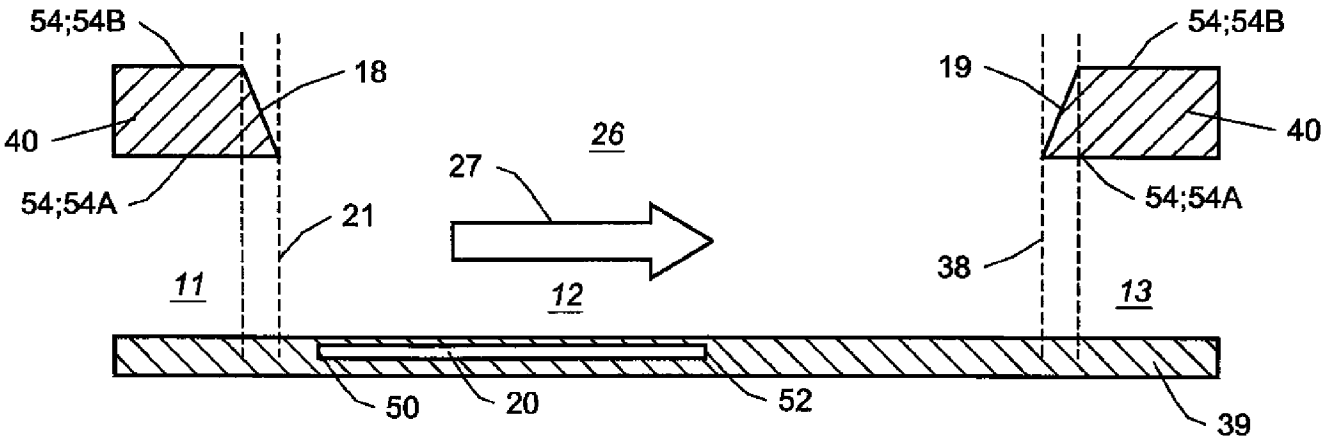
Figure 10A:
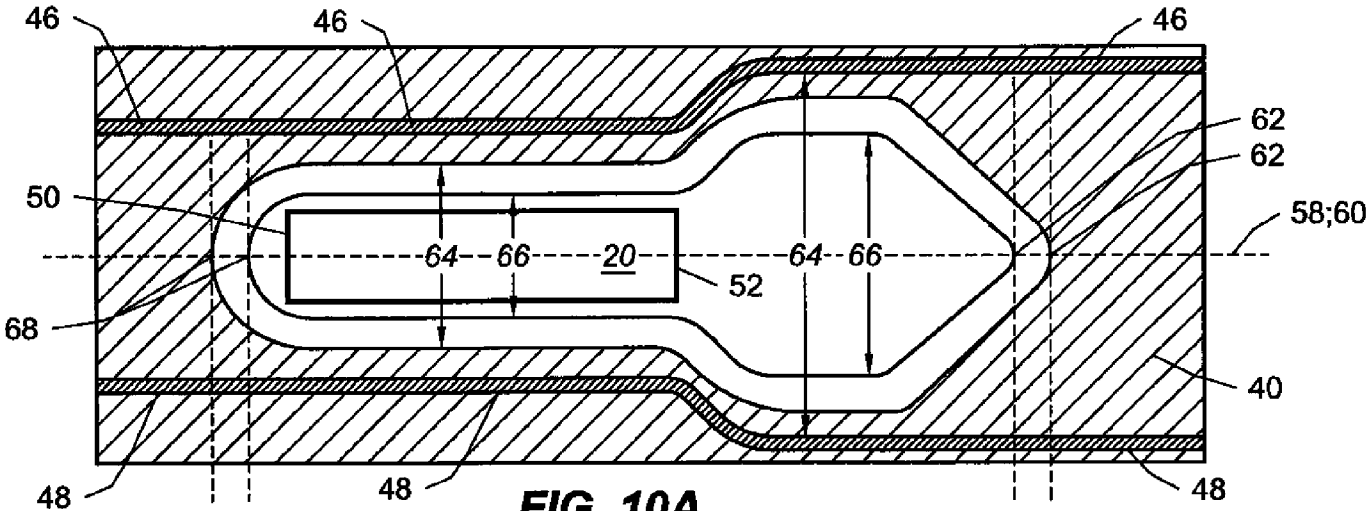
FIGS. 10A and 10B are a schematic plan view and a schematic cross sectional view, respectively, of another example embodiment of a liquid dispenser made in accordance with the present invention.
Figure 10B:
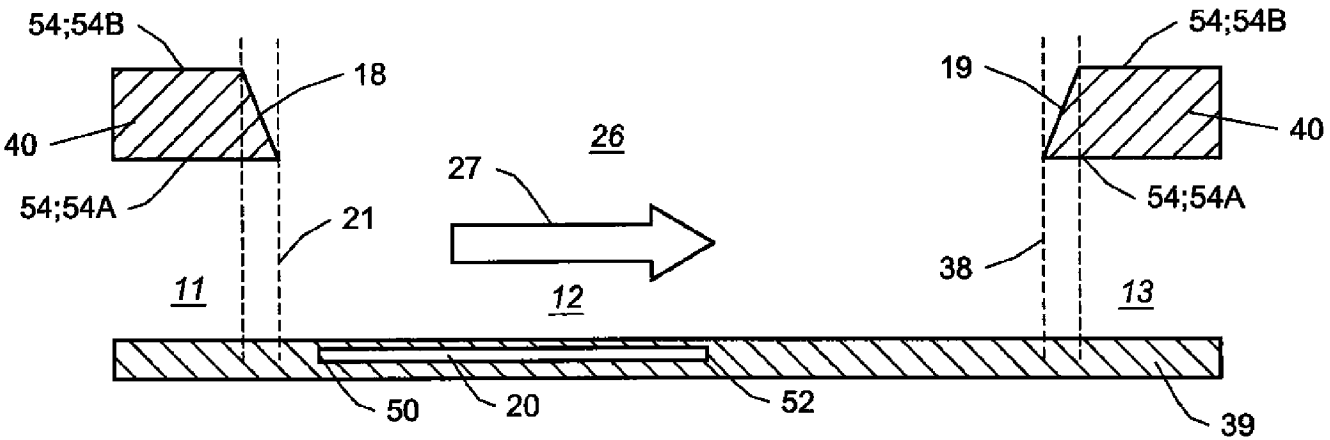
Figure 11A:
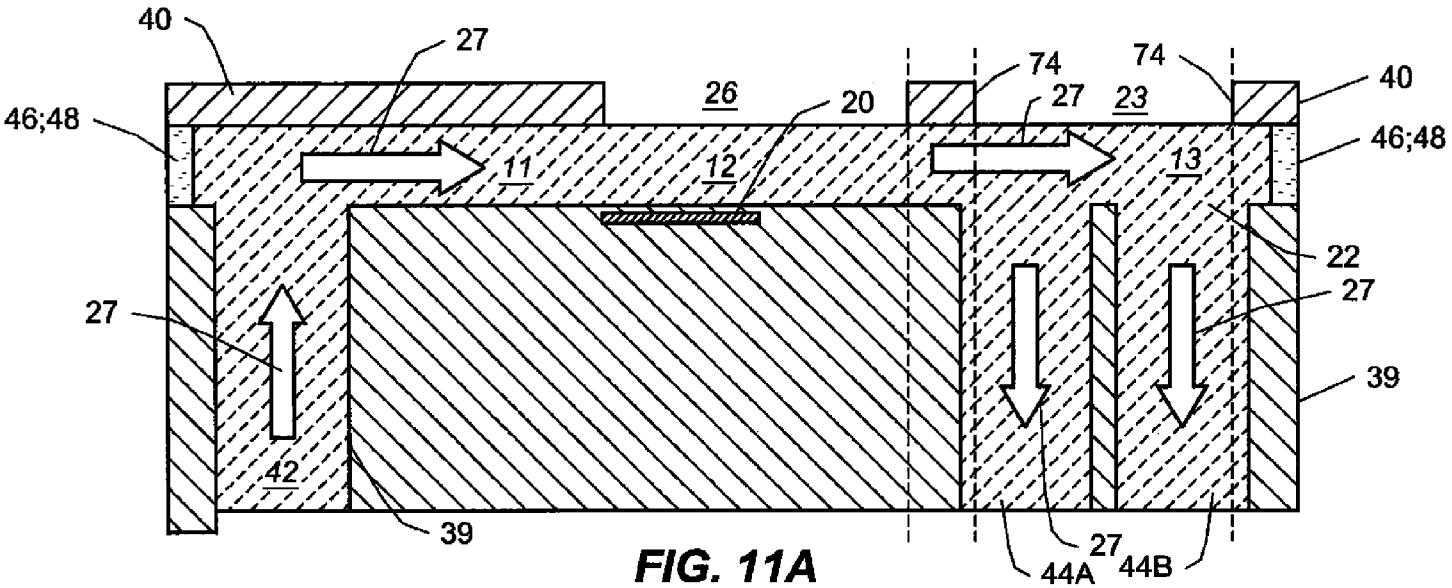
FIGS. 11A and 11B are a schematic cross sectional view and a schematic plan view, respectively, of another example embodiment of a liquid dispenser made in accordance with the present invention.
Figure 11B:
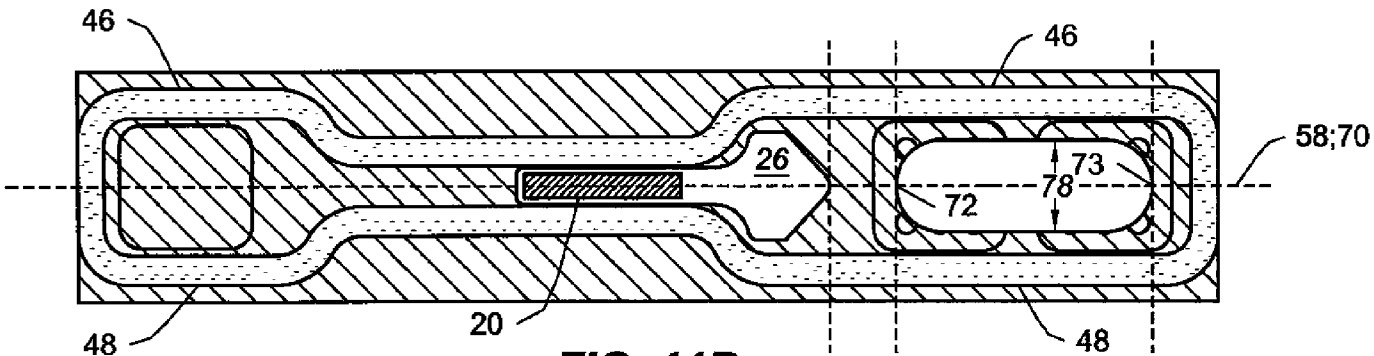

Referring to FIGS. 8A-10B, and back to FIGS. 1B and 2A-2D, additional example embodiments of liquid dispenser 10 are shown. As shown in FIGS. 8B, 9B, and 10B, wall 40, that defines outlet opening 26, includes a surface 54. Surface 54 can be either interior surface 54A or exterior surface 54B. The downstream edge 19, as viewed in the direction of liquid flow 27 through liquid dispensing channel 12, of outlet opening 26 is sloped (angled) relative to the surface 54 of wall 40 of liquid dispensing channel 12.

Downstream edge 19 of outlet opening 26 can include other features. For example, as shown in FIG. 8A, the center portion of the downstream edge 19 of outlet opening 26 is straight when viewed from a direction perpendicular to surface 54 of wall 40. When center portion of the downstream edge 19 is straight, the corners 56 of downstream edge 19 can be rounded to provide mechanical stability and reduce stress induced cracks in wall 40.

It is believed, however, that it is more preferable to configure the center portion of the downstream edge 19 of outlet opening 26 to include a radius of curvature when viewed from a direction perpendicular to the surface 54 of wall 40 as shown in FIG. 9A in order to improve the drop ejection performance of liquid dispenser 10. The radius of curvature can be different at different location along the arc of the curve. In this sense, the radius of curvature can include a plurality of radii of curvature.

Outlet opening 26 includes a centerline 58 along the direction of the liquid flow 27 through liquid dispensing channel 12 as viewed from a direction perpendicular to surface 54 of wall 40 of liquid dispensing channel 12. Liquid dispensing channel 12 includes a centerline 60 along the direction of the liquid flow 27 through liquid dispensing channel 12 as viewed from a direction perpendicular to surface 54 of wall 40 of liquid dispensing channel 12. In some example embodiments of the present invention, liquid dispensing channel 12 and outlet opening 26 share this centerline 58, 60.

It is believed that it is still more preferable to configure the downstream edge 19 of the outlet opening 26 such that it tapers towards the centerline 58 of the outlet opening 26, as shown in FIG. 10A, in order to improve the drop ejection performance of liquid dispenser 10. The apex 62 of the taper can include a radius of curvature when viewed from a direction perpendicular to the surface 54 of wall 40.

In some example embodiments, the overall shape of the outlet opening 26 is symmetric relative to the centerline 58 of the outlet opening 26. In other example embodiments, the overall shape of the liquid dispensing channel 12 is symmetric relative to the centerline 60 of the liquid dispensing channel 12. It is believed, however, that optimal drop ejection performance can be achieved when the overall shape of the liquid dispensing channel 12 and the overall shape of the outlet opening 26 are symmetric relative to a shared centerline 58, 60.

Liquid dispensing channel 12 includes a width 64 that is perpendicular to the direction of liquid flow 27 through liquid dispensing channel 12. Outlet opening 26 also includes a width 66 that is perpendicular to the direction of liquid flow 27 through liquid dispensing channel 12. The width 66 of the outlet opening 26 is less than the width 64 of the liquid dispensing channel 12.

In the example embodiments of the present invention described herein, the width 64 of the liquid dispensing channel 12 is greater at a location that is downstream relative to diverter member 20. Additionally, liquid return channel 13 is wider than the width of liquid dispensing channel 12 at the upstream edge 18 of the liquid dispensing channel 12. Liquid return channel 13 is also wider than the width of liquid supply channel 11 at exit 21. This feature helps to control the meniscus height of the liquid in outlet opening 26 so as to reduce or even prevent liquid spills.

In the example embodiments shown in FIGS. 8A, 9A, and 10A, the width 66 of outlet opening 26 is greater at a location that is downstream relative to diverter member 20 and upstream relative to the downstream edge 19 of the outlet opening when compared to the width 66 of outlet opening 26 at a location in the vicinity of diverter member 20. It is believed that this configuration helps achieve optimal drop ejection performance. However, alternative example embodiments that include a sloped downstream edge 19 of outlet opening 26, can include an outlet opening 26 width 66 that remains constant along the length of the outlet opening 26 until the downstream edge 19 of the outlet opening is encountered. These alternative example embodiments are similar to ones described above with reference to FIGS. 2A, 3A, and 4A, except that the downstream edge 19 is sloped relative the surface 54 of the wall.

Although the location of diverter member 20 can vary, as described above with reference to FIGS. 2A-2D, in some example embodiments of the present invention, diverter member 20 can be positioned spaced apart from downstream edge 19 of outlet opening 26 by a distance that is between a range of greater than or equal to 0.5× of the width 64 of liquid dispensing channel 12 and less than or equal to 2.5× of the width 64 of liquid dispensing channel 12 as viewed from a direction perpendicular to surface 54 of wall 40 of the liquid dispensing channel 12. Again, it is believed that this diverter member 20 location helps achieve optimal drop ejection performance.

Referring back to FIGS. 1B, 2A-2D, and 8A-10B, another method of ejecting liquid from a liquid dispenser will be described. A liquid dispenser is provided that includes a liquid supply channel, a liquid dispensing channel, and a liquid return channel. The liquid dispensing channel includes a wall. The wall includes a surface. A portion of the wall defines an outlet opening that includes a downstream edge relative to a direction of liquid flow through the liquid dispensing channel. The downstream edge is sloped relative to the surface of the wall of the liquid dispensing channel. A liquid is provided that flows from the liquid supply channel through the liquid dispensing channel to the liquid return channel. A liquid drop is caused to be ejected from the outlet opening of the liquid dispensing channel by selectively actuating a diverter member to divert a portion of the flowing liquid through the outlet opening of the liquid dispensing channel.

Selectively actuating the diverter member to divert a portion of the flowing liquid through the outlet opening of the liquid dispensing channel can include applying heat to a portion of the liquid flowing through the liquid dispensing channel. Providing the liquid that flows from the liquid supply channel through the liquid dispensing channel to the liquid return channel can include providing the liquid under pressure sufficient to cause the liquid to flow from the liquid supply channel through the liquid dispensing channel to the liquid return channel in a continuous manner. Additionally, providing the liquid dispenser can include providing a liquid dispenser that includes any of the example embodiments described above either alone or in combination with each other.

Referring back to FIGS. 1A-10B, another example embodiment of a liquid dispenser 10 made in accordance with the present invention will be discussed. As shown in FIGS. 2B-2D, 3B, 4B, 5B, 6B, 7B, 8B, 9B, and 10B, wall 40, that defines outlet opening 26, includes a surface 54. Surface 54 can be either interior surface 54A of wall 40 or exterior surface 54B of wall 40. The upstream edge 18, as viewed in the direction of liquid flow 27 through liquid dispensing channel 12, of outlet opening 26 includes a radius of curvature when viewed from a direction perpendicular to the surface 54 of wall 40 of liquid dispensing channel 12. It is believed that providing upstream edge 18 with a radius of curvature helps to strengthen wall 40 thereby reducing the likelihood of wall fatigue or wall cracking during operation.

Upstream edge 18 of outlet opening 26 can include other features. For example, as shown in FIGS. 2B-2D, 3B, 4B, 5B, 6B, and 7B, upstream edge 18 of outlet opening 26 can be perpendicular relative to the surface 54 of wall 40 of the liquid dispensing channel 12. Alternatively, as shown in FIGS. 8B, 9B, and 10B, upstream edge 18 of outlet opening 26 can be sloped relative to the surface 54 of wall 40 of the liquid dispensing channel 12. As shown in FIGS. 1A, 2A, 4A, 5A, 6A, 7A, 8A, 9A, and 10*a*, upstream edge 18 includes a circular shape when viewed from a direction perpendicular to when viewed from a direction perpendicular to surface 54 of wall 40 of liquid dispensing channel 12. However, alternative example embodiments of upstream edge 18, for example, the one shown in FIG. 3A, can include an oblong shape when viewed from a direction perpendicular to surface 54 of wall 40 of liquid dispensing channel 12. Corners 57 of upstream edge 18 can be rounded to provide mechanical stability.

Outlet opening 26 includes a centerline 58 along the direction of the liquid flow 27 through liquid dispensing channel 12 as viewed from a direction perpendicular to surface 54 of wall 40 of liquid dispensing channel 12. In some example embodiments that include upstream edge 18 being provided with a radius of curvature, the overall shape of the outlet opening 26 is symmetric relative to the centerline 58 of the outlet opening 26.

As described above with reference to FIGS. 2A-2D, the location of diverter member 20 can vary. In example embodiments of liquid dispenser 10 that include providing an upstream edge 18 with a radius of curvature the location of diverter member 20 can also vary. For example, as shown in FIG. 2B, an upstream edge 50 (leading edge) of diverter member 20 can be aligned with a center 68 of the radius of curvature of upstream edge 18 of outlet opening 26 when viewed from a direction perpendicular to surface 54 of wall 40 of liquid dispensing channel 12. Alternatively, as shown in FIGS. 2C and 2D, an upstream edge 50 (leading edge) of diverter member 20 and a center 68 of the radius of curvature of upstream edge 18 of outlet opening 26 can be offset relative to each other when viewed from a direction perpendicular to surface 54 of wall 40 of liquid dispensing channel 12. For example, upstream edge 50 of diverter member 20 can be located in liquid dispensing channel 12 downstream from the center 68 of the radius of curvature of upstream edge 18 of outlet opening 26. Alternatively, upstream edge 50 of diverter member 20 can be located in liquid supply channel 11, upstream from the center 68 of the radius of curvature of upstream edge 18 of outlet opening 26.

Referring back to FIGS. 1A-10B, another method of ejecting liquid from a liquid dispenser will be described. A liquid dispenser is provided that includes a liquid supply channel, a liquid dispensing channel, and a liquid return channel. The liquid dispensing channel includes a wall. The wall includes a surface. A portion of the wall defines an outlet opening that includes an upstream edge relative to a direction of liquid flow through the liquid dispensing channel. The upstream edge includes a radius of curvature when viewed from a direction perpendicular to the surface of the wall. A liquid is provided that flows from the liquid supply channel through the liquid dispensing channel to the liquid return channel. A liquid drop is caused to be ejected from the outlet opening of the liquid dispensing channel by selectively actuating a diverter member to divert a portion of the flowing liquid through the outlet opening of the liquid dispensing channel.

Selectively actuating the diverter member to divert a portion of the flowing liquid through the outlet opening of the liquid dispensing channel can include applying heat to a portion of the liquid flowing through the liquid dispensing channel. Providing the liquid that flows from the liquid supply channel through the liquid dispensing channel to the liquid return channel can include providing the liquid under pressure sufficient to cause the liquid to flow from the liquid supply channel through the liquid dispensing channel to the liquid return channel in a continuous manner. Additionally, providing the liquid dispenser can include providing a liquid dispenser that includes any of the example embodiments described above either alone or in combination with each other.

Figure 17A:
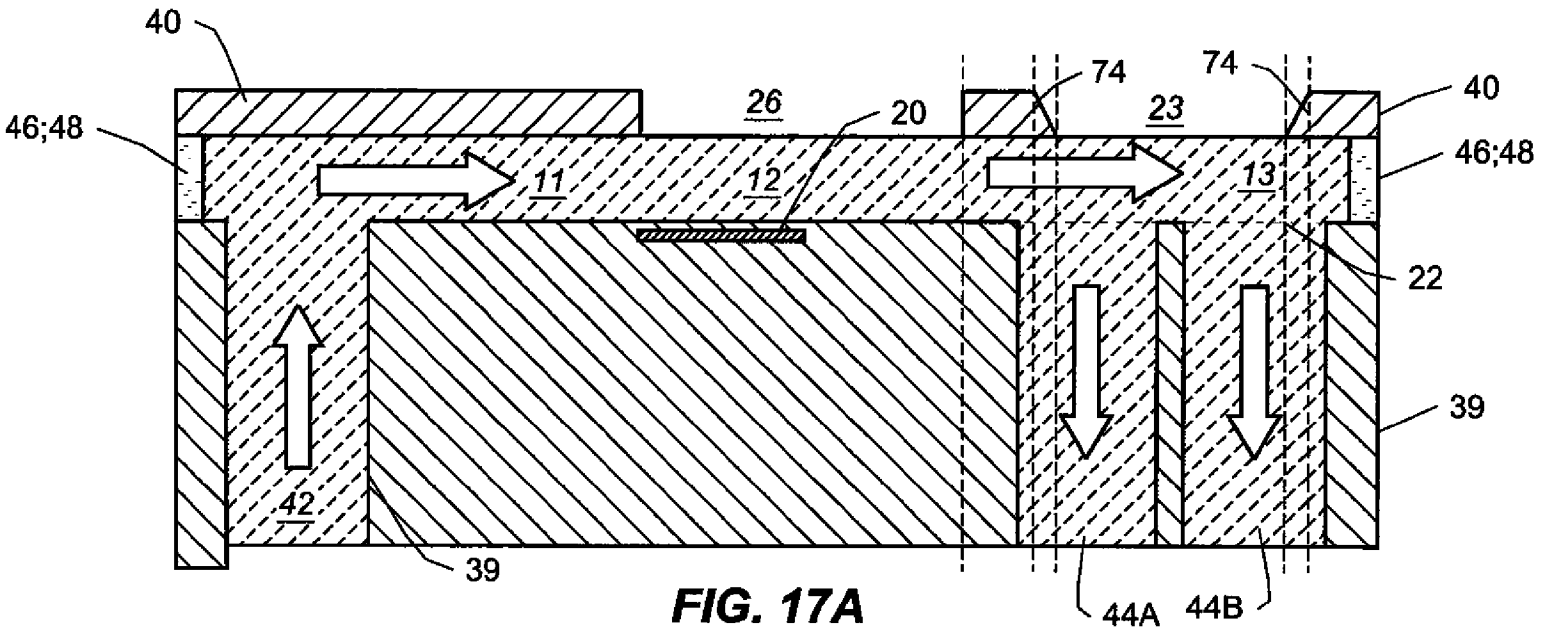
FIGS. 17A and 17B are a schematic cross sectional view and a schematic plan view, respectively, of another example embodiment of a liquid dispenser made in accordance with the present invention.
Figure 17B:
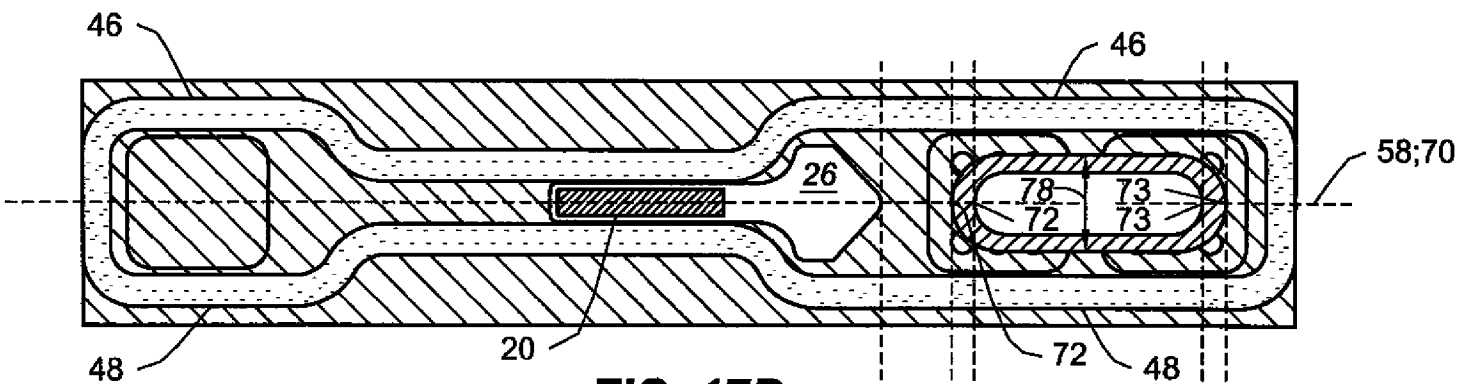
Figure 18A:
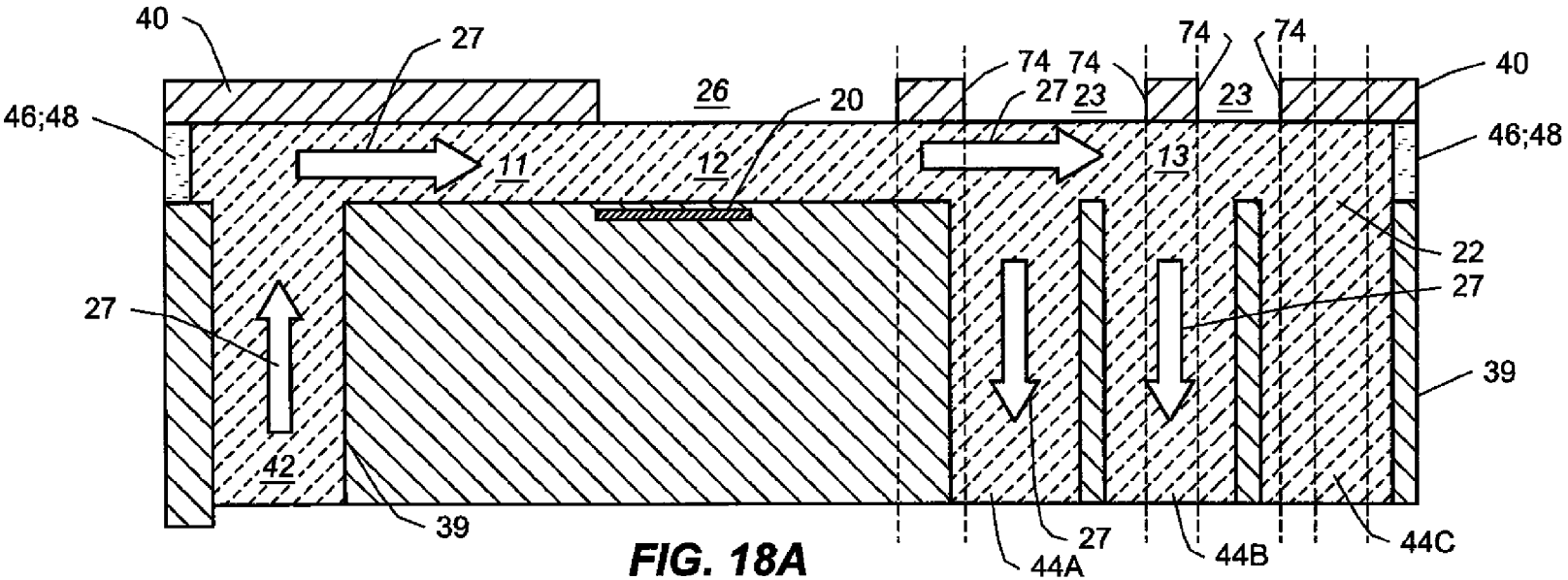
FIGS. 18A and 18B are a schematic cross sectional view and a schematic plan view, respectively, of another example embodiment of a liquid dispenser made in accordance with the present invention.
Figure 18B:
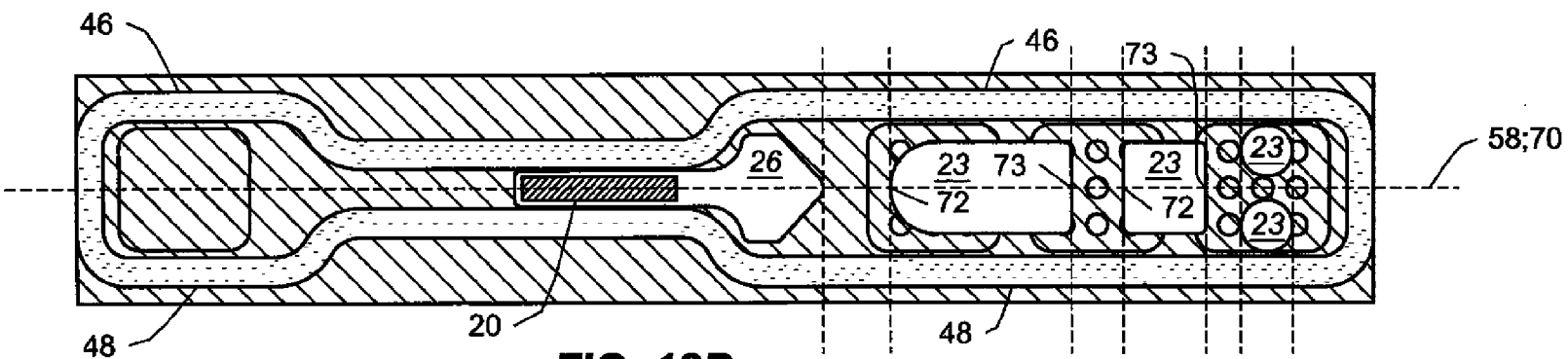

Referring to FIGS. 11A-18B and back to FIGS. 1A and 1B, example embodiments of a liquid dispenser 10 that include another aspect of the present invention are shown. As shown in FIGS. 1A and 18B, the size of liquid return passage 44 is greater than the size of liquid supply passage 42. It is believed that this feature helps to accommodate liquid flow and pressure changes in liquid return channel 13 which reduces the likelihood of liquid spilling over outlet opening 26 of liquid dispensing channel 12. As shown in FIGS. 11A-18B, liquid return passage 44 includes a plurality of individual liquid return passages 44A, 44B, 44C. The overall (aggregate) size of liquid return passage 44 is still greater than the size of liquid supply passage 42 but the size and shape of individual liquid return passages 44A, 44B, 44C is approximately equal to the size and shape of liquid supply passage 42. It is believed that this feature not only accommodates liquid flow and pressure changes in liquid return channel 13 which reduces the likelihood of liquid spilling over outlet opening 26 of liquid dispensing channel 12, but also facilitates the manufacturing of liquid dispenser 10 and improves the heat dissipation from diverter member 20 to the liquid flowing through individual liquid return passages 44A, 44B, 44C.

As described above, a portion of wall 40 defines outlet opening 26. Another portion of wall 40 defines a drain 23 located in wall 40 downstream, as viewed in the direction of liquid flow 27, from outlet opening 26. Drain 23, also referred to as a vent, is a suitably shaped through hole in wall 40. In the example embodiments of drain 23 described with reference to FIGS. 11A-18B, drain 23 includes a radius of curvature as viewed from a direction perpendicular to wall 40.

Wall 40 includes a surface 54 which can be either interior surface 54A of wall 40 or exterior surface 54B of wall 40. As described above, outlet opening 26 includes a centerline 58 along the direction of the liquid flow 27 through liquid dispensing channel 12 as viewed from a direction perpendicular to surface 54 of wall 40 of liquid dispensing channel 12. The overall shape of the outlet opening 26 can be symmetric relative to the centerline 58 of the outlet opening 26.

Drain 23 also includes a centerline 70 along the direction of the liquid flow 27 through liquid dispensing channel 12 as viewed from a direction perpendicular to surface 54 of wall 40 of liquid dispensing channel 12. In some example embodiments of the present invention, outlet opening 26 and drain 23 share this centerline 58, 70. In some example embodiments of this aspect of the present invention, the overall shape of drain 23 is symmetric relative to the centerline 70 of the liquid dispensing channel 12. It is believed, however, that optimal drop ejection performance can be achieved when the shape of the outlet opening 26 and the shape of drain 23 are symmetric relative to the shared centerline 58, 70.

Drain 23 can include a single through hole (opening) as shown in FIGS. 11A-17B. Alternatively, drain 23 can include a plurality of distinct through hole (openings) in wall 40 as shown in FIGS. 18A and 18B. All or a portion of drain 23 can be circular in shape as viewed from a direction perpendicular to wall 40 as shown in FIGS. 11A-18B. The shape of drain 23, as viewed from a direction perpendicular to wall 40, can be elongated in the direction of liquid flow 27 through liquid dispensing channel 12 as shown in FIGS. 11A-18B. The elongation of drain 23 can span more than one individual liquid return passage 44A, 44B, 44C when liquid return passage 44 is configured in this manner. The width 78 of drain 23 can vary along the direction of liquid flow 27 through the liquid dispensing channel 12 as viewed from a direction perpendicular to surface 54 of wall 40 of liquid dispensing channel 12 as shown in FIGS. 15A-16B. Alternatively, the width 78 of drain 23 can remain constant along the direction of liquid flow 27 through the liquid dispensing channel 12 as viewed from a direction perpendicular to surface 54 of wall 40 of liquid dispensing channel 12 as shown in FIGS. 11A-14B, 18A and 18B.

Figure 12A:
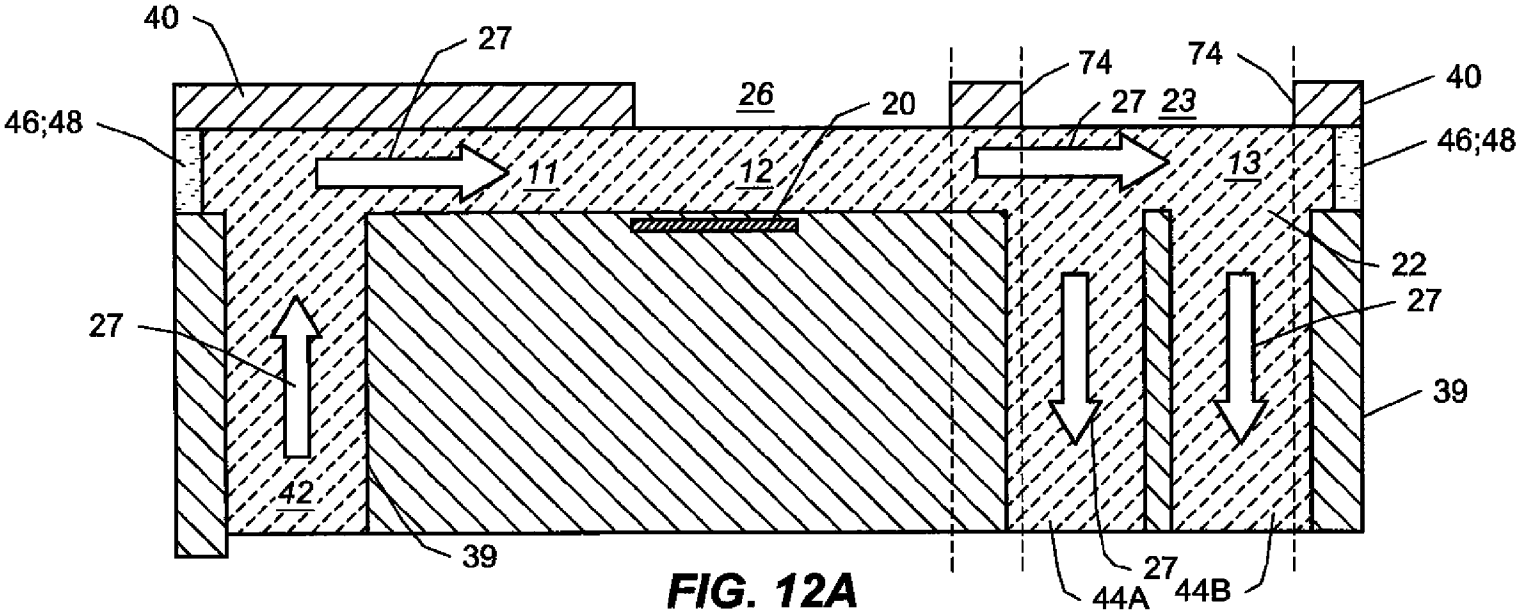
FIGS. 12A and 12B are a schematic cross sectional view and a schematic plan view, respectively, of another example embodiment of a liquid dispenser made in accordance with the present invention.
Figure 12B:
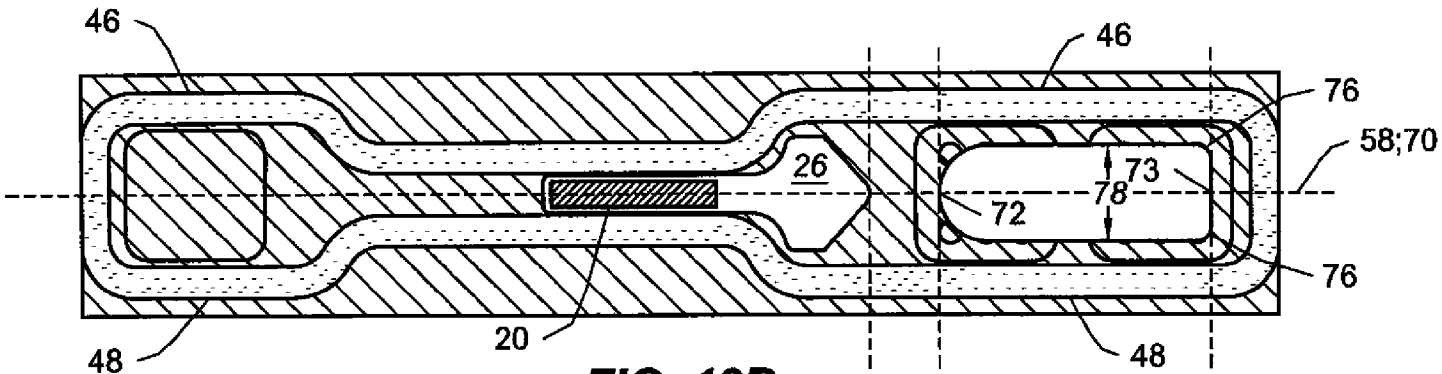
Figure 13A:
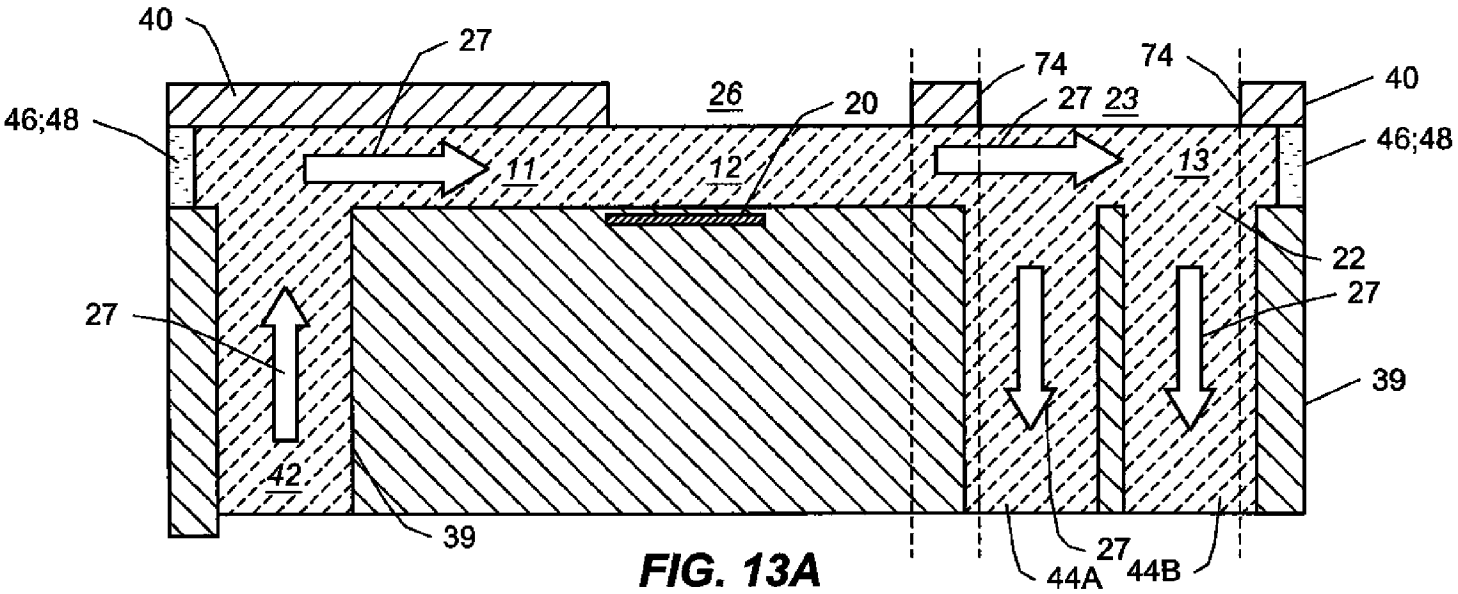
FIGS. 13A and 13B are a schematic cross sectional view and a schematic plan view, respectively, of another example embodiment of a liquid dispenser made in accordance with the present invention.
Figure 13B:
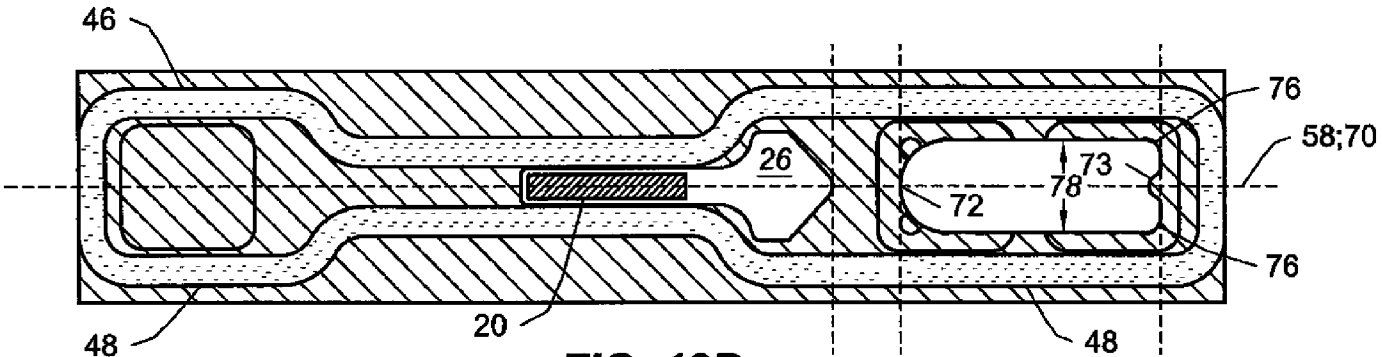
Figure 14A:
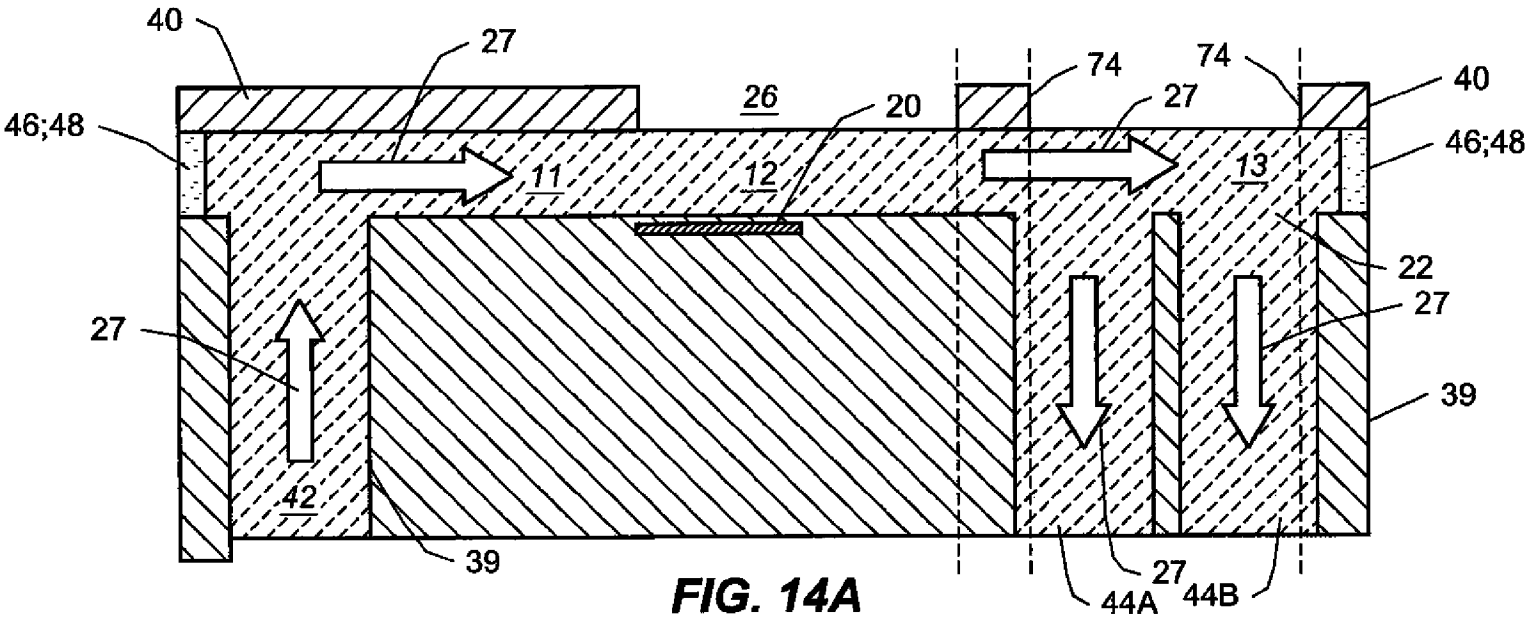
FIGS. 14A and 14B are a schematic cross sectional view and a schematic plan view, respectively, of another example embodiment of a liquid dispenser made in accordance with the present invention.
Figure 14B:
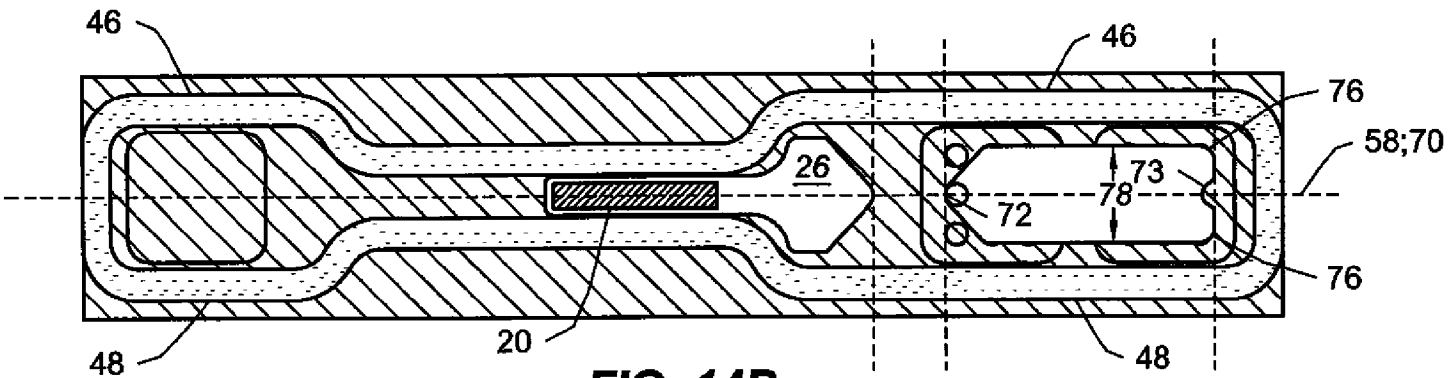
Figure 15A:
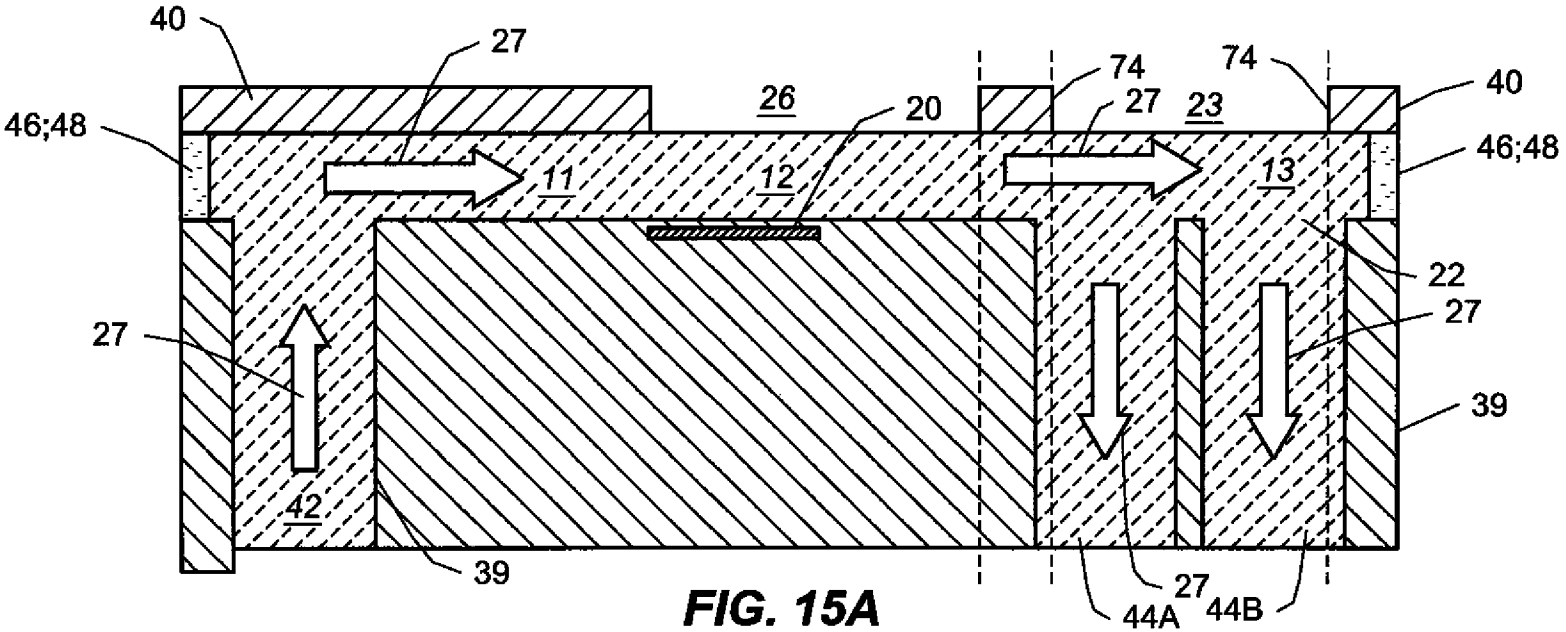
FIGS. 15A and 15B are a schematic cross sectional view and a schematic plan view, respectively, of another example embodiment of a liquid dispenser made in accordance with the present invention.
Figure 15B:
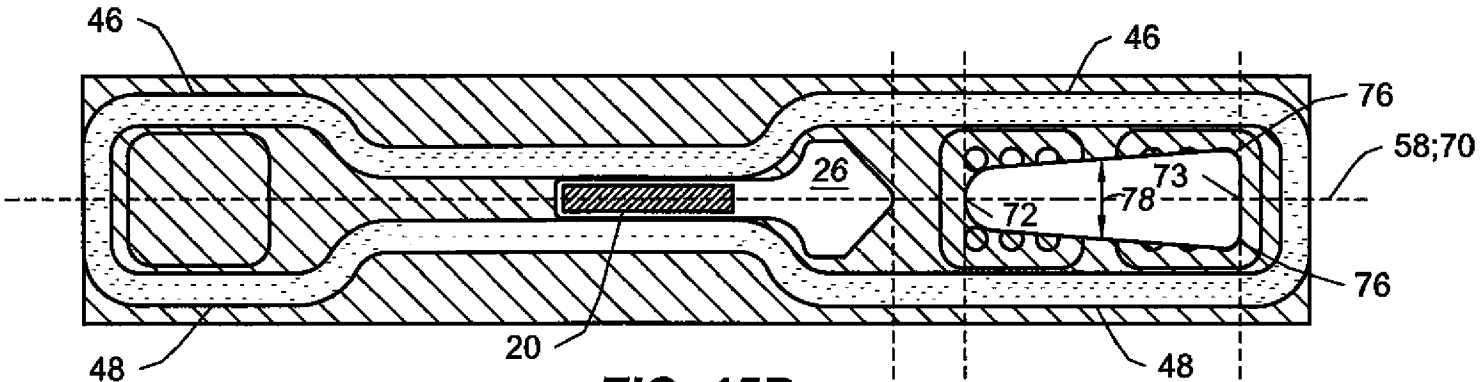
Figure 16A:
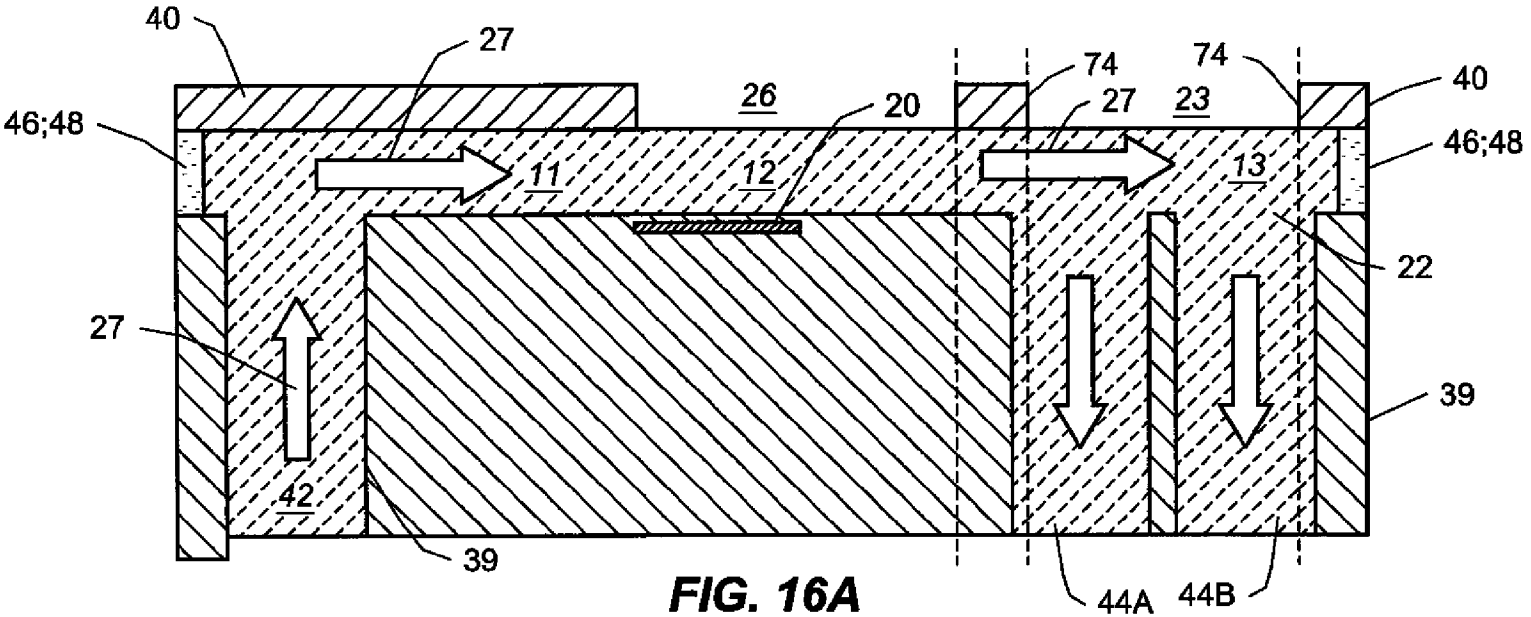
FIGS. 16A and 16B are a schematic cross sectional view and a schematic plan view, respectively, of another example embodiment of a liquid dispenser made in accordance with the present invention.
Figure 16B:
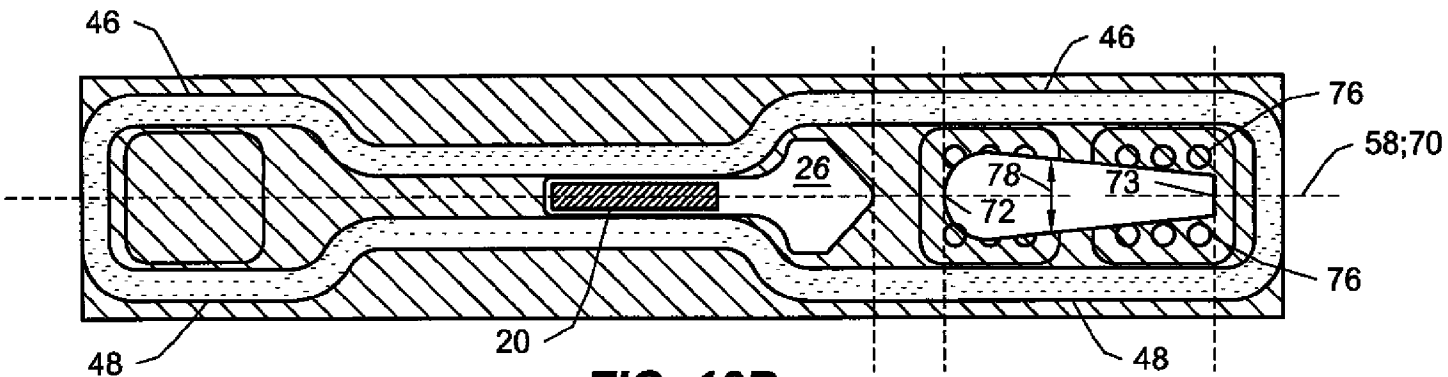

Drain 23 can include other features. For example, as shown in FIGS. 11A, 12A, 13A, 14A, 15A, 16A, and 18A, a wall 74 of drain 23 can be perpendicular relative to the surface 54 of wall 40 of the liquid dispensing channel 12. Alternatively, as shown in FIG. 17A, wall 74 of drain 23 can be sloped relative to the surface 54 of wall 40 of the liquid dispensing channel 12. As shown in FIGS. 11B, 12B, 13B, 14B, 15B, 16B, 17B, and 18B, an upstream edge 72 of drain 23 can include the radius of curvature. In some example embodiments, for example, those shown in FIGS. 13B and 14B, this radius of curvature is a first radius of curvature with a downstream edge 73 of drain 23 including a second radius of curvature that is distinct when compared to the first radius of curvature. In other example embodiments, for example, those shown in FIGS. 11B and 17B, the second radius of curvature is the same as the first radius of curvature. Alternatively, as shown in FIGS. 12B, 15B, and 16B, downstream edge 73 is straight and has no radius of curvature. The corners 76 of downstream edge 73 can be rounded to provide mechanical stability.

Referring back to FIGS. 1A, 1B, and 11A-18B, another method of ejecting liquid from a liquid dispenser will be described. A liquid dispenser is provided that includes a liquid supply channel, a liquid dispensing channel, and a liquid return channel. The liquid dispensing channel includes a wall. The wall includes a surface. A portion of the wall defines an outlet opening. Another portion of the wall defines a drain located in the wall downstream from the outlet opening. The drain includes a radius of curvature as viewed from a direction perpendicular to the wall. A liquid is provided that flows from the liquid supply channel through the liquid dispensing channel to the liquid return channel. A liquid drop is caused to be ejected from the outlet opening of the liquid dispensing channel by selectively actuating a diverter member to divert a portion of the flowing liquid through the outlet opening of the liquid dispensing channel.

Selectively actuating the diverter member to divert a portion of the flowing liquid through the outlet opening of the liquid dispensing channel can include applying heat to a portion of the liquid flowing through the liquid dispensing channel. Providing the liquid that flows from the liquid supply channel through the liquid dispensing channel to the liquid return channel can include providing the liquid under pressure sufficient to cause the liquid to flow from the liquid supply channel through the liquid dispensing channel to the liquid return channel in a continuous manner. Additionally, providing the liquid dispenser can include providing a liquid dispenser that includes any of the example embodiments described above either alone or in combination with each other.

Referring to FIGS. 19A-24B and back to FIGS. 11A-18B, 1A, and 1B, example embodiments of a liquid dispenser 10 that include another aspect of the present invention are shown. As shown in FIGS. 19A-24B and 11A-18B, liquid return passage 44 includes a plurality of individual liquid return passages 44A, 44B, 44C. The overall (aggregate) size of liquid return passage 44 is still greater than the size of liquid supply passage 42 but the size and shape of individual liquid return passages 44A, 44B, 44C is approximately equal to the size and shape of liquid supply passage 42. It is believed that this feature not only accommodates liquid flow and pressure changes in liquid return channel 13 which reduces the likelihood of liquid spilling over outlet opening 26 of liquid dispensing channel 12, but also facilitates the manufacturing of liquid dispenser 10 and improves the heat dissipation from diverter member 20 to the liquid flowing through individual liquid return passages 44A, 44B, 44C. In FIGS. 19A-24B, drain 23 has been removed from each "B" figure so that individual liquid return passages 44A, 44B, 44C can be seen more clearly.

Figure 24A:
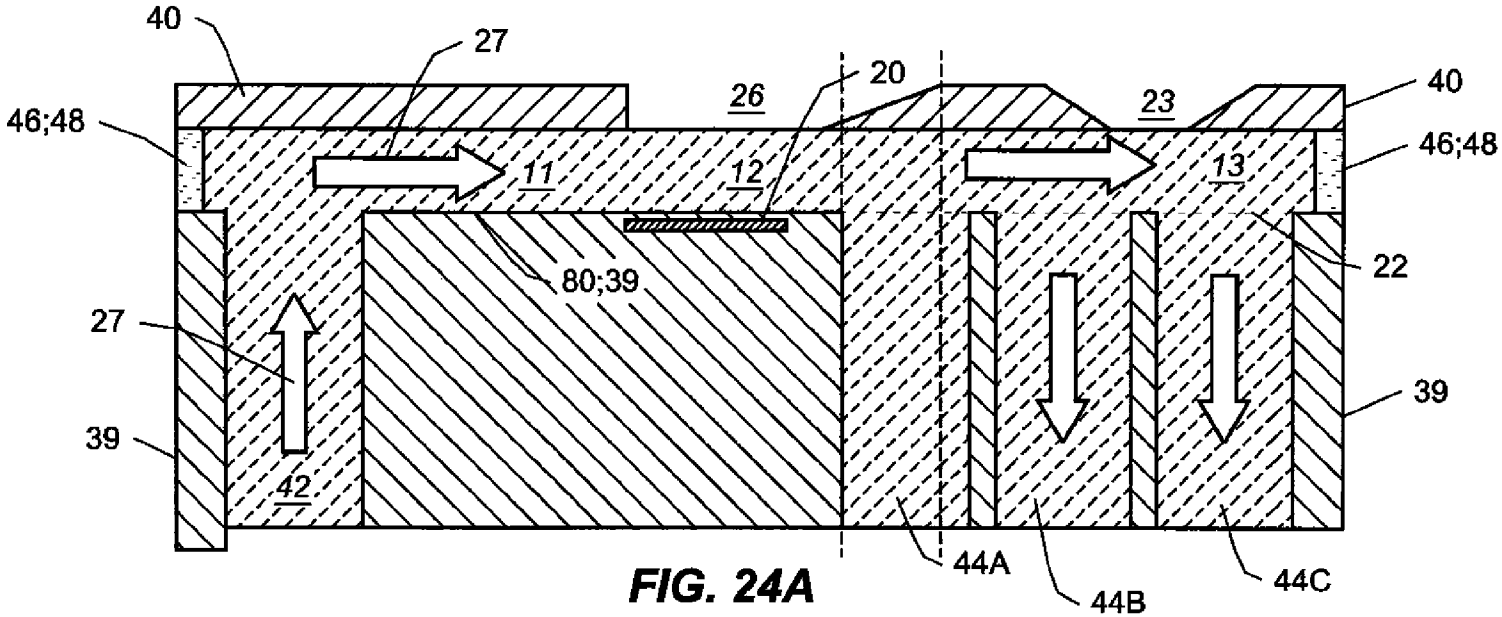
FIGS. 24A and 24B are a schematic cross sectional view and a schematic plan view, respectively, of another example embodiment of a liquid dispenser made in accordance with the present invention.
Figure 24B:
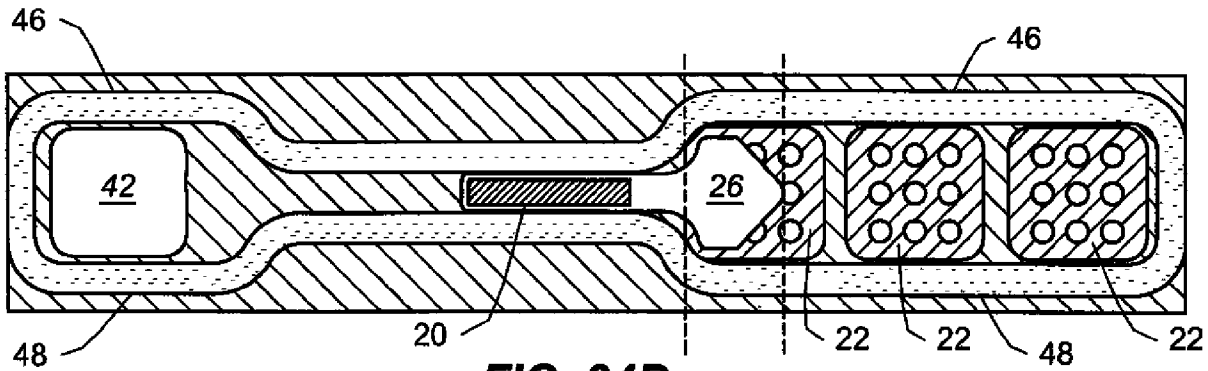

Liquid dispensing channel 12 includes a first wall 40. A portion of first wall 40 defines outlet opening 26. Liquid dispensing channel 12 includes a second wall 80 opposite first wall 40. Second wall 80 of liquid dispensing channel 12 extends along a portion of liquid supply channel 11 and along a portion of liquid return channel 13. Liquid supply passage 42 extends through second wall 80 and is in fluid communication with liquid supply channel 11. A plurality of liquid return passages 44A, 44B (and 44C as shown in FIGS. 24A and 24B) extend through second wall 80 and are in fluid communication with liquid return channel 13. Liquid supply 24 (shown in FIGS. 1A and 1B) provides liquid that flows from liquid supply passage 42 through liquid supply channel 11, through liquid dispensing channel 12, and through liquid return channel 13 to the plurality of liquid return passages 44A, 44B (and 44C as shown in FIGS. 24A and 24B). Diverter member 20 selectively diverts a portion of the flowing liquid through outlet opening 26 of liquid dispensing channel 12.

As shown in FIGS. 11A-24B, the plurality of liquid return passages 44A, 44B (and 44C as shown in FIGS. 24A and 24B) can be aligned relative to a centerline 70 (shown in FIGS. 11B and 18B for example) positioned along the direction of the liquid flow 27 through liquid dispensing channel 12 as viewed from a direction perpendicular to first wall 40 of liquid dispensing channel 12. Each individual liquid return passage 44A, 44B, 44C has an area that is substantially the same as the area of the other liquid return passages 44A, 44B, 44C. Liquid supply passage 42 also has an area that is substantially equal to the area of one (or more) of the plurality of liquid return passages 44A, 44B, 44C. Accordingly, the overall (aggregate) area of liquid return passages 44A, 44B, 44C is greater than the area of liquid supply passage 42.

Figure 19A:
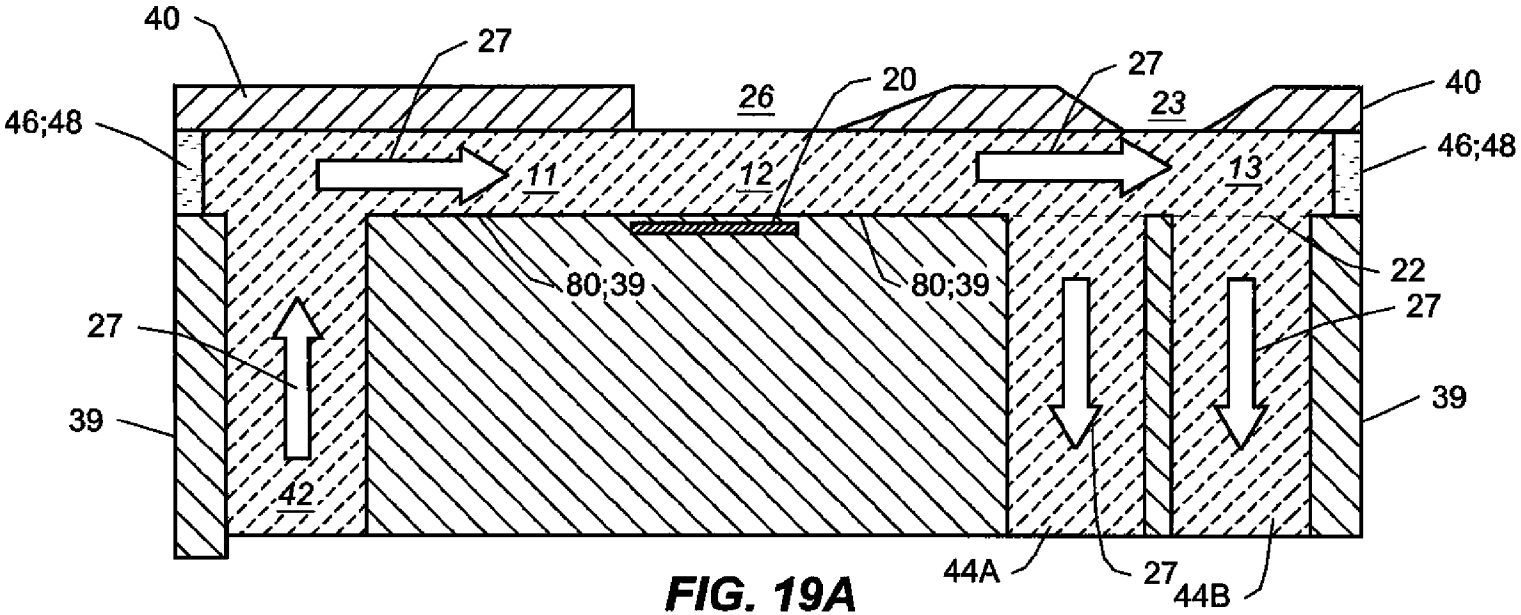
FIGS. 19A and 19B are a schematic cross sectional view and a schematic plan view, respectively, of another example embodiment of a liquid dispenser made in accordance with the present invention.
Figure 19B:
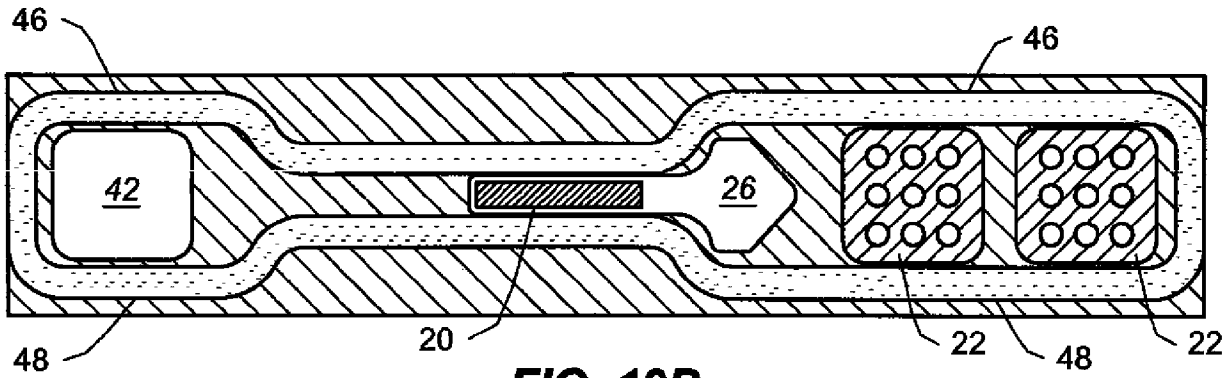
Figure 22A:
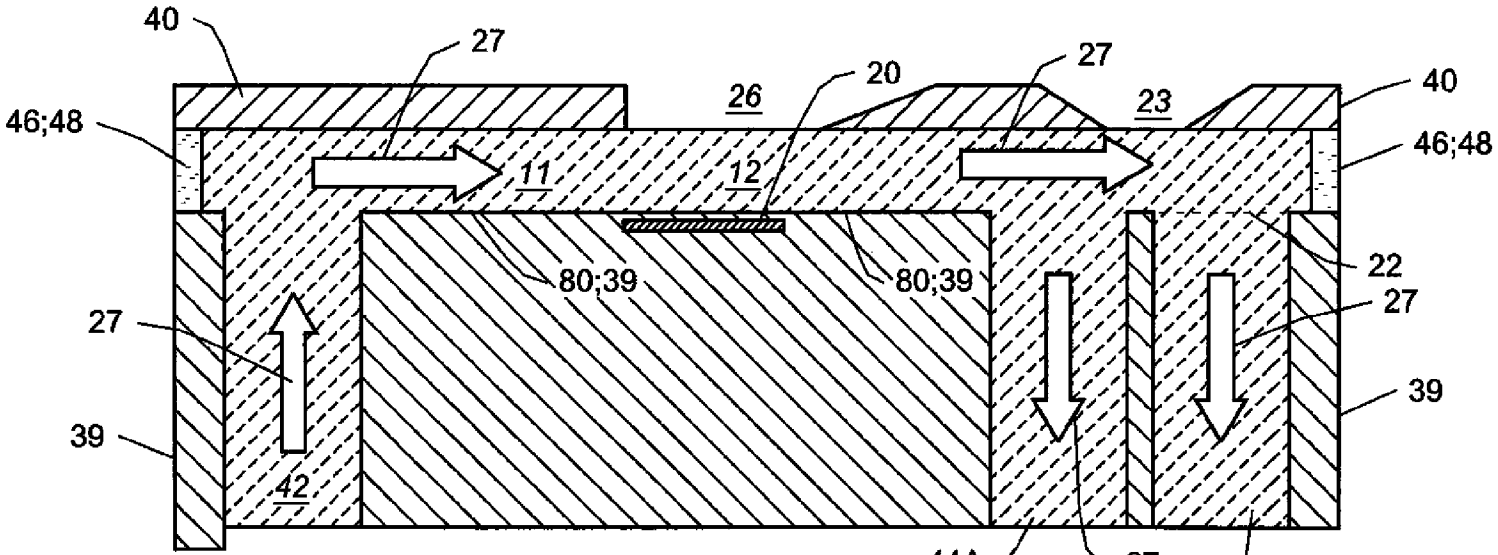
FIGS. 22A and 22B are a schematic cross sectional view and a schematic plan view, respectively, of another example embodiment of a liquid dispenser made in accordance with the present invention.
Figure 22B:
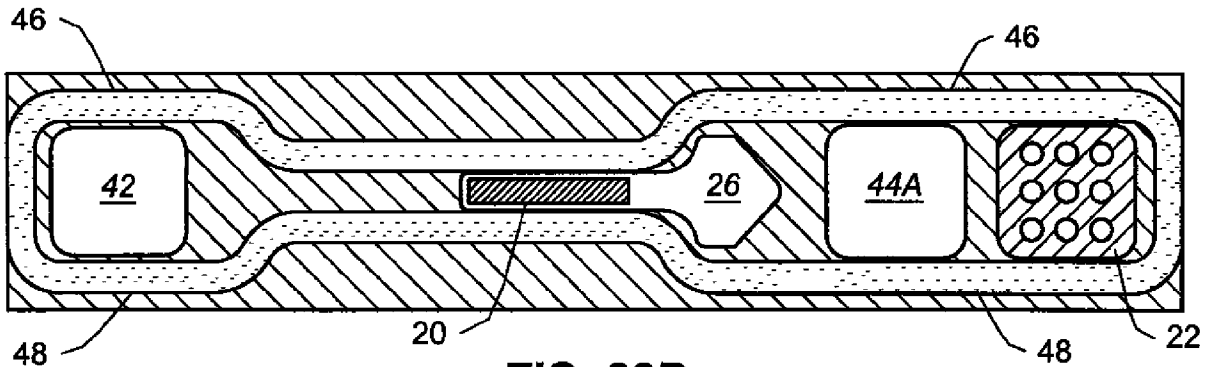
Figure 23A:
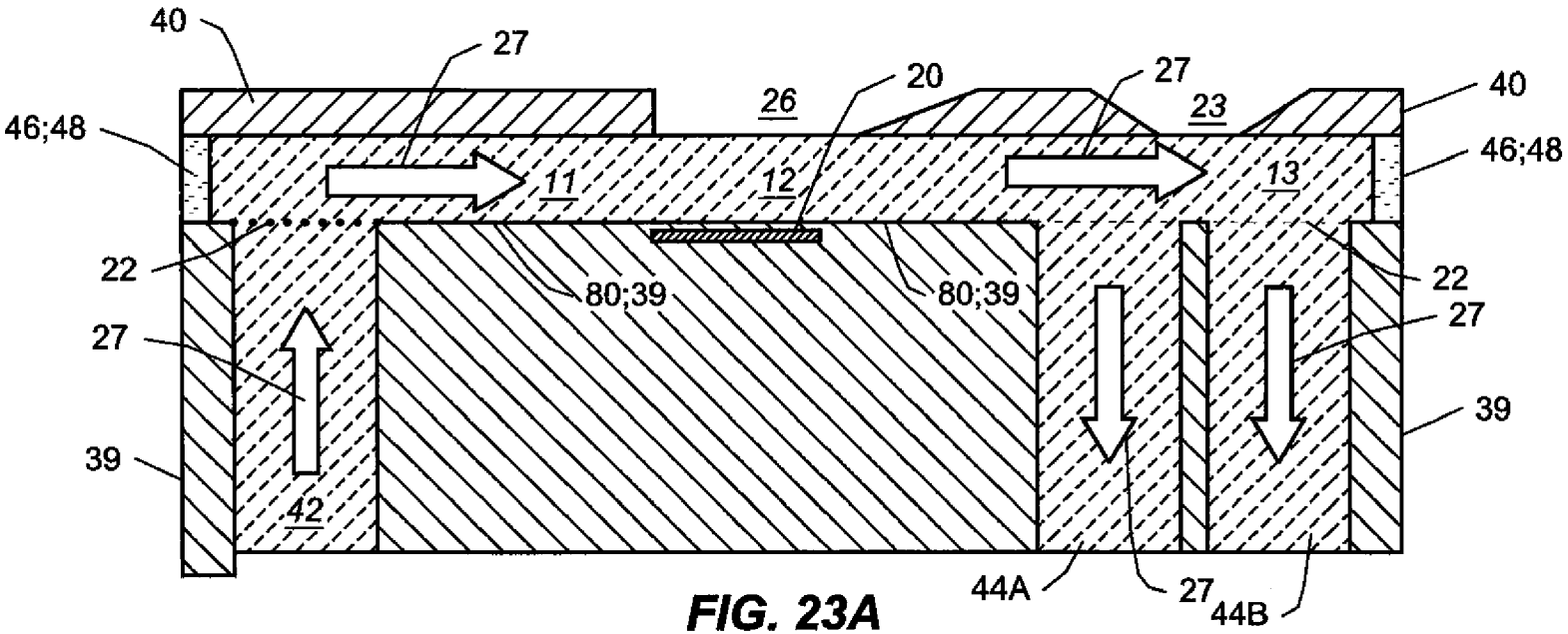
FIGS. 23A and 23B are a schematic cross sectional view and a schematic plan view, respectively, of another example embodiment of a liquid dispenser made in accordance with the present invention.
Figure 23B:
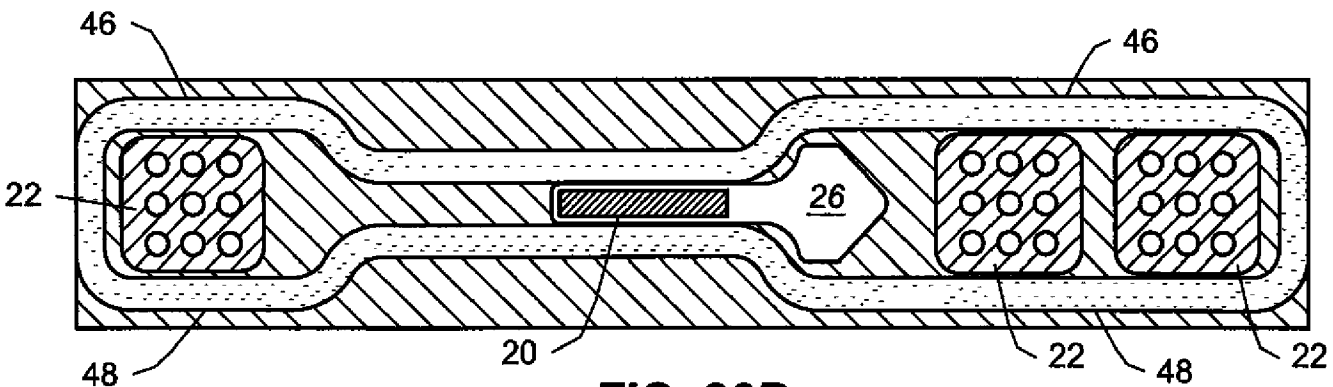

At least one of the plurality of liquid return passages 44A, 44B, 44C includes a porous member 22. For example, as shown in FIGS. 19A and 19B, both of liquid return passages 44A and 44B include porous member 22. However, as shown in FIGS. 22A and 22B, only liquid return passage 44B includes porous member 22. The characteristics of the plurality of pores included in porous member 22 can change depending on the specific application of liquid dispenser 10. For example, as shown in FIGS. 23A and 23B, each of the plurality of pores the porous members 22 positioned in liquid return passages 44A and 44B has substantially the same size when compared to each other. In FIGS. 23A and 23B, liquid supply passage 42 includes a porous member 22.

Figure 20A:
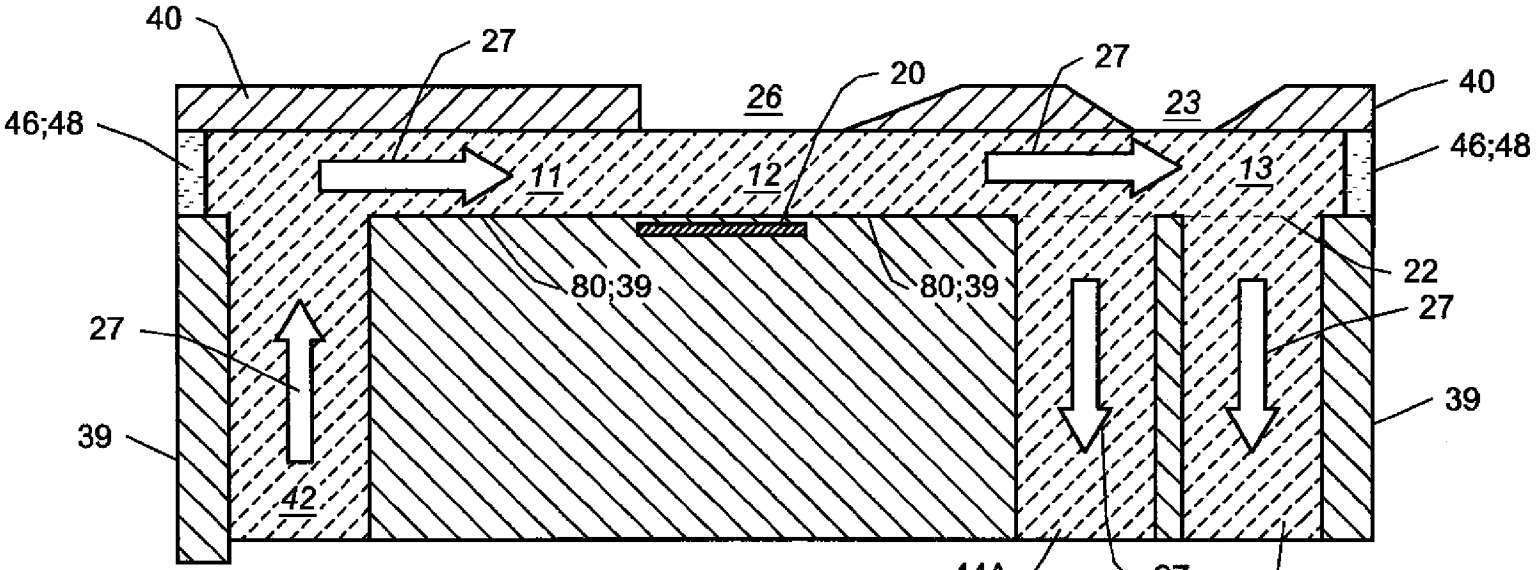
FIGS. 20A and 20B are a schematic cross sectional view and a schematic plan view, respectively, of another example embodiment of a liquid dispenser made in accordance with the present invention.
Figure 20B:
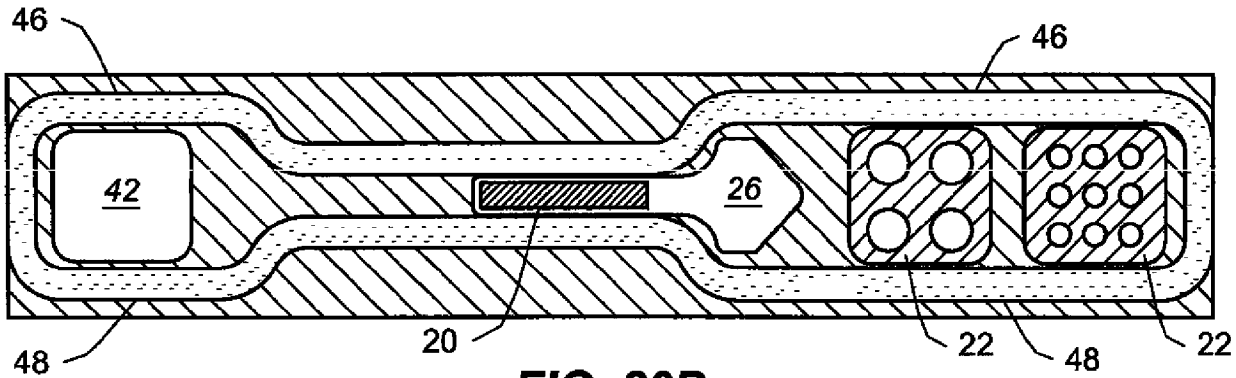
Figure 21A:
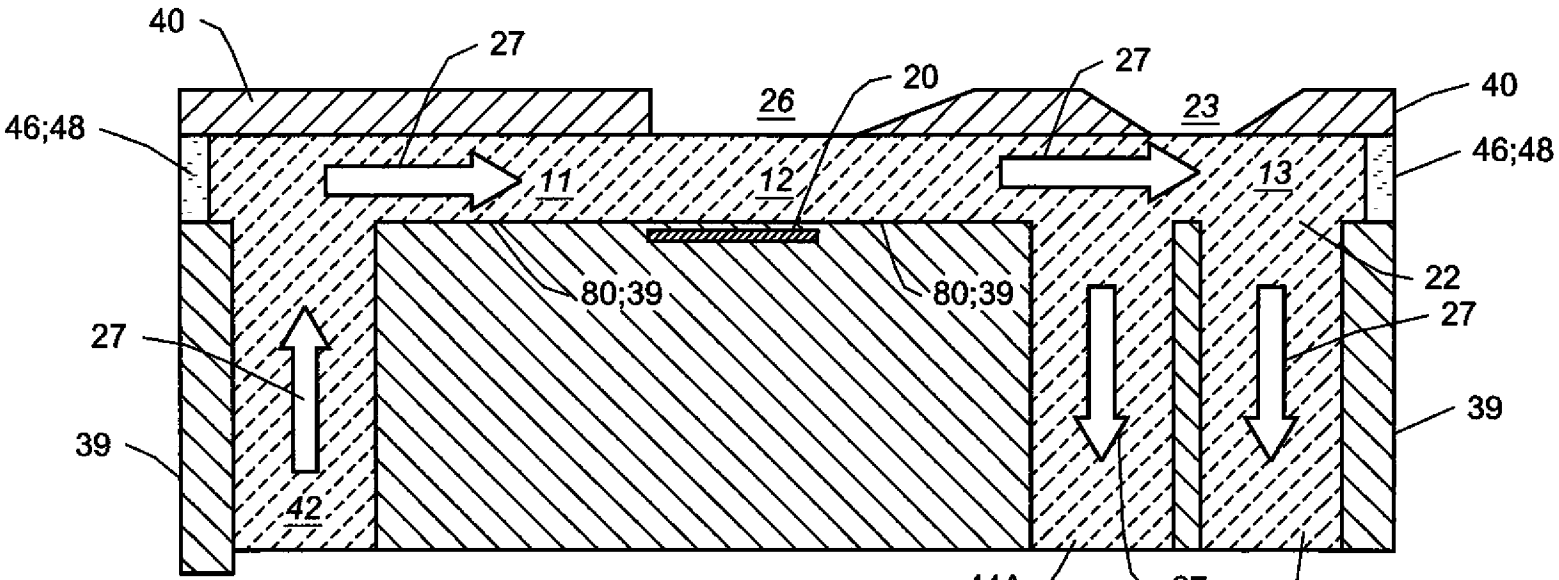
FIGS. 21A and 21B are a schematic cross sectional view and a schematic plan view, respectively, of another example embodiment of a liquid dispenser made in accordance with the present invention.
Figure 21B:
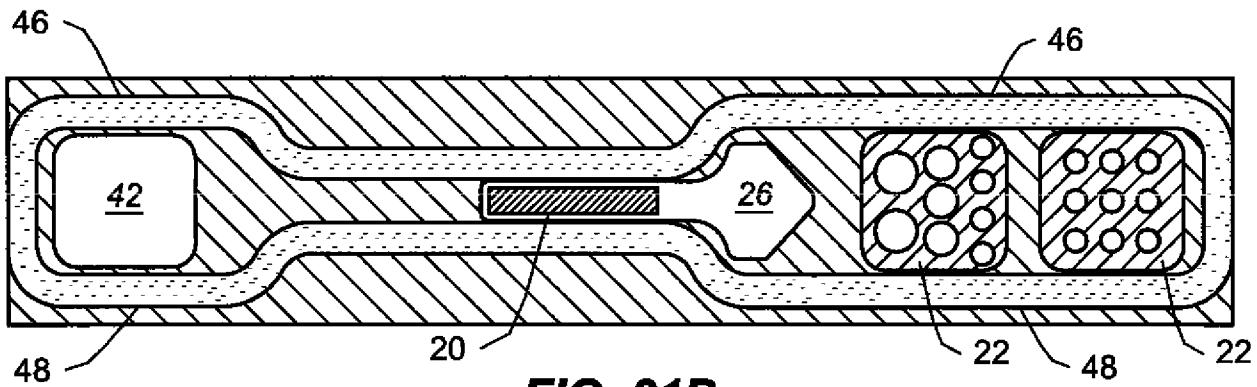

Alternatively, porous member(s) 22 can include a plurality of pores in which pore size varies. For example, as shown in FIGS. 20A and 20B, the pore size of the porous member 22 positioned in liquid return passage 44A is different when compared to the pore size of the porous member 22 positioned in liquid return passage 44B. In FIGS. 20A and 20B, the pore size of the porous member 22 positioned in liquid return passage 44A and the pore size of the porous member 22 positioned in liquid return passage 44B varies monotonically along the direction of the liquid flow 27 through liquid dispensing channel 12. Pore size variation can occur with the pores of a single porous member 22. As shown in FIGS. 21A and 21B, the pore size of the porous member 22 positioned in liquid return passage 44A varies within the porous member 22. In FIGS. 21A and 21B, the pore size varies monotonically along the direction of the liquid flow 27 through liquid dispensing channel 12 within the porous member 22 positioned in liquid return passage 44A.

When at least each of two of the plurality of liquid return passages, for example, when at least two of liquid return passages 44A, 44B, or 44C include a porous member 22, the pores can have the same pore sizes as shown in FIGS. 24A and 24B or different pore sizes. Alternatively, each porous member 22 can include a liquid flow impedance that is distinct when compared to another porous member 22.

Referring back to FIGS. 1A, 1B, and 11A-24B, another method of ejecting liquid from a liquid dispenser will be described. A liquid dispenser is provided that includes a liquid supply channel, a liquid dispensing channel, and a liquid return channel. The liquid dispensing channel includes a first wall. A portion of the first wall defines an outlet opening. The liquid dispensing channel includes a second wall opposite the first wall. The second wall of the liquid dispensing channel extends along a portion of the liquid supply channel and along a portion of the liquid return channel. A liquid supply passage is provided that extends through the second wall and is in fluid communication with the liquid supply channel. A plurality of liquid return passages are provided that extend through the second wall and are in fluid communication with the liquid return channel. A liquid is provided that flows from the liquid supply passage through the liquid supply channel through the liquid dispensing channel through the liquid return channel to the plurality of liquid return passages. A liquid drop is caused to be ejected from the outlet opening of the liquid dispensing channel by selectively actuating a diverter member to divert a portion of the flowing liquid through the outlet opening of the liquid dispensing channel.

Selectively actuating the diverter member to divert a portion of the flowing liquid through the outlet opening of the liquid dispensing channel can include applying heat to a portion of the liquid flowing through the liquid dispensing channel. Providing the liquid that flows from the liquid supply channel through the liquid dispensing channel to the liquid return channel can include providing the liquid under pressure sufficient to cause the liquid to flow from the liquid supply channel through the liquid dispensing channel to the liquid return channel in a continuous manner. Additionally, providing the liquid dispenser can include providing a liquid dispenser that includes any of the example embodiments described above either alone or in combination with each other.

Referring to FIGS. 24A and 24B and back to FIGS. 1A and 1B, an example embodiment of a liquid dispenser 10 that includes another aspect of the present invention is shown. Liquid dispensing channel 12 includes a first wall 40. First wall 40 includes a surface 54 (either interior surface 54A or exterior surface 54B). A portion of first wall 40 defines outlet opening 26. Liquid dispensing channel 12 includes a second wall 80 opposite first wall 40. Second wall 80 of liquid dispensing channel 12 extends along a portion of liquid supply channel 11 and along a portion of liquid return channel 13. Liquid supply passage 42 extends through second wall 80 and is in fluid communication with liquid supply channel 11. A plurality of liquid return passages 44A, 44B, and 44C extend through second wall 80 and are in fluid communication with liquid return channel 13. Liquid supply 24 (shown in FIGS. 1A and 1B) provides liquid that flows from liquid supply passage 42 through liquid supply channel 11, through liquid dispensing channel 12, and through liquid return channel 13 to the plurality of liquid return passages 44A, 44B, and 44C. Diverter member 20 selectively diverts a portion of the flowing liquid through outlet opening 26 of liquid dispensing channel 12. Liquid return passage 44A overlaps outlet opening 26 of liquid dispensing channel 12 as viewed from a direction perpendicular to surface 54 of first wall 40 of liquid dispensing channel 12. Liquid return passage 44A is located downstream and spaced apart from diverter member 20. Liquid return passage 44A includes a porous member.

Additionally, as shown in FIGS. 24A and 24B, liquid return passage 44A is a first liquid return passage and liquid dispenser 10 includes a second liquid return passage (either 44B or 44C) positioned downstream from first liquid return passage 44A. At least one of first liquid return passage 44A and second liquid return passage (either 44B or 44C) includes a porous member.

Referring back to FIGS. 1A, 1B, 24A, and 24B, another method of ejecting liquid from a liquid dispenser will be described. A liquid dispenser is provided that includes a liquid supply channel, a liquid dispensing channel, and a liquid return channel. The liquid dispensing channel includes a first wall. The first wall includes a surface. A portion of the first wall defines an outlet opening. The liquid dispensing channel includes a second wall that is positioned opposite the first wall. The second wall of the liquid dispensing channel extends along a portion of the liquid supply channel and along a portion of the liquid return channel. A liquid supply passage is provided that extends through the second wall in and is fluid communication with the liquid supply channel. A liquid return passage is provided that extends through the second wall and is in fluid communication with the liquid return channel. The liquid return passage overlaps the outlet opening of the liquid dispensing channel as viewed from a direction perpendicular to the surface of the first wall of the liquid dispensing channel. A liquid is provided that flows from the liquid supply passage through the liquid supply channel through the liquid dispensing channel through the liquid return channel to the liquid return passage. A liquid drop is caused to be ejected from the outlet opening of the liquid dispensing channel by selectively actuating a diverter member to divert a portion of the flowing liquid through the outlet opening of the liquid dispensing channel.

Selectively actuating the diverter member to divert a portion of the flowing liquid through the outlet opening of the liquid dispensing channel can include applying heat to a portion of the liquid flowing through the liquid dispensing channel. Providing the liquid that flows from the liquid supply channel through the liquid dispensing channel to the liquid return channel can include providing the liquid under pressure sufficient to cause the liquid to flow from the liquid supply channel through the liquid dispensing channel to the liquid return channel in a continuous manner. Additionally, providing the liquid dispenser can include providing a liquid dispenser that includes any of the example embodiments described above either alone or in combination with each other.

Referring to FIGS. 25A-26B and back to FIGS. 1A and 1B, an example embodiment of a liquid dispenser 10 that includes another aspect of the present invention is shown. Liquid dispensing channel 12 includes a first wall 40. Wall 40 includes a surface 54 (either interior surface 54A or exterior surface 54B). A portion of first wall 40 defines an outlet opening 26. Liquid dispensing channel 12 also includes a second wall 80 positioned opposite first wall 40. Second wall 80 of liquid dispensing channel 12 extends along a portion of liquid supply channel 11 and along a portion of liquid return channel 13. A liquid supply passage 42 extends through second wall 80 and is in fluid communication with liquid supply channel 11. Liquid supply passage 42 includes a porous member 22. A liquid return passage 44 extends through second wall 80 and is in fluid communication with liquid return channel 13. Liquid return passage includes a porous member 22. A liquid supply 24 provides liquid that flows from liquid supply passage 42 through the liquid supply channel 11, through liquid dispensing channel 12, and through liquid return channel 13 to liquid return passage 44. Diverter member 20 selectively diverts a portion of the flowing liquid through outlet opening 26 of liquid dispensing channel 12.

As shown in FIGS. 25A-26B, porous member 22 is positioned in liquid supply channel 11 in the area where liquid supply channel 11 and liquid supply passage 42 intersect. As such, it can be stated that either liquid supply passage 42 includes porous member 22 or that liquid supply channel 11 includes porous member 22. The same can be said when referring to other example embodiments of the present invention that include a porous member 22 at the intersection of where liquid supply channel 11 and liquid supply passage 42. Alternatively, porous member 22 can be positioned in liquid supply passage 42 upstream from its location as shown in FIGS. 25A-26B. Also, as shown in FIGS. 25A-26B, porous member 22 is positioned in liquid return channel 13 in the area where liquid return channel 13 and liquid return passage 44 intersect. As such, it can be stated that either liquid return passage 44 includes porous member 22 or that liquid return channel 13 includes porous member 22. The same can be said when referring to other example embodiments of the present invention that include a porous member 22 at the intersection of liquid return channel 13 and liquid return passage 44. Alternatively, porous member 22 can be positioned in liquid return passage 44 downstream from its location as shown in FIGS. 25A-26B.

Figure 25A:
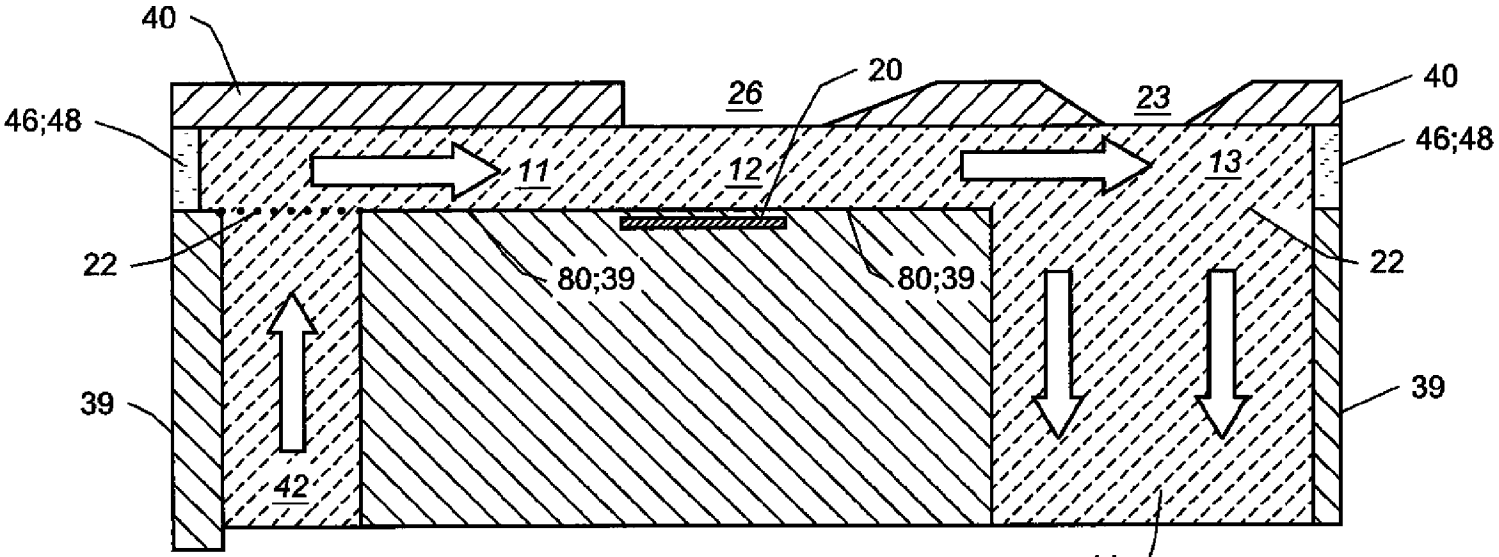
FIGS. 25A and 25B are a schematic cross sectional view and a schematic plan view, respectively, of another example embodiment of a liquid dispenser made in accordance with the present invention.
Figure 25B:
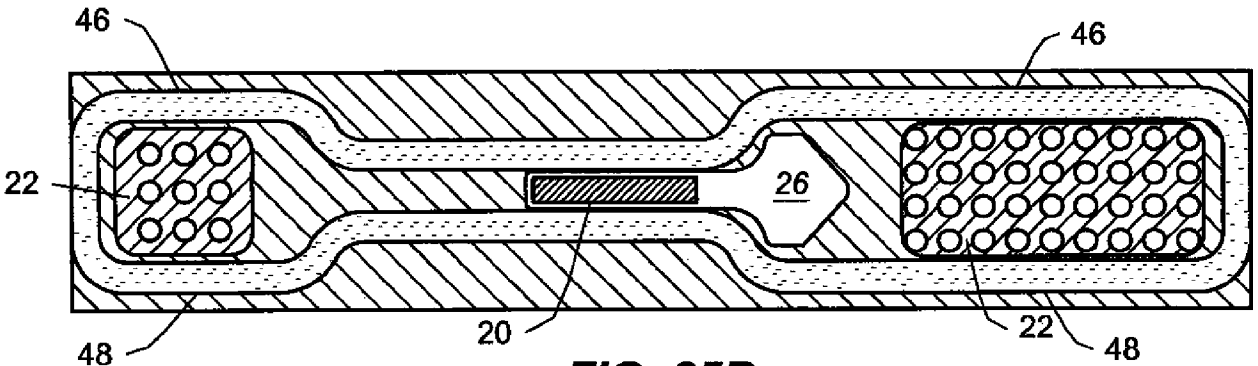
Figure 26A:
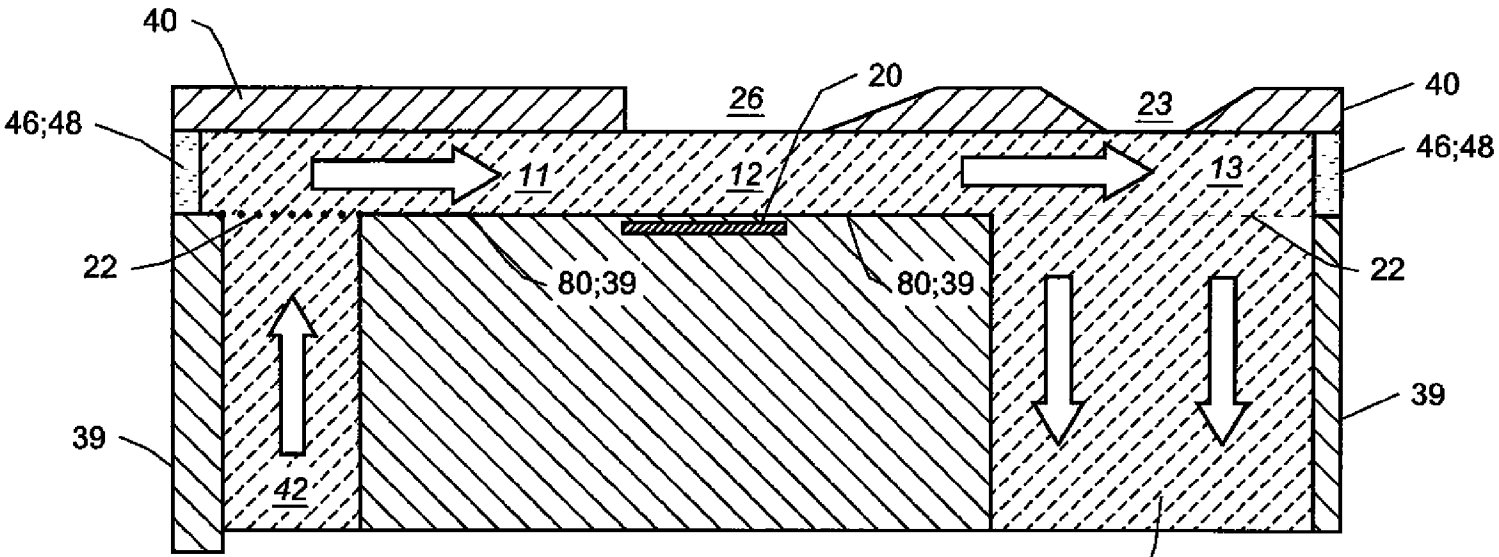
FIGS. 26A and 26B are a schematic cross sectional view and a schematic plan view, respectively, of another example embodiment of a liquid dispenser made in accordance with the present invention.
Figure 26B:
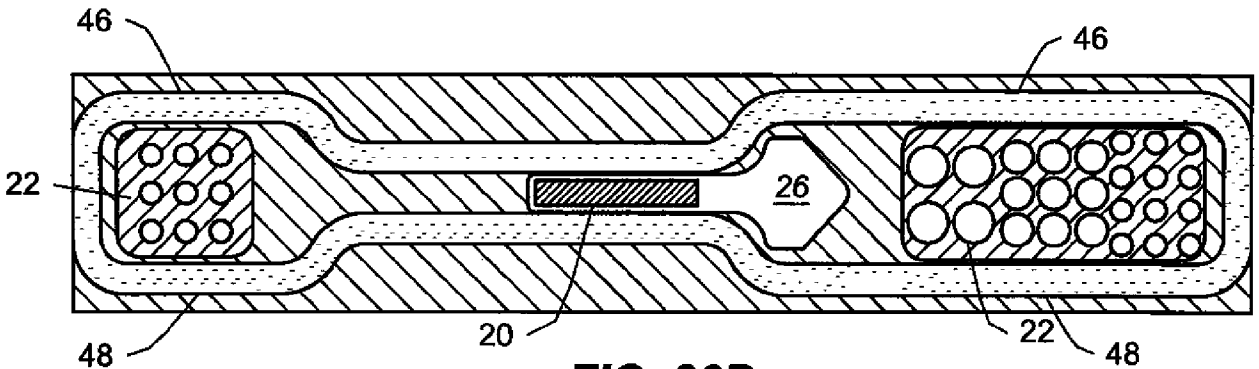

As shown in FIGS. 25A and 25B, porous member 22 includes pores that have the same size. Alternatively, porous member 22 includes pores that have variations in size when compared to each other. As shown in FIGS. 26A and 26B, the pore size varies monotonically along the direction of the liquid flow 27 through liquid dispensing channel 12. The pores of porous member 22 can also be shaped to provide distinct liquid flow impedances. In FIGS. 25B-26B, drain 23 has been removed from each "B" figure so that the liquid return passage 44 and porous member 22 can be seen more clearly.

Referring back to FIGS. 1A, 1B, and 25A-26B, another method of ejecting liquid from a liquid dispenser will be described. A liquid dispenser is provided that includes a liquid supply channel, a liquid dispensing channel, and a liquid return channel. The liquid dispensing channel includes a first wall. A portion of the first wall defines an outlet opening. The liquid dispensing channel includes a second wall that is positioned opposite the first wall. The second wall of the liquid dispensing channel extends along a portion of the liquid supply channel and along a portion of the liquid return channel. A liquid supply passage is provided that extends through the second wall and is in fluid communication with the liquid supply channel. The liquid supply passage includes a porous member. A liquid return passage is provided that extends through the second wall and is in fluid communication with the liquid return channel. The liquid return passage includes a porous member. A liquid is provided that flows from the liquid supply passage through the liquid supply channel through the liquid dispensing channel through the liquid return channel to the liquid return passage. A liquid drop is caused to be ejected from the outlet opening of the liquid dispensing channel by selectively actuating a diverter member to divert a portion of the flowing liquid through the outlet opening of the liquid dispensing channel.

Selectively actuating the diverter member to divert a portion of the flowing liquid through the outlet opening of the liquid dispensing channel can include applying heat to a portion of the liquid flowing through the liquid dispensing channel. Providing the liquid that flows from the liquid supply channel through the liquid dispensing channel to the liquid return channel can include providing the liquid under pressure sufficient to cause the liquid to flow from the liquid supply channel through the liquid dispensing channel to the liquid return channel in a continuous manner. Additionally, providing the liquid dispenser can include providing a liquid dispenser that includes any of the example embodiments described above either alone or in combination with each other.

Referring to FIGS. 27A-32B and back to FIGS. 1A and 1B, example embodiments of a liquid dispenser 10 that include another aspect of the present invention are shown. In FIGS. 27B-32B, drain 23 has been removed from each "B" figure so that the liquid return passage 44 and porous member 22 can be seen more clearly. Liquid dispenser 10 includes a substrate 39 and an array of liquid dispensing elements 82A, 82B, 82C (as shown in FIGS. 27B, 28B, 29B, 30B, 31B, and 32B) positioned on substrate 39. Each liquid dispensing element 82A, 82B, 82C includes a liquid dispensing channel 12 positioned on substrate 39. Liquid dispensing channel 12 includes outlet opening 26 located in wall 40 opposite substrate 39. Diverter member 20 is associated with liquid dispensing channel 12. Liquid return channel 13 is positioned on substrate 39 and is in fluid communication with liquid dispensing channel 12. Liquid supply channel 11 is positioned on substrate 39 and is in fluid communication with liquid dispensing channel 12. Liquid supply passage 42 extends through substrate 39 and in fluid communication with liquid supply channel 11. Liquid return passage 44 extends through substrate 39 and is in fluid communication with liquid return channel 13. Liquid return passage 44 can be a single liquid return passage or a plurality of individual liquid return passages 44A, 44B, 44C as described above.

Liquid supply 24 (shown in FIGS. 1A and 1B) provides a liquid 25 that flows from each liquid supply channel 11 through each liquid dispensing element 12 to each liquid return channel 13 of each liquid dispensing element 82A, 82B, 82C. Each diverter member 20 of each liquid dispensing element 82A, 82B, 82C is selectively activated to divert a portion of the liquid flowing through the associated liquid dispensing channel 12 through the outlet opening 26 of the associated liquid dispensing channel 12 to dispense a drop 15 of liquid 25.

As described above, each liquid dispensing element 82A, 82B, 82C includes a liquid supply passage 42 that is in fluid communication with a liquid supply channel 11 and a liquid return passage 44 that is in fluid communication with a liquid return channel. However, the relationship of supply passage 42 to supply channel 11 and the relationship of return passage 44 to return channel 13 does not have to be one to one. Accordingly, one liquid supply passage 42 can be in fluid communication with more than one liquid supply channel 11 in an alternative example embodiment of this aspect of the present invention. Similarly, one liquid return passage 44 can be in fluid communication with more than one liquid return channel 13 in an alternative example embodiment of this aspect of the present invention.

Liquid supply channel 11 includes a width 84 as viewed from a direction perpendicular to surface 54A or 54B of wall 40. Width 84 varies along the direction of liquid flow 27. Typically, a downstream portion of liquid supply channel 11 is narrower than an upstream portion of liquid supply channel 11.

As viewed in the direction of liquid flow 27, liquid supply channel 11 narrows (or "necks down") upstream from exit 21 of liquid supply channel 11. The wall to wall spacing of wall 46 and wall 48 of liquid supply channel 11 becomes closer together as the liquid travels from liquid supply passage 42 to liquid dispensing channel 12. The cross sectional area of the exit 21 of liquid supply channel 11 is less than the cross section area of liquid supply channel 11 that is adjacent to liquid supply passage 42. This is done to increase the velocity of the liquid flowing through liquid dispensing channel 12. Additionally, in a liquid dispenser 10 that includes an array of liquid dispensing elements 82, there is limited space between neighboring liquid dispensing elements 82A, 82B, 82C. A liquid supply channel 11 that is narrow at exit 21 allows a downstream portion of liquid dispensing channel 12 to be wider than exit 21 in order to control the meniscus height of the liquid in outlet opening 26 so as to reduce or even prevent liquid spills.

Figure 27A:
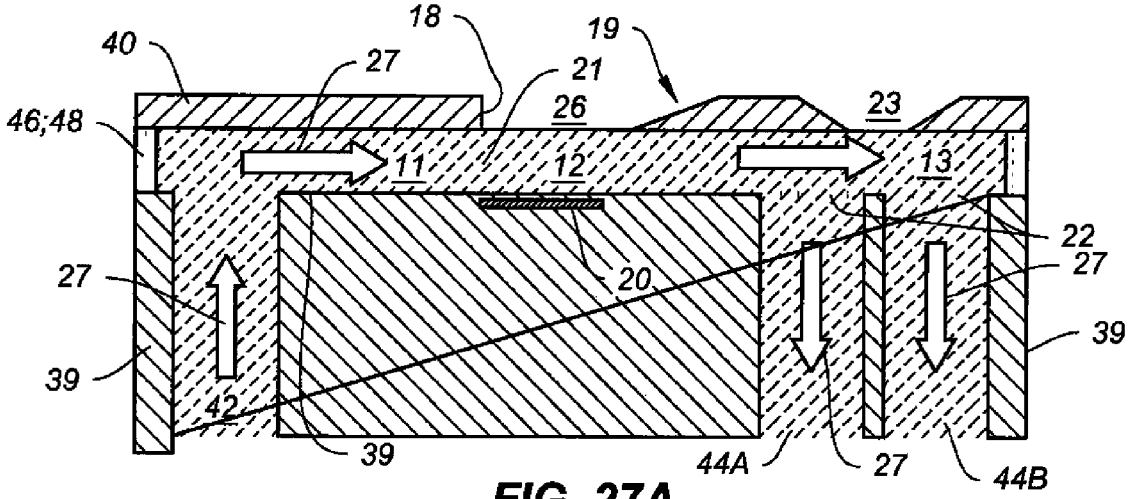
FIGS. 27A and 27B are a schematic cross sectional view and a schematic plan view, respectively, of another example embodiment of a liquid dispenser made in accordance with the present invention.
Figure 27B:
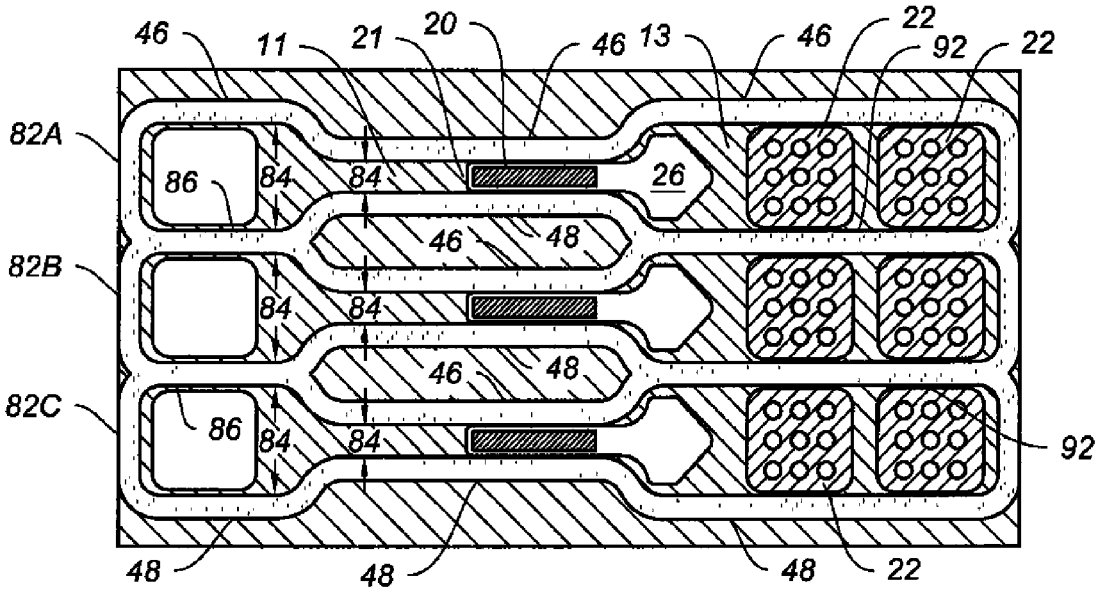
Figure 28A:
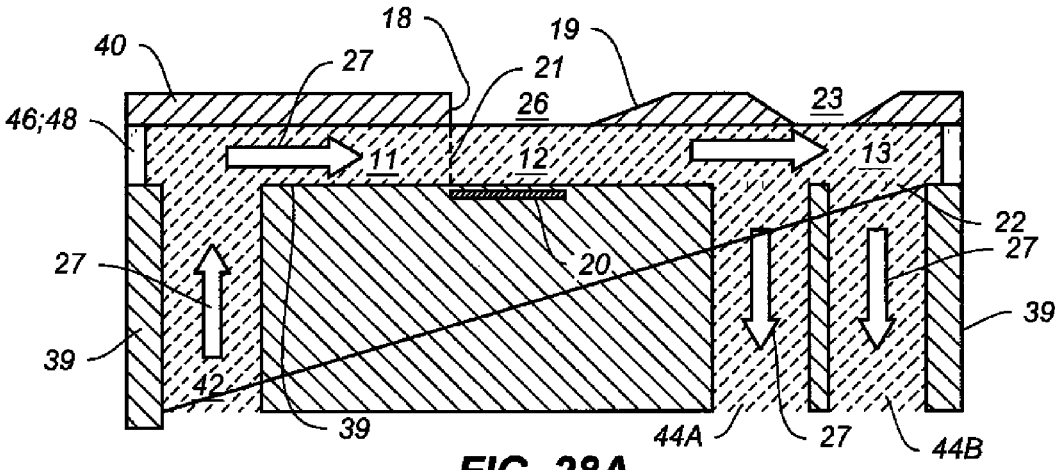
FIGS. 28A and 28B are a schematic cross sectional view and a schematic plan view, respectively, of another example embodiment of a liquid dispenser made in accordance with the present invention.
Figure 28B:
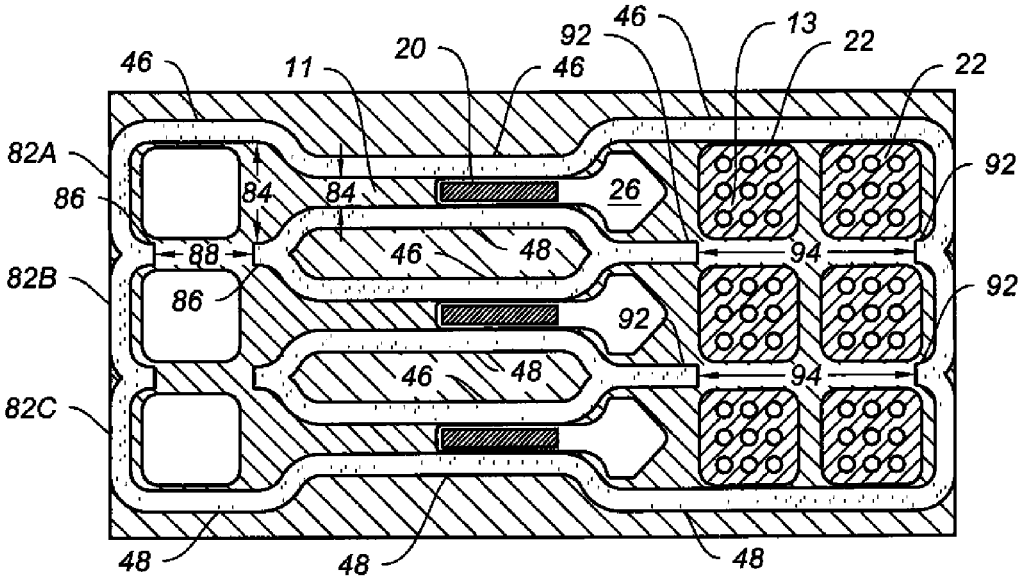
Figure 29A:
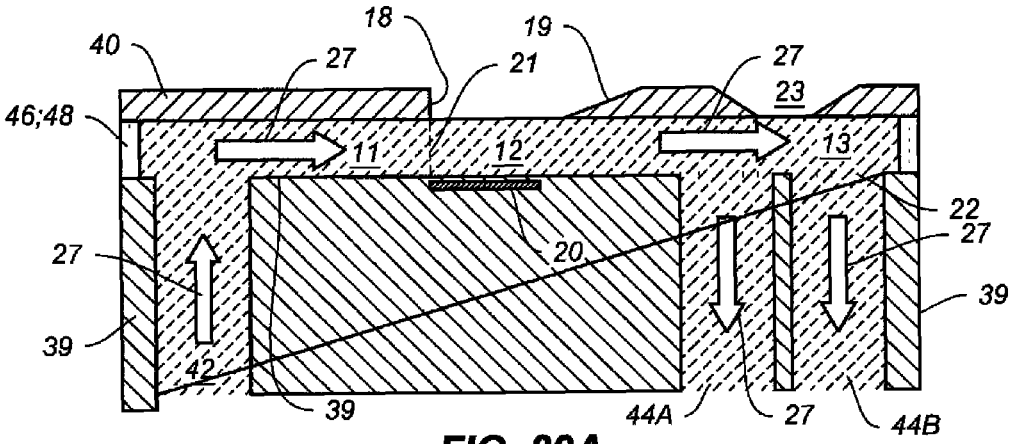
FIGS. 29A and 29B are a schematic cross sectional view and a schematic plan view, respectively, of another example embodiment of a liquid dispenser made in accordance with the present invention.
Figure 29B:
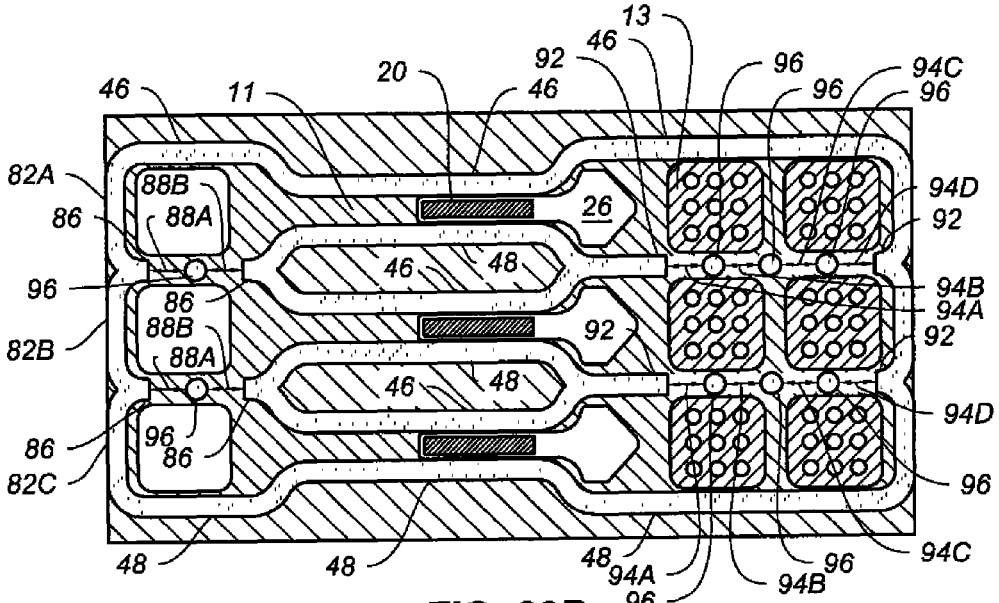
Figure 30A:
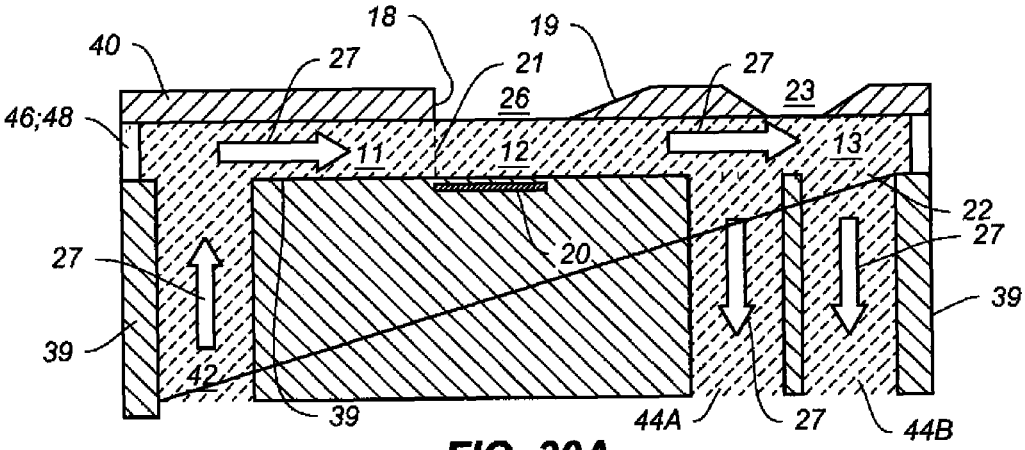
FIGS. 30A and 30B are a schematic cross sectional view and a schematic plan view, respectively, of another example embodiment of a liquid dispenser made in accordance with the present invention.
Figure 30B:
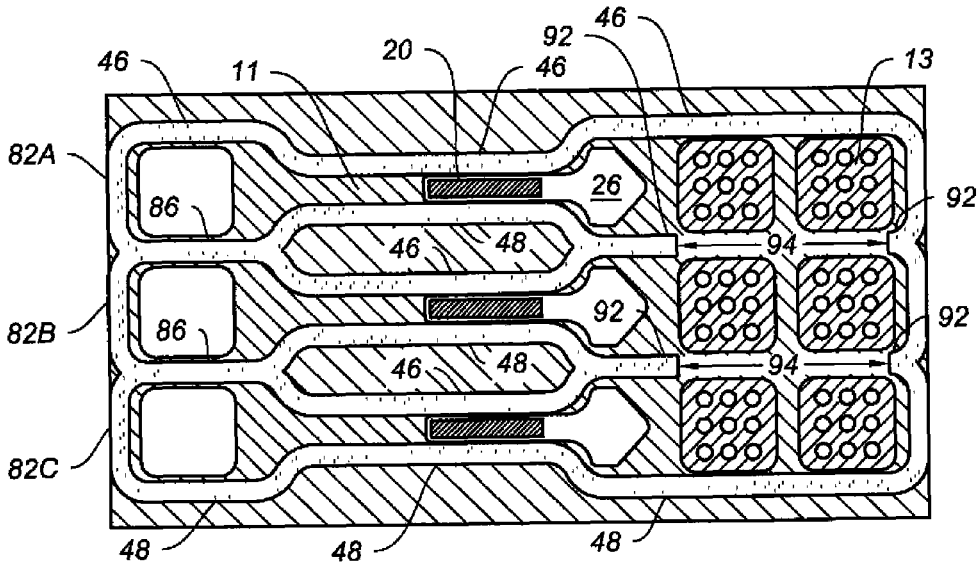
Figure 31A:
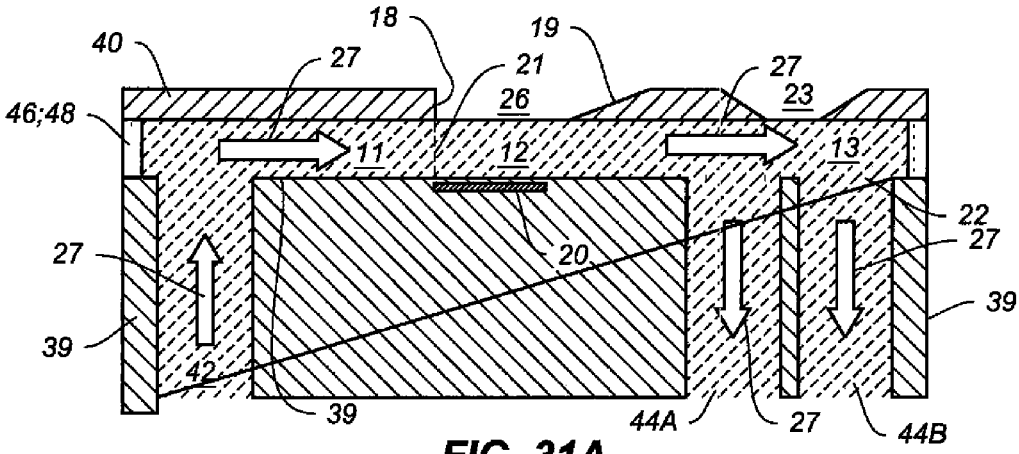
FIGS. 31A and 31B are a schematic cross sectional view and a schematic plan view, respectively, of another example embodiment of a liquid dispenser made in accordance with the present invention.
Figure 31B:
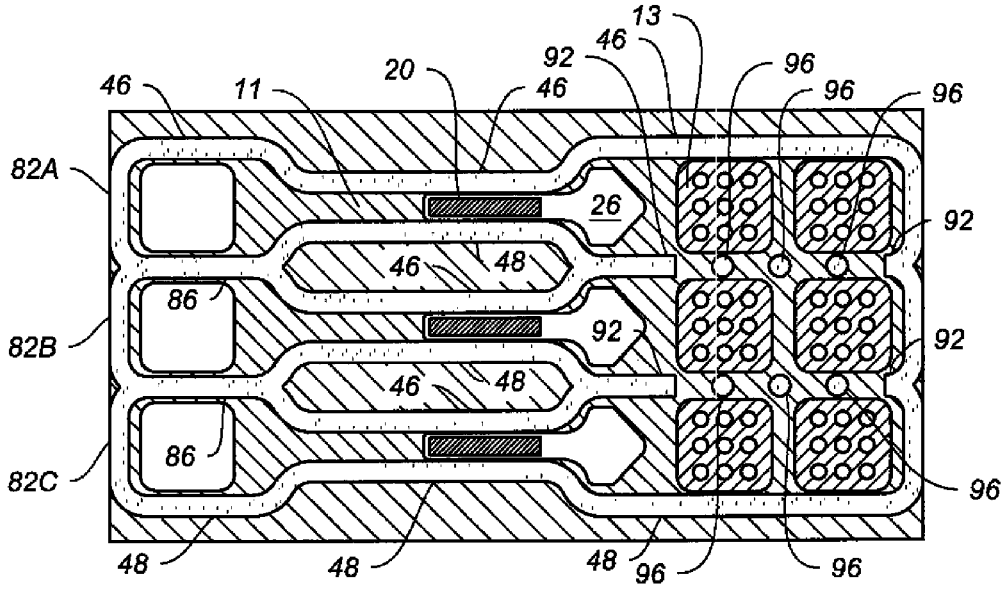
Figure 32A:
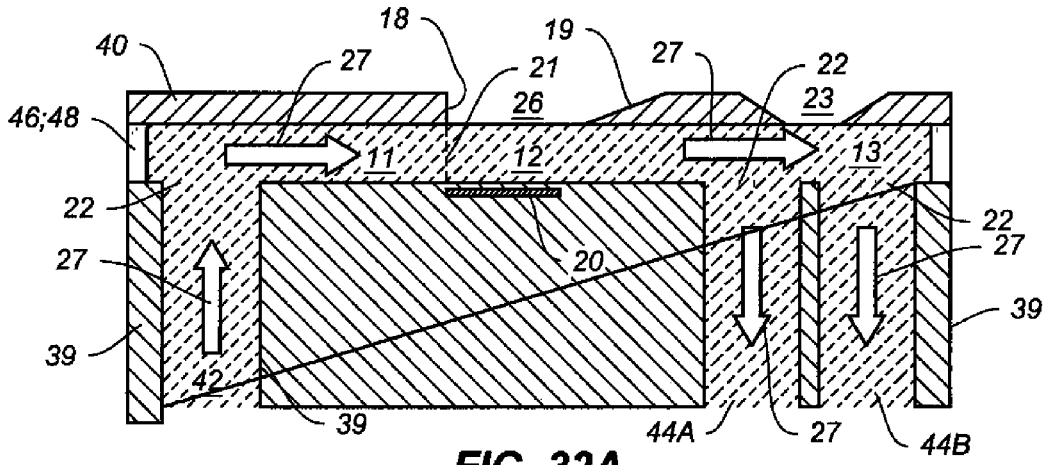
FIGS. 32A and 32B are a schematic cross sectional view and a schematic plan view, respectively, of another example embodiment of a liquid dispenser made in accordance with the present invention.
Figure 32B:
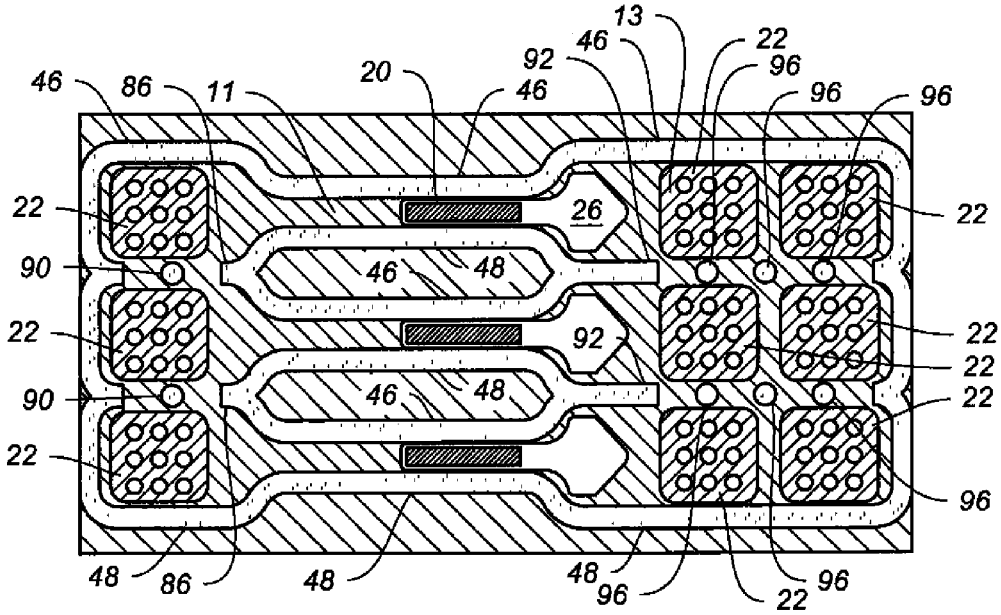

Example embodiments will now be discussed with reference to selected figures of FIGS. 27A-32B. As shown in FIGS. 27B, 30B, and 31B, an upstream portion of a first liquid supply channel, for example, liquid supply channel 11 of liquid dispensing element 82A, can share a wall 86 with an upstream portion of a second liquid supply channel, for example, liquid supply channel 11 of liquid dispensing element 82B. As shown in FIG. 28B, the shared wall 86 can include at least one opening 88 that provides fluid communication between the first liquid supply channel (liquid supply channel 11 of liquid dispensing element 82A) and the second liquid supply channel (liquid supply channel 11 of liquid dispensing element 82B). As shown in FIGS. 29B and 32B, the shared wall 86 can be divided by a post 90 (or a plurality of posts 90 in some example embodiments) to create a first opening 88A and a second opening 88B spaced apart from each other by post 90. First opening 88A and second opening 88B provide fluid communication between the first liquid supply channel (liquid supply channel 11 of liquid dispensing element 82A) and the second liquid supply channel (liquid supply channel 11 of liquid dispensing element 82B). As shown in FIGS. 27A-32B, liquid supply passage 42 can optionally include porous member 22.

As shown in FIG. 27B, a portion of a first liquid return channel, for example, liquid return channel 13 of liquid dispensing element 82A, can share a wall 92 with a portion of a second liquid return channel, for example, liquid return channel 13 of liquid dispensing element 82B. As shown in FIGS. 28B and 30B, the shared wall 92 can include at least one opening 94 that provides fluid communication between the first liquid return channel (liquid return channel 13 of liquid dispensing element 82A) and the second liquid return channel (liquid return channel 13 of liquid dispensing element 82B). As shown in FIGS. 29B, 31B, and 32B, the shared wall 92 can be divided by a plurality of posts 96 to create a first opening 94A and a second opening 94B and a third opening 94C and a fourth opening 94D spaced apart from each other by posts 96. In alternative embodiments, a single post 96 can be used to create first opening 94A and a second opening 94B. First opening 94A and second opening 94B (and third opening 94C and fourth opening 94D) provide fluid communication between the first liquid return channel (liquid return channel 13 of liquid dispensing element 82A) and the second liquid return channel (liquid return channel 13 of liquid dispensing element 82B).

As shown in FIGS. 27A-32B, in each of liquid dispensing elements 82A, 82B liquid return passage 44 includes a first liquid return passage 44A and a second liquid return passage 44B. First liquid return passage 44A and a second liquid return passage 44B are in fluid communication with liquid return channel 13. Alternative example embodiments of this aspect of the invention include using a single liquid return passage or more than two liquid return passages. Liquid return passage 44 (44A, 44B) includes porous member 22. Drain 23, positioned in wall 40 opposite substrate 39 and located downstream from outlet opening 26, spans a plurality of liquid dispensing elements 82A, 82B in some example embodiments of the invention while in other example embodiments of the invention, described above, is located between walls 46, 48 of a single liquid dispensing element 82.

Referring back to FIGS. 1A, 1B, and 27A-32B, another method of ejecting liquid from a liquid dispenser will be described. An array of liquid dispensing elements positioned on a substrate is provided. Each liquid dispensing element includes a liquid dispensing channel positioned on the substrate. The liquid dispensing channel includes an outlet opening positioned on a wall opposite the substrate. A diverter member is associated with the liquid dispensing channel. A liquid return channel is positioned on the substrate and is in fluid communication with the liquid dispensing channel. A liquid supply channel is positioned on the substrate and is in fluid communication with the liquid dispensing channel. A liquid supply passage extends through the substrate and is in fluid communication with the liquid supply channel. A liquid return passage extends through the substrate and is in fluid communication with the liquid return channel. A liquid is provided that flows from the liquid supply passage through the liquid supply channel, through the liquid dispensing channel, through the liquid return channel to the liquid return passage of the array of liquid dispensing elements. A liquid drop is ejected from the outlet opening of the liquid dispensing channel of one of the liquid dispensing elements by selectively actuating the diverter member of the liquid dispensing element to divert a portion of the flowing liquid through the outlet opening of the liquid dispensing channel of the liquid dispensing element.

A liquid drop can be ejected from the outlet opening of the liquid dispensing channel of another of the liquid dispensing elements by selectively actuating the diverter member of the other liquid dispensing element to divert a portion of the flowing liquid through the outlet opening of the liquid dispensing channel of the other liquid dispensing element Selectively actuating the diverter member to divert a portion of the flowing liquid through the outlet opening of the liquid dispensing channel can include applying heat to a portion of the liquid flowing through the liquid dispensing channel. Providing the liquid that flows from the liquid supply passage through the liquid supply channel through the liquid dispensing channel through the liquid return channel to the liquid return passage can include providing the liquid under pressure sufficient to cause the liquid to flow from the liquid supply passage through the liquid supply channel through the liquid dispensing channel through the liquid return channel to the liquid return passage liquid in a continuous manner. Additionally, providing the liquid dispenser can include providing a liquid dispenser that includes any of the example embodiments described above either alone or in combination with each other.

Figure 33A:
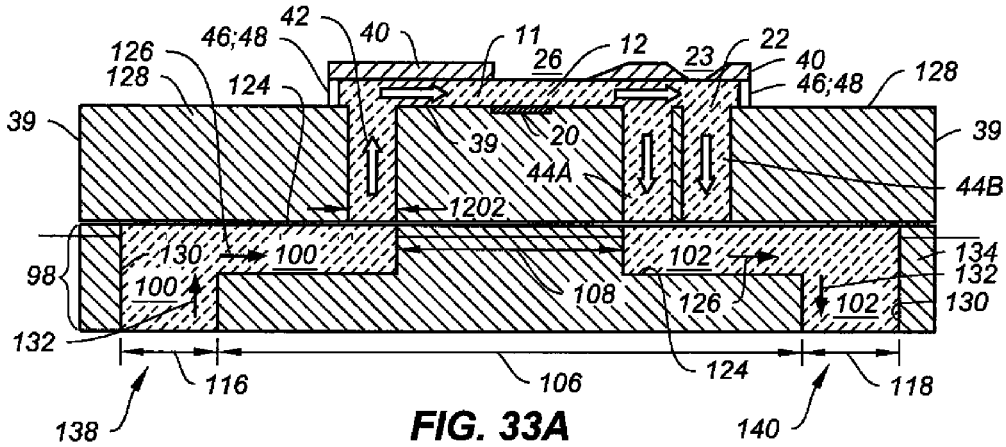
FIGS. 33A and 33B are a schematic cross sectional view and a schematic view, respectively, of another example embodiment of a liquid dispenser made in accordance with the present invention.
Figure 33B:
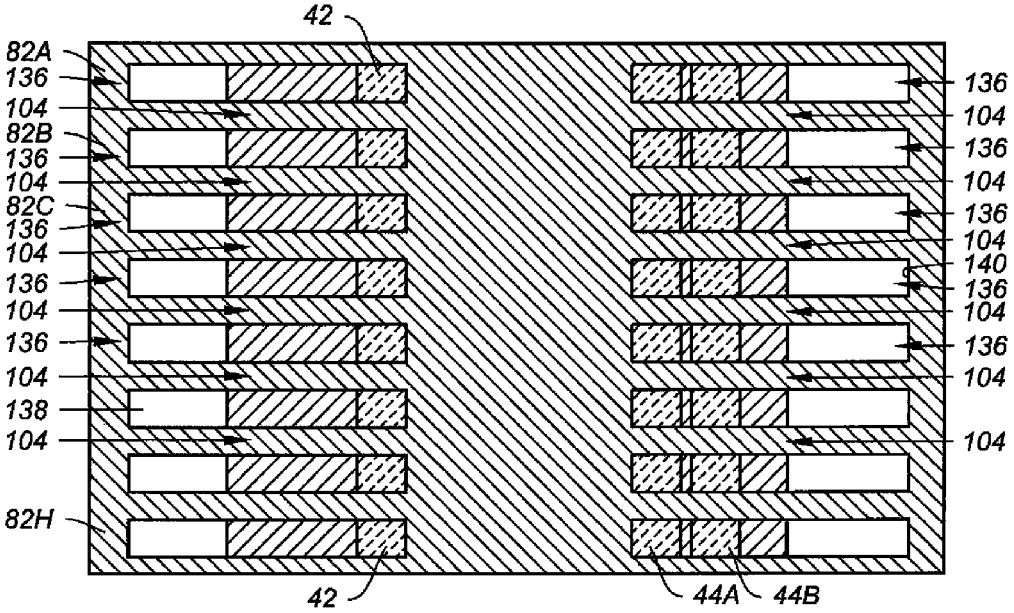
Figure 34A:
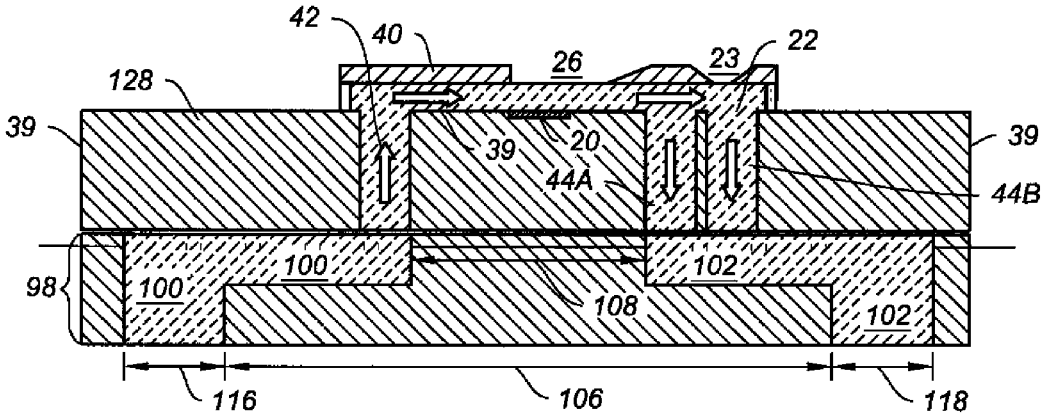
FIGS. 34A and 34B are a schematic cross sectional view and a schematic view, respectively, of another example embodiment of a liquid dispenser made in accordance with the present invention.
Figure 34B:
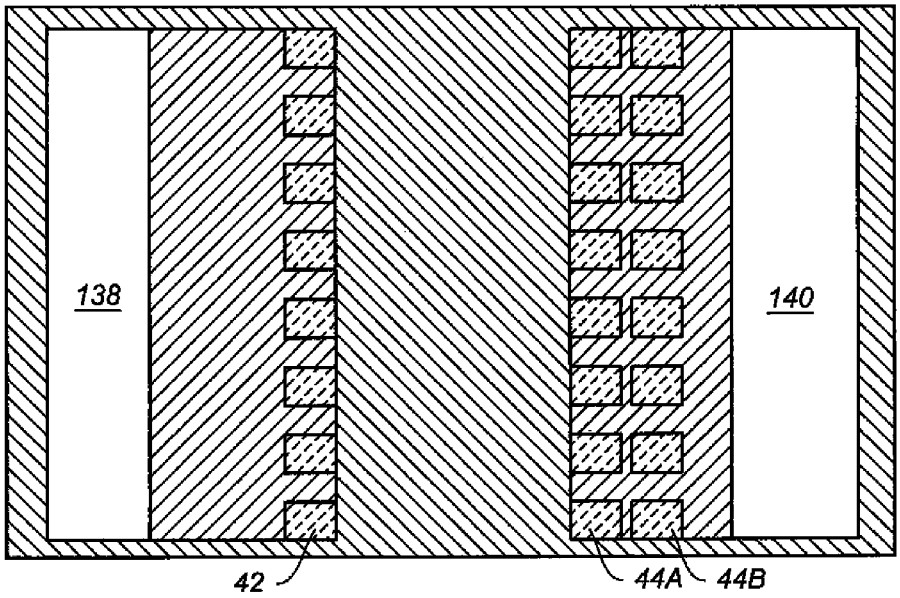
Figure 35A:
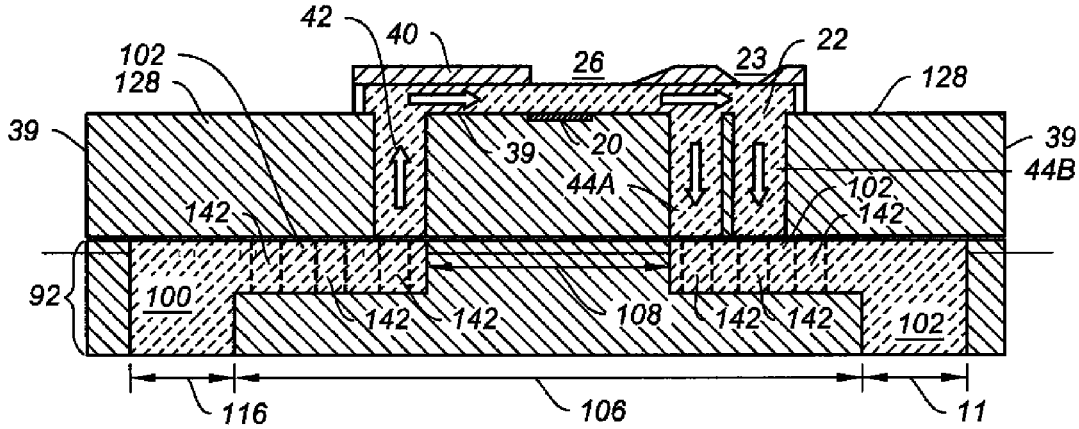
FIGS. 35A and 35B are a schematic cross sectional view and a schematic view, respectively, of another example embodiment of a liquid dispenser made in accordance with the present invention.
Figure 35B:
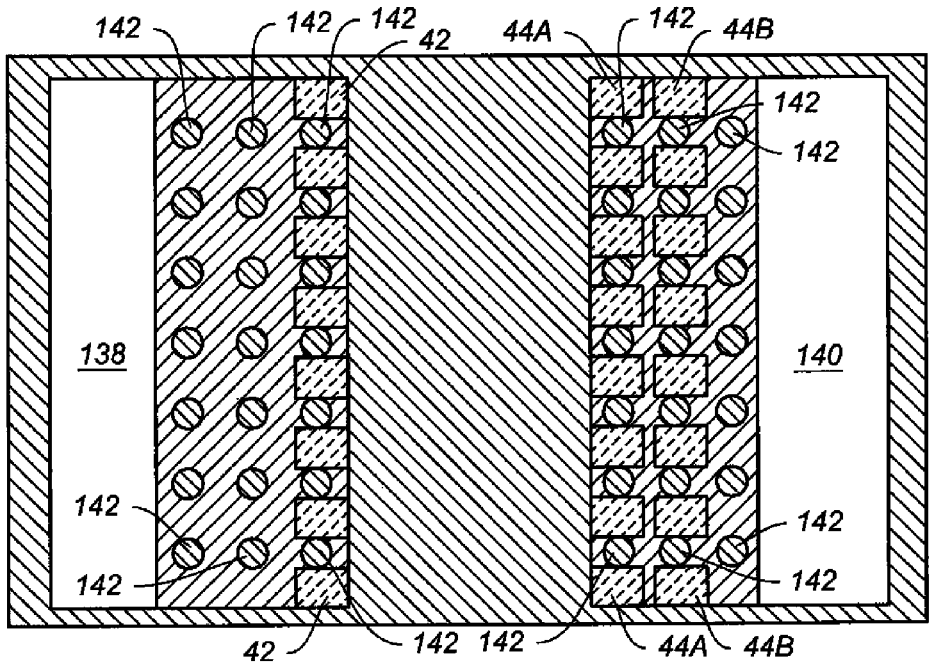

Referring to FIGS. 33A-35B and back to FIGS. 1A and 1B, example embodiments of a liquid dispenser 10 that include another aspect of the present invention are shown. FIGS. 33B, 34B, and 35B provide a view of liquid dispenser 10 taken along line X-X with the locations of liquid supply passages 42 and liquid return passages 44 (44A, 44B) superimposed to more clearly show their orientation relative to a liquid manifold 98.

Liquid dispenser 10 includes and an array of liquid dispensing elements 82A, 82B, 82C, . . . 82H (as shown in FIGS. 33B, 34B, and 35B) positioned on substrate 39. Each liquid dispensing element 82A, 82B, 82C, . . . 82H includes a liquid dispensing channel 12 positioned on substrate 39. Liquid dispensing channel 12 includes outlet opening 26 located in wall 40 opposite substrate 39. Diverter member 20 is associated with liquid dispensing channel 12. Liquid return channel 13 is positioned on substrate 39 and is in fluid communication with liquid dispensing channel 12. Liquid supply channel 11 is positioned on substrate 39 and is in fluid communication with liquid dispensing channel 12. Liquid supply passage 42 extends through substrate 39 and in fluid communication with liquid supply channel 11. Liquid return passage 44 extends through substrate 39 and is in fluid communication with liquid return channel 13. Liquid return passage 44 can be a single liquid return passage or a plurality of individual liquid return passages 44A, 44B, 44C, . . . 44H as described above.

A liquid manifold 98 includes a liquid supply duct 100 and a liquid return duct 102. The liquid supply duct 100 is in fluid communication with each liquid supply passage 42 of each liquid dispensing element 82A, 82B, 82C, . . . 82H. Liquid return duct 102 is in fluid communication with each liquid return passage 44A, 44B, 44C, . . . 44H of each liquid dispensing element 82A, 82B, 82C, . . . 82H.

A liquid supply 24 (shown in FIGS. 1A and 1B) provides a liquid 25 that flows from liquid supply duct 100 of liquid manifold 98 through each liquid dispensing element 82A, 82B, 82C, . . . 82H to liquid return duct 102 of liquid manifold 98. Each diverter member 20 is selectively activated to divert a portion of liquid 25 flowing through the associated liquid dispensing channel 12 through the outlet opening 26 of the associated liquid dispensing channel 12 to dispense a drop 15 of liquid 25.

Liquid supply duct 100 includes a liquid inlet 116 while liquid return duct 102 includes a liquid outlet 118. Liquid inlet 116 of liquid supply duct 100 and liquid outlet 118 of liquid return duct 102 are spaced apart by a first distance 106. Liquid supply passage 42 includes a liquid inlet 120 and liquid return passage 44 includes a liquid outlet 122. Liquid inlet 120 of liquid supply passage 42 and liquid outlet 122 of liquid return passage 44 are spaced apart by a second distance 108. The first distance 106 is greater than the second distance 108 so as to help facilitate fluidic connections between liquid dispenser 10 and liquid source 24.

The liquid inlet 116 of liquid supply duct 100 and the liquid outlet 118 of liquid return duct 102 are aligned relative to each other in the direction of liquid flow 27 through liquid dispensing channel 12 of one of the liquid dispensing elements 82A, 82B, 82C, . . . 82H. At least one of the liquid supply duct 100 and the liquid return duct 102 include a portion 124 positioned to provide a liquid flow 126 that is parallel to the surface 128 of substrate 39 that includes the liquid dispensing elements 82A, 82B, 82C, . . . 82H. In some example embodiments, portion 124 is a first portion 124 and at least one of the liquid supply duct 100 and the liquid return duct 102 include a second portion 130 positioned to provide a liquid flow 132 that is perpendicular to the surface 128 of substrate 39 that includes the liquid dispensing elements 82A, 82B, 82C, . . . 82H. In other example embodiments, only at least one of liquid supply duct 100 and liquid return duct 102 include a portion 130 positioned to provide a liquid flow 132 that is perpendicular to the surface 128 of substrate 39 that includes the liquid dispensing elements 82A, 82B, 82C, . . . 82H. Substrate 39 that includes the array of liquid dispensing elements 82A, 82B, 82C, . . . 82H can be referred to as a first substrate with the liquid manifold 98 being formed in a second substrate 134 that is bonded to the first substrate 39.

Example embodiments will now be discussed with reference to selected figures of FIGS. 33A-35B. As shown in FIG. 34B, liquid supply duct 100 of liquid manifold 98 is common to the liquid supply passage 42 of each liquid dispensing element 82A, 82B, 82C, . . . 82H. Additionally, as shown in FIG. 34B, liquid return duct 102 of liquid manifold 98 is common to the liquid return passage 44A, 44B, 44C, . . . 44H of each liquid dispensing element 82A, 82B, 82C, . . . 82H. In other example embodiments, only liquid return duct 102 of liquid manifold 98 is common to the liquid return passage 44A, 44B, 44C, . . . 44H of each liquid dispensing element 82A, 82B, 82C, . . . 82H.

As shown in FIG. 33B, the liquid supply duct 100 of liquid manifold 98 includes a plurality of partitions 104 which separate the liquid supply duct 100 into a plurality of segments 136. Each segment 136 is in fluid communication with a liquid dispensing element 82A, 82B, 82C, . . . 82H through a corresponding liquid supply passage 42. In this example embodiment, liquid supply duct 100 of liquid manifold 98 includes a section 138 that is common to each segment 136. The common section 138 is located upstream from the segmented section 136 as viewed along a direction of liquid flow 27. In other example embodiments, liquid supply duct 100 is segmented and includes no common section.

Liquid return duct 102 can also be segmented either by itself or in conjunction with liquid supply duct 100. As shown in FIG. 33B, the liquid return duct 102 of liquid manifold 98 includes a plurality of partitions 104 which separate the liquid return duct 100 into a plurality of segments 136. Each segment 136 is in fluid communication with a liquid dispensing element 82A, 82B, 82C, . . . 82H through a corresponding liquid return passage 44 or passages 44A, 44B, 44C, . . . 44H. In this example embodiment, liquid return duct 102 of liquid manifold 98 includes a section 140 that is common to each segment 136. The common section 138 is located downstream from the segmented section 136 as viewed along a direction of liquid flow 27. In other example embodiments, the length of liquid return duct 102 is segmented and includes no common section.

As shown in FIG. 35B, liquid supply duct 100 of liquid manifold 98 includes a plurality of posts 142 positioned in liquid supply duct 100 to provide additional mechanical support and stability. Liquid return duct 102 of liquid manifold also includes a plurality of posts 142 positioned in liquid return duct 102 that also provide additional mechanical stability and support. In other example embodiments, only liquid return duct 102 includes posts.

Referring back to FIGS. 1A, 1B, and 33A-35B, another method of ejecting liquid from a liquid dispenser will be described. An array of liquid dispensing elements positioned on a substrate is provided. Each liquid dispensing element includes a liquid dispensing channel positioned on the substrate. The liquid dispensing channel includes an outlet opening positioned on a wall opposite the substrate. A diverter member is associated with the liquid dispensing channel. A liquid return channel is positioned on the substrate in fluid communication with the liquid dispensing channel. A liquid supply channel is positioned on the substrate in fluid communication with the liquid dispensing channel. A liquid supply passage extends through the substrate and is in fluid communication with the liquid supply channel. A liquid return passage extends through the substrate and is in fluid communication with the liquid return channel. A liquid manifold is provided that includes a liquid supply duct and a liquid return duct. The liquid supply duct is in fluid communication with each liquid supply passage of each liquid dispensing element. The liquid return duct is in fluid communication with each liquid return passage of each liquid dispensing element. A liquid flows from the liquid supply duct of the liquid manifold through each liquid dispensing element to the liquid return duct of the liquid manifold. A liquid drop is ejected from the outlet opening of the liquid dispensing channel of one of the liquid dispensing elements by selectively actuating the diverter member of the liquid dispensing element to divert a portion of the flowing liquid through the outlet opening of the liquid dispensing channel of the liquid dispensing element.

A liquid drop can be ejected from the outlet opening of the liquid dispensing channel of another of the liquid dispensing elements by selectively actuating the diverter member of the other liquid dispensing element to divert a portion of the flowing liquid through the outlet opening of the liquid dispensing channel of the other liquid dispensing element Selectively actuating the diverter member to divert a portion of the flowing liquid through the outlet opening of the liquid dispensing channel can include applying heat to a portion of the liquid flowing through the liquid dispensing channel. Providing the liquid that flows from the liquid supply passage through the liquid supply channel through the liquid dispensing channel through the liquid return channel to the liquid return passage can include providing the liquid under pressure sufficient to cause the liquid to flow from the liquid supply passage through the liquid supply channel through the liquid dispensing channel through the liquid return channel to the liquid return passage liquid in a continuous manner. Additionally, providing the liquid dispenser can include providing a liquid dispenser that includes any of the example embodiments described above either alone or in combination with each other.

Referring back to FIGS. 1A-35B, wall(s) 46, 48 can be separate material layers deposited and formed over substrate 39. Alternatively, wall(s) 46, 48 can be formed from portions of substrate 39. Wall 40 can be positioned over either type of wall(s) 46, 48.

Although aspects of the present invention have been described individually, it should be understood that combinations of each aspect are considered within the scope of the present invention. As such, additional example embodiments of the present invention include any combination of aspects of the example embodiments of the present invention described above. For consistency among the illustrated example embodiments of the invention, wall 40 containing outlet opening 26 has been shown on an upper side of the device (for example, as shown in FIG. 1A). Liquid dispenser 10 is not limited to operating in such an orientation. Liquid dispenser 10 can be oriented so that the wall 40 containing the outlet opening 26 is on a lateral side of the device (for example, by rotating the liquid dispenser 10 shown in FIG. 1A by 90° either clockwise or counter clockwise) or on a lower face of the device (for example, by rotating the liquid dispenser 10 shown in FIG. 1A by 180°).

The invention has been described in detail with particular reference to certain preferred embodiments thereof, but it will be understood that variations and modifications can be effected within the scope of the invention.

PARTS LIST

10 liquid dispenser
11 liquid supply channel
12 liquid dispensing channel
13 liquid return channel
15 drop
16 regulated pressure supply source
17 regulated vacuum supply source
18 upstream edge
19 downstream edge
20 diverter member
21 exit
22 porous member
23 vent/drain
24 liquid supply
25 liquid
26 outlet opening
27 liquid flow direction/arrows
38 entrance
39 substrate
40 wall
42 liquid supply passage
44 liquid return passage
44A liquid return passage
44B liquid return passage
44C liquid return passage
46 wall
48 wall
50 upstream edge
52 downstream edge
54 surface
54A interior surface
54B exterior surface
56 corner
58 centerline
60 centerline
62 apex
64 width
66 width
68 center
70 centerline
72 upstream edge
73 downstream edge
74 wall
76 corner
78 width
80 second wall
82A liquid dispensing element
82B liquid dispensing element
82C liquid dispensing element
84 width
86 wall
88 opening
88A opening
88B opening
90 post
92 wall
94 opening
94A opening
94B opening
94C opening
94D opening
96 post
98 liquid manifold
100 liquid supply duct
102 liquid return duct
104 partitions
106 distance
108 distance
116 liquid inlet
118 liquid outlet
120 liquid inlet
122 liquid outlet
124 portion
126 liquid flow
128 surface
130 portion
132 liquid flow
134 substrate
136 segments
138 section
140 section
142 post

The invention claimed is:

1. A method of ejecting liquid from a liquid dispenser comprising:

providing a liquid dispenser including a liquid supply channel, a liquid dispensing channel, and a liquid return channel, the liquid dispensing channel including a wall, the wall including a surface, a portion of the wall defining an outlet opening, the outlet opening including a downstream edge relative to a direction of liquid flow through the liquid dispensing channel, the downstream edge being sloped relative to the surface of the wall of the liquid dispensing channel, and a liquid return channel;

providing a liquid that flows from the liquid supply channel through the liquid dispensing channel to the liquid return channel; and causing a liquid drop to be ejected from the outlet opening of the liquid dispensing channel by selectively actuating a diverter member to divert a portion of the flowing liquid through the outlet opening of the liquid dispensing channel, wherein providing the liquid that flows from the liquid supply channel through the liquid dispensing channel to the liquid return channel includes providing the liquid under pressure sufficient to cause the liquid to serve as the primary motive force for liquid drop ejection.

2. The method of claim 1, wherein causing a liquid drop to be ejected from the outlet opening of the liquid dispensing channel by selectively actuating the diverter member to divert a portion of the flowing liquid through the outlet opening of the liquid dispensing channel includes applying heat to a portion of the liquid flowing through the liquid dispensing channel.

3. The method of claim 1, wherein providing the liquid that flows from the liquid supply channel through the liquid dispensing channel to the liquid return channel includes providing the liquid under pressure sufficient to cause the liquid to flow from the liquid supply channel through the liquid dispensing channel to the liquid return channel in a continuous manner.

4. The method of claim 1, wherein the downstream edge of the outlet opening includes a radius of curvature when viewed from a direction perpendicular to the surface of the wall.

5. A method of ejecting liquid from a liquid dispenser comprising:

providing a liquid dispenser including a liquid supply channel, a liquid dispensing channel, and a liquid return channel, the liquid dispensing channel including a wall, the wall including a surface, a portion of the wall defining an outlet opening, the outlet opening including a downstream edge relative to a direction of liquid flow through the liquid dispensing channel, the downstream edge being sloped relative to the surface of the wall of the liquid dispensing channel, and a liquid return channel;

providing a liquid that flows from the liquid supply channel through the liquid dispensing channel to the liquid return channel; and causing a liquid drop to be ejected from the outlet opening of the liquid dispensing channel by selectively actuating a diverter member to divert a portion of the flowing liquid through the outlet opening of the liquid dispensing channel, the outlet opening including a centerline along the direction of the liquid flow through the liquid dispensing channel as viewed from a direction perpendicular to the surface of the wall of the liquid dispensing channel, wherein the downstream edge of the outlet opening tapers towards the centerline of the outlet opening when viewed from a direction perpendicular to the surface of the wall.

6. The method of claim 5, the taper including an apex, wherein the apex of the taper includes a radius of curvature when viewed from a direction perpendicular to the surface of the wall.

7. The method of claim 5, wherein providing the liquid that flows from the liquid supply channel through the liquid dispensing channel to the liquid return channel includes providing the liquid under pressure sufficient to cause the liquid to serve as the primary motive force for liquid drop ejection.

8. A method of ejecting liquid from a liquid dispenser comprising:

providing a liquid dispenser including a liquid supply channel, a liquid dispensing channel, and a liquid return channel, the liquid dispensing channel including a wall, the wall including a surface, a portion of the wall defining an outlet opening, the outlet opening including a downstream edge relative to a direction of liquid flow through the liquid dispensing channel, the downstream edge being sloped relative to the surface of the wall of the liquid dispensing channel, and a liquid return channel;

providing a liquid that flows from the liquid supply channel through the liquid dispensing channel to the liquid return channel; and causing a liquid drop to be ejected from the outlet opening of the liquid dispensing channel by selectively actuating a diverter member to divert a portion of the flowing liquid through the outlet opening of the liquid dispensing channel, the outlet opening including a centerline along the direction of the liquid flow through the liquid dispensing channel as viewed from a direction perpendicular to the surface of the wall of the liquid dispensing channel, the outlet opening including a shape, wherein the shape of the outlet opening is symmetric relative to the centerline of the outlet opening.

9. The method of claim 8, wherein providing the liquid that flows from the liquid supply channel through the liquid dispensing channel to the liquid return channel includes providing the liquid under pressure sufficient to cause the liquid to serve as the primary motive force for liquid drop ejection.

10. A method of ejecting liquid from a liquid dispenser comprising:

providing a liquid dispenser including a liquid supply channel, a liquid dispensing channel, and a liquid return channel, the liquid dispensing channel including a wall, the wall including a surface, a portion of the wall defining an outlet opening, the outlet opening including a downstream edge relative to a direction of liquid flow through the liquid dispensing channel, the downstream edge being sloped relative to the surface of the wall of the liquid dispensing channel, and a liquid return channel;

providing a liquid that flows from the liquid supply channel through the liquid dispensing channel to the liquid return channel; and causing a liquid drop to be ejected from the outlet opening of the liquid dispensing channel by selectively actuating a diverter member to divert a portion of the flowing liquid through the outlet opening of the liquid dispensing channel, the outlet opening including a width that is perpendicular to the direction of liquid flow through the liquid dispensing channel, the width of the outlet opening being greater at a location that is downstream relative to the diverter member.

11. The method of claim 10, wherein providing the liquid that flows from the liquid supply channel through the liquid dispensing channel to the liquid return channel includes providing the liquid under pressure sufficient to cause the liquid to serve as the primary motive force for liquid drop ejection.

12. A method of ejecting liquid from a liquid dispenser comprising:

providing a liquid dispenser including a liquid supply channel, a liquid dispensing channel, and a liquid return channel, the liquid dispensing channel including a wall, the wall including a surface, a portion of the wall defining an outlet opening, the outlet opening including a downstream edge relative to a direction of liquid flow through the liquid dispensing channel, the downstream edge being sloped relative to the surface of the wall of the liquid dispensing channel, and a liquid return channel;

providing a liquid that flows from the liquid supply channel through the liquid dispensing channel to the liquid return channel; and causing a liquid drop to be ejected from the outlet opening of the liquid dispensing channel by selectively actuating a diverter member to divert a portion of the flowing liquid through the outlet opening of the liquid dispensing channel, the dispensing channel including a width that is perpendicular to the direction of liquid flow through the liquid dispensing channel, the width of the liquid dispensing channel being greater at a location that is downstream relative to the diverter member.

13. The method of claim 12, wherein providing the liquid that flows from the liquid supply channel through the liquid dispensing channel to the liquid return channel includes providing the liquid under pressure sufficient to cause the liquid to serve as the primary motive force for liquid drop ejection.

14. A method of ejecting liquid from a liquid dispenser comprising:

providing a liquid dispenser including a liquid supply channel, a liquid dispensing channel, and a liquid return channel, the liquid dispensing channel including a wall, the wall including a surface, a portion of the wall defining an outlet opening, the outlet opening including a downstream edge relative to a direction of liquid flow through the liquid dispensing channel, the downstream edge being sloped relative to the surface of the wall of the liquid dispensing channel, and a liquid return channel;

providing a liquid that flows from the liquid supply channel through the liquid dispensing channel to the liquid return channel; and causing a liquid drop to be ejected from the outlet opening of the liquid dispensing channel by selectively actuating a diverter member to divert a portion of the flowing liquid through the outlet opening of the liquid dispensing channel, the liquid dispensing channel and the outlet opening sharing a centerline along the direction of the liquid flow through the liquid dispensing channel as viewed from a direction perpendicular to the surface of the wall of the liquid dispensing channel, the liquid dispensing channel including a shape, the outlet opening including a shape, wherein the shape of the liquid dispensing channel and the shape of the outlet opening are symmetric relative to the centerline.

15. The method of claim 14, wherein providing the liquid that flows from the liquid supply channel through the liquid dispensing channel to the liquid return channel includes providing the liquid under pressure sufficient to cause the liquid to serve as the primary motive force for liquid drop ejection.

16. A method of ejecting liquid from a liquid dispenser comprising:

providing a liquid dispenser including a liquid supply channel, a liquid dispensing channel, and a liquid return channel, the liquid dispensing channel including a wall, the wall including a surface, a portion of the wall defining an outlet opening, the outlet opening including a downstream edge relative to a direction of liquid flow through the liquid dispensing channel, the downstream edge being sloped relative to the surface of the wall of the liquid dispensing channel, and a liquid return channel;

providing a liquid that flows from the liquid supply channel through the liquid dispensing channel to the liquid return channel; and causing a liquid drop to be ejected from the outlet opening of the liquid dispensing channel by selectively actuating a diverter member to divert a portion of the flowing liquid through the outlet opening of the liquid dispensing channel, wherein the diverter member is positioned upstream relative to the downstream edge of the outlet opening.

17. The method of claim 16, wherein providing the liquid that flows from the liquid supply channel through the liquid dispensing channel to the liquid return channel includes providing the liquid under pressure sufficient to cause the liquid to serve as the primary motive force for liquid drop ejection.

* * * * *